US012281541B2

(12) United States Patent
Prevost et al.

(10) Patent No.: US 12,281,541 B2
(45) **Date of Patent: *Apr. 22, 2025**

(54) DOWNHOLE DRILLING TOOL WITH A POLYCRYSTALLINE DIAMOND BEARING

(71) Applicant: XR Reserve, LLC, Houston, TX (US)

(72) Inventors: Gregory Prevost, Spring, TX (US); Michael V. Williams, Conroe, TX (US); Edward C. Spatz, Spring, TX (US); Michael R. Reese, Houston, TX (US); William W. King, Houston, TX (US); David P. Miess, Magnolia, TX (US)

(73) Assignee: XR Reserve, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/627,141

(22) Filed: Apr. 4, 2024

(65) Prior Publication Data

US 2024/0328257 A1 Oct. 3, 2024

Related U.S. Application Data

(63) Continuation of application No. 18/300,819, filed on Apr. 14, 2023, now Pat. No. 11,994,006, which is a (Continued)

(51) Int. Cl.
*E21B 4/00* (2006.01)
*E21B 10/573* (2006.01)

(52) U.S. Cl.
CPC ..... *E21B 4/003* (2013.01); *E21B 10/573* (2013.01)

(58) Field of Classification Search
CPC ..... E21B 4/003; E21B 10/573
See application file for complete search history.

(56) References Cited

U.S. PATENT DOCUMENTS 729,694 A 6/1903 Stewart
1,798,604 A 3/1931 Hoke
(Continued)

FOREIGN PATENT DOCUMENTS

CA 1286655 C 7/1991
CA 2891268 A1 11/2016
(Continued)

OTHER PUBLICATIONS

Anonymous: "Chemical vapor deposition—Wikipedia", Dec. 27, 2023, Retrieved from the Internet on Feb. 9, 2024, https://en.wikipedia.org/wiki/Chemical_vapor_deposition#Diamond (14 pages).
(Continued)

*Primary Examiner* — Kristyn A Hall
(74) *Attorney, Agent, or Firm* — Michael S. McCoy; Amatong McCoy LLC

(57) ABSTRACT

A downhole tool for use in a downhole drill string is provided. The downhole tool includes a rotor movably coupled within a stator, and a drive shaft movably coupled within a bearing housing. The drive shaft has a first end coupled with the rotor and a second end coupled with a drill bit. Bearing assemblies interfaces engagement between the drive shaft and the bearing housing, including polycrystalline diamond elements, each with an engagement surface, and an opposing engagement surface of a non-superhard metal.

47 Claims, 28 Drawing Sheets

Related U.S. Application Data continuation of application No. 17/518,315, filed on Nov. 3, 2021, now Pat. No. 11,655,679, which is a continuation of application No. 16/561,335, filed on Sep. 5, 2019, now Pat. No. 11,187,040, which is a continuation-in-part of application No. 16/049,608, filed on Jul. 30, 2018, now Pat. No. 10,738,821.

(56) References Cited

U.S. PATENT DOCUMENTS

| | | | |
|---|---|---|---|
| 1,963,956 | A | 6/1934 | James |
| 2,259,023 | A | 10/1941 | Clark |
| 2,299,978 | A | 10/1942 | Hall |
| 2,407,586 | A | 9/1946 | Summers |
| 2,499,030 | A | 2/1950 | Moon |
| 2,567,735 | A | 9/1951 | Scott |
| 2,693,396 | A | 11/1954 | Gondek |
| 2,758,181 | A | 8/1956 | Crouch |
| 2,788,677 | A | 4/1957 | Hayek |
| 2,877,662 | A | 3/1959 | Eduard |
| 2,897,016 | A | 7/1959 | Baker |
| 2,947,609 | A | 8/1960 | Strong |
| 2,947,610 | A | 8/1960 | Hall et al. |
| 3,132,904 | A | 5/1964 | Kohei et al. |
| 3,559,802 | A | 2/1971 | Eidus |
| 3,582,161 | A | 6/1971 | Hudson |
| 3,603,652 | A | 9/1971 | Youden |
| 3,650,714 | A | 3/1972 | Farkas |
| 3,697,141 | A | 10/1972 | Garrett |
| 3,707,107 | A | 12/1972 | Bieri |
| 3,741,252 | A | 6/1973 | Williams |
| 3,745,623 | A | 7/1973 | Wentorf et al. |
| 3,752,541 | A | 8/1973 | Mcvey |
| 3,866,987 | A | 2/1975 | Garner |
| 3,869,947 | A | 3/1975 | Vandenkieboom |
| 3,920,290 | A | 11/1975 | Evarts |
| 4,085,634 | A | 4/1978 | Sattler |
| 4,182,537 | A | 1/1980 | Oster |
| 4,225,322 | A | 9/1980 | Knemeyer |
| 4,238,137 | A | 12/1980 | Furchak et al. |
| 4,285,550 | A | 8/1981 | Blackburn et al. |
| 4,364,136 | A | 12/1982 | Hattan |
| 4,382,637 | A | 5/1983 | Blackburn et al. |
| 4,398,772 | A | 8/1983 | Odell |
| 4,410,054 | A | 10/1983 | Nagel et al. |
| 4,410,284 | A | 10/1983 | Herrick |
| 4,428,627 | A | 1/1984 | Teramachi |
| 4,432,682 | A | 2/1984 | McKewan |
| 4,468,138 | A | 8/1984 | Nagel |
| 4,554,208 | A | 11/1985 | MacIver et al. |
| 4,560,014 | A | 12/1985 | Geczy |
| 4,620,601 | A | 11/1986 | Nagel |
| RE32,380 | E | 3/1987 | Wentorf, Jr. et al. |
| 4,662,348 | A | 5/1987 | Hall et al. |
| 4,679,639 | A | 7/1987 | Barr et al. |
| 4,689,847 | A | 9/1987 | Huber |
| 4,720,199 | A | 1/1988 | Geczy et al. |
| 4,729,440 | A | 3/1988 | Hall |
| 4,732,490 | A | 3/1988 | Masciarelli |
| 4,738,322 | A | 4/1988 | Hall et al. |
| 4,764,036 | A | 8/1988 | McPherson |
| 4,796,670 | A | 1/1989 | Russell et al. |
| 4,797,011 | A | 1/1989 | Saeki et al. |
| 4,858,688 | A | 8/1989 | Edwards et al. |
| 4,906,528 | A | 3/1990 | Cerceau et al. |
| 4,958,692 | A | 9/1990 | Anderson |
| 5,011,514 | A | 4/1991 | Cho et al. |
| 5,011,515 | A | 4/1991 | Frushour |
| 5,030,276 | A | 7/1991 | Sung et al. |
| 5,037,212 | A | 8/1991 | Justman et al. |
| 5,066,145 | A | 11/1991 | Sibley et al. |
| 5,067,826 | A | 11/1991 | Lemelson |
| 5,092,687 | A | 3/1992 | Hall |
| 5,112,146 | A | 5/1992 | Stangeland |
| 5,123,772 | A | 6/1992 | Anderson |
| 5,151,107 | A | 9/1992 | Cho et al. |
| 5,176,483 | A | 1/1993 | Baumann et al. |
| 5,193,363 | A | 3/1993 | Petty |
| 5,205,188 | A | 4/1993 | Repenning et al. |
| 5,253,939 | A | 10/1993 | Hall |
| 5,271,749 | A | 12/1993 | Rai et al. |
| 5,351,770 | A | 10/1994 | Cawthorne et al. |
| 5,358,041 | A | 10/1994 | O'Hair |
| 5,358,337 | A | 10/1994 | Codatto |
| 5,364,192 | A | 11/1994 | Damm et al. |
| 5,375,679 | A | 12/1994 | Biehl |
| 5,385,715 | A | 1/1995 | Fish |
| 5,447,208 | A | 9/1995 | Lund et al. |
| 5,462,362 | A | 10/1995 | Yuhta et al. |
| 5,464,086 | A | 11/1995 | Coelln |
| 5,514,183 | A | 5/1996 | Epstein et al. |
| 5,522,467 | A | 6/1996 | Stevens et al. |
| 5,533,604 | A | 7/1996 | Brierton |
| 5,538,346 | A | 7/1996 | Frias et al. |
| 5,540,314 | A | 7/1996 | Coelln |
| 5,560,716 | A | 10/1996 | Tank et al. |
| 5,618,114 | A | 4/1997 | Katahira |
| 5,645,617 | A | 7/1997 | Frushour |
| 5,653,146 | A | 8/1997 | Barton |
| 5,653,300 | A | 8/1997 | Lund et al. |
| 5,715,898 | A | 2/1998 | Anderson |
| 5,833,019 | A | 11/1998 | Gynz-Rekowski |
| 5,855,996 | A | 1/1999 | Corrigan et al. |
| 5,948,541 | A | 9/1999 | Inspektor |
| 6,045,029 | A | 4/2000 | Scott |
| 6,109,790 | A | 8/2000 | Gynz-Rekowski et al. |
| 6,120,185 | A | 9/2000 | Masciarelli |
| 6,129,195 | A | 10/2000 | Matheny |
| 6,152,223 | A | 11/2000 | Abdo et al. |
| 6,164,109 | A | 12/2000 | Bartosch |
| 6,190,050 | B1 | 2/2001 | Campbell |
| 6,209,185 | B1 | 4/2001 | Scott |
| 6,279,716 | B1 | 8/2001 | Kayatani et al. |
| 6,378,633 | B1 | 4/2002 | Moore et al. |
| 6,409,388 | B1 | 6/2002 | Lin |
| 6,457,865 | B1 | 10/2002 | Masciarelli, Jr. |
| 6,488,103 | B1 | 12/2002 | Dennis et al. |
| 6,488,715 | B1 | 12/2002 | Pope et al. |
| 6,516,934 | B2 | 2/2003 | Masciarelli, Jr. |
| 6,517,583 | B1 | 2/2003 | Pope et al. |
| 6,652,201 | B2 | 11/2003 | Kunimori et al. |
| 6,655,845 | B1 | 12/2003 | Pope et al. |
| 6,737,377 | B1 | 5/2004 | Sumiya et al. |
| 6,764,219 | B2 | 7/2004 | Doll et al. |
| 6,808,019 | B1 | 10/2004 | Mabry |
| 6,814,775 | B2 | 11/2004 | Scurlock et al. |
| 6,951,578 | B1 | 10/2005 | Belnap et al. |
| 7,007,787 | B2 | 3/2006 | Pallini et al. |
| 7,128,173 | B2 | 10/2006 | Lin |
| 7,198,043 | B1 | 4/2007 | Zhang |
| 7,234,541 | B2 | 6/2007 | Scott et al. |
| 7,311,159 | B2 | 12/2007 | Lin et al. |
| 7,441,610 | B2 | 10/2008 | Belnap et al. |
| 7,475,744 | B2 | 1/2009 | Pope |
| 7,552,782 | B1 | 6/2009 | Sexton et al. |
| 7,703,982 | B2 | 4/2010 | Cooley |
| 7,737,377 | B1 | 6/2010 | Dodal et al. |
| 7,743,654 | B2 | 6/2010 | Spross et al. |
| 7,845,436 | B2 | 12/2010 | Cooley et al. |
| 7,861,805 | B2 | 1/2011 | Dick et al. |
| 7,870,913 | B1 | 1/2011 | Sexton et al. |
| 8,069,933 | B2 | 12/2011 | Sexton et al. |
| 8,080,071 | B1 | 12/2011 | Vail |
| 8,109,247 | B2 | 2/2012 | Wakade et al. |
| 8,119,240 | B2 | 2/2012 | Cooper |
| 8,163,232 | B2 | 4/2012 | Fang et al. |
| 8,277,124 | B2 | 10/2012 | Sexton et al. |
| 8,277,722 | B2 | 10/2012 | DiGiovanni |
| 8,365,846 | B2 | 2/2013 | Dourfaye et al. |
| 8,435,317 | B2 | 5/2013 | Burgess et al. |
| 8,480,304 | B1 | 7/2013 | Cooley et al. |
| 8,485,284 | B2 | 7/2013 | Sithebe |
| 8,613,554 | B2 | 12/2013 | Tessier et al. |
| 8,627,904 | B2 | 1/2014 | Voronin |

(56) References Cited

U.S. PATENT DOCUMENTS 8,678,657 B1 3/2014 Knuteson et al.
8,701,797 B2 4/2014 Baudoin
8,734,550 B1 5/2014 Sani
8,757,299 B2 6/2014 DiGiovanni et al.
8,763,727 B1 7/2014 Cooley et al.
8,764,295 B2 7/2014 Dadson et al.
8,789,281 B1 7/2014 Sexton et al.
8,833,635 B1 9/2014 Peterson
8,881,849 B2 11/2014 Shen et al.
8,911,521 B1 12/2014 Miess et al.
8,939,652 B2 1/2015 Peterson et al.
8,974,559 B2 3/2015 Frushour
9,004,198 B2 4/2015 Kulkarni
9,010,418 B2 4/2015 Pereyra et al.
9,022,149 B2 5/2015 Lyons
9,045,941 B2 6/2015 Chustz
9,097,100 B2 8/2015 Finke et al.
9,103,172 B1 8/2015 Bertagnolli et al.
9,127,713 B1 9/2015 Lu
9,145,743 B2 9/2015 Shen et al.
9,151,326 B1 10/2015 Peterson et al.
9,222,515 B2 12/2015 Chang
9,273,381 B2 3/2016 Qian et al.
9,284,980 B1 3/2016 Miess
9,309,923 B1 4/2016 Lingwall et al.
9,353,788 B1 5/2016 Tulett et al.
9,366,085 B2 6/2016 Panahi
9,404,310 B1 8/2016 Sani et al.
9,410,573 B1 8/2016 Lu
9,429,188 B2 8/2016 Peterson et al.
9,488,221 B2 11/2016 Gonzalez
9,562,562 B2 2/2017 Peterson
9,611,885 B1 4/2017 Cooley et al.
9,643,293 B1 5/2017 Miess et al.
9,702,198 B1 7/2017 Topham
9,702,401 B2 7/2017 Gonzalez
9,732,791 B1 8/2017 Gonzalez
9,776,917 B2 10/2017 Tessitore et al.
9,790,749 B2 10/2017 Chen
9,790,818 B2 10/2017 Berruet et al.
9,803,432 B2 10/2017 Wood et al.
9,822,523 B1 11/2017 Miess
9,840,875 B2 12/2017 Harvey et al.
9,869,135 B1 1/2018 Martin
10,018,146 B2 7/2018 Azevedo et al.
10,067,258 B2 9/2018 Hill et al.
10,113,362 B2 10/2018 Ritchie et al.
10,273,800 B2 4/2019 Downie et al.
10,280,735 B2 5/2019 Finke et al.
10,294,986 B2 5/2019 Gonzalez
10,307,891 B2 6/2019 Daniels et al.
10,408,086 B1 9/2019 Meier
10,465,775 B1 11/2019 Miess et al.
10,584,534 B2 3/2020 Hagar et al.
10,683,895 B2 6/2020 Hall et al.
10,711,792 B2 7/2020 Mdalenc et al.
10,711,833 B2 7/2020 Manwill et al.
10,738,821 B2 * 8/2020 Miess ..... F16C 17/02
10,807,913 B1 10/2020 Hawks et al.
10,823,871 B2 11/2020 Donderici
10,968,700 B1 4/2021 Raymond
10,968,703 B2 4/2021 Haugvaldstad et al.
11,085,488 B2 8/2021 Gonzalez
11,118,408 B2 9/2021 Marshall et al.
11,187,040 B2 * 11/2021 Prevost ..... E21B 10/573
11,242,891 B2 * 2/2022 Miess ..... F16C 17/02
11,608,729 B2 3/2023 Hay et al.
11,608,735 B2 3/2023 Wisinger, Jr.
11,608,858 B2 * 3/2023 Prevost ..... F16H 53/06
11,619,123 B2 4/2023 Dunbar
11,643,929 B2 5/2023 Harrigan
11,655,850 B2 * 5/2023 Prevost ..... F16C 33/043
384/266
11,680,478 B2 6/2023 Simeonov et al.
11,761,481 B2 * 9/2023 Miess ..... F16C 17/02
384/416
11,802,443 B2 10/2023 Peters et al.
11,933,356 B1 * 3/2024 Prevost ..... F16C 33/043
11,994,006 B2 * 5/2024 Prevost ..... E21B 4/003
12,006,973 B2 * 6/2024 Prevost ..... F16C 33/26
12,031,574 B2 7/2024 Varghese et al.
2002/0020526 A1 2/2002 Male et al.
2002/0183122 A1 12/2002 Sone et al.
2003/0019106 A1 1/2003 Pope et al.
2003/0075363 A1 4/2003 Lin et al.
2003/0159834 A1 8/2003 Kirk et al.
2003/0220691 A1 11/2003 Songer et al.
2004/0031625 A1 2/2004 Lin et al.
2004/0134687 A1 7/2004 Radford et al.
2004/0163822 A1 8/2004 Zhang et al.
2004/0219362 A1 11/2004 Wort et al.
2004/0223676 A1 11/2004 Pope et al.
2006/0060392 A1 3/2006 Eyre
2006/0165973 A1 7/2006 Dumm et al.
2007/0046119 A1 3/2007 Cooley
2008/0085407 A1 4/2008 Cooley et al.
2008/0217063 A1 9/2008 Moore et al.
2008/0253706 A1 10/2008 Bischof et al.
2009/0020046 A1 1/2009 Marcelli
2009/0060408 A1 3/2009 Nagasaka et al.
2009/0087563 A1 4/2009 Voegele et al.
2009/0268995 A1 10/2009 Ide et al.
2010/0037864 A1 2/2010 Dutt et al.
2010/0061676 A1 3/2010 Sugiyama et al.
2010/0276200 A1 11/2010 Schwefe et al.
2010/0307069 A1 12/2010 Bertagnolli et al.
2011/0174547 A1 7/2011 Sexton et al.
2011/0203791 A1 8/2011 Jin et al.
2011/0220415 A1 9/2011 Jin et al.
2011/0297454 A1 12/2011 Shen et al.
2012/0037425 A1 2/2012 Sexton et al.
2012/0057814 A1 3/2012 Dadson et al.
2012/0225253 A1 9/2012 DiGiovanni et al.
2012/0281938 A1 11/2012 Peterson et al.
2013/0000442 A1 1/2013 Wiesner et al.
2013/0004106 A1 1/2013 Wenzel
2013/0140093 A1 6/2013 Zhou et al.
2013/0146367 A1 6/2013 Zhang et al.
2013/0170778 A1 7/2013 Higginbotham et al.
2014/0037232 A1 2/2014 Marchand et al.
2014/0064646 A1 3/2014 Meier et al.
2014/0176139 A1 6/2014 Espinosa et al.
2014/0254967 A1 9/2014 Gonzalez
2014/0341487 A1 11/2014 Cooley et al.
2014/0355914 A1 12/2014 Cooley et al.
2015/0027713 A1 1/2015 Penisson
2015/0079349 A1 3/2015 Russell et al.
2015/0132539 A1 5/2015 Bailey et al.
2015/0337949 A1 11/2015 Ziegler et al.
2016/0153243 A1 6/2016 Hinz et al.
2016/0186363 A1 6/2016 Merzaghi et al.
2016/0312535 A1 * 10/2016 Ritchie ..... E21B 4/003
2017/0030393 A1 2/2017 Phua et al.
2017/0108039 A1 4/2017 Hall et al.
2017/0138224 A1 5/2017 Henry et al.
2017/0234071 A1 8/2017 Spatz et al.
2017/0261031 A1 9/2017 Gonzalez et al.
2018/0087134 A1 3/2018 Chang et al.
2018/0209476 A1 * 7/2018 Gonzalez ..... F16C 17/03
2018/0216661 A1 8/2018 Gonzalez
2018/0264614 A1 9/2018 Winkelmann et al.
2018/0320740 A1 11/2018 Hall et al.
2019/0063495 A1 2/2019 Peterson et al.
2019/0136628 A1 5/2019 Savage et al.
2019/0170186 A1 6/2019 Gonzalez et al.
2020/0031586 A1 1/2020 Miess et al.
2020/0032841 A1 1/2020 Miess et al.
2020/0032846 A1 1/2020 Miess et al.
2020/0056659 A1 2/2020 Prevost et al.
2020/0063503 A1 2/2020 Reese et al.
2020/0182290 A1 6/2020 Doehring et al.
2020/0362956 A1 11/2020 Prevost et al.
2021/0140277 A1 5/2021 Hall et al.

(56) References Cited

U.S. PATENT DOCUMENTS

| | | | |
|---|---|---|---|
| 2021/0148406 | A1 | 5/2021 | Hoyle et al. |
| 2021/0198949 | A1 | 7/2021 | Haugvaldstad et al. |
| 2021/0207437 | A1 | 7/2021 | Raymond |
| 2021/0222734 | A1 | 7/2021 | Gonzalez et al. |
| 2023/0088047 | A1 | 3/2023 | Schiermeier et al. |
| 2023/0167734 | A1 | 6/2023 | Zimmerman et al. |
| 2023/0175382 | A1 | 6/2023 | Chen |
| 2023/0184081 | A1 | 6/2023 | Chen et al. |
| 2023/0184102 | A1 | 6/2023 | Fripp et al. |
| 2023/0184985 | A1 | 6/2023 | Hay et al. |

FOREIGN PATENT DOCUMENTS

| | | | |
|---|---|---|---|
| CN | 101273151 | B | 12/2011 |
| CN | 102128214 | B | 12/2012 |
| CN | 103069099 | A | 8/2016 |
| CN | 106151029 | A | 11/2016 |
| CN | 109072811 | A | 12/2018 |
| CN | 106678189 | A | 11/2023 |
| DE | 376227 | C | 5/1923 |
| DE | 4226986 | A1 | 2/1994 |
| DE | 29705983 | U1 | 6/1997 |
| DE | 102010052804 | A1 | 5/2012 |
| EP | 0595630 | B1 | 1/1998 |
| EP | 1860016 | B1 | 11/2007 |
| EP | 2592295 | A1 | 5/2013 |
| EP | 1931852 | B1 | 1/2018 |
| EP | 3287638 | A1 | 2/2018 |
| FR | 539497 | A | 6/1922 |
| FR | 955966 | A | 1/1950 |
| GB | 156771 | A | 4/1922 |
| GB | 614917 | A | 12/1948 |
| GB | 2514445 | B | 6/2015 |
| JP | S6061404 | A | 4/1985 |
| JP | 06174051 | A | 6/1994 |
| JP | H06241232 | A | 8/1994 |
| JP | H08106917 | A | 4/1996 |
| JP | 2000002315 | A | 1/2000 |
| JP | 2000211717 | A | 8/2000 |
| JP | 2002070507 | A | 3/2002 |
| JP | 2002363616 | A | 12/2002 |
| JP | 2004002912 | A | 1/2004 |
| JP | 2006220282 | A | 8/2006 |
| JP | 2006275286 | A | 10/2006 |
| JP | 2007153141 | A | 6/2007 |
| JP | 2007155041 | A | 6/2007 |
| JP | 2007314091 | B1 | 12/2007 |
| JP | 2008056735 | A | 3/2008 |
| JP | 2010174902 | A | 8/2010 |
| JP | 2018141197 | A | 9/2018 |
| WO | 8700080 | A1 | 1/1987 |
| WO | 2004001238 | A2 | 12/2003 |
| WO | 2006011028 | A1 | 2/2006 |
| WO | 2006028327 | A1 | 3/2006 |
| WO | 2008133197 | A1 | 11/2008 |
| WO | 2011052231 | A1 | 5/2011 |
| WO | 2013043917 | A1 | 3/2013 |
| WO | 2014014673 | A1 | 1/2014 |
| WO | 2014189763 | A1 | 11/2014 |
| WO | 2016089680 | A1 | 6/2016 |
| WO | 2017105883 | A1 | 6/2017 |
| WO | 2018041578 | A1 | 3/2018 |
| WO | 2018226380 | A1 | 12/2018 |
| WO | 2019096851 | A1 | 5/2019 |
| WO | 2020028188 | A1 | 2/2020 |

OTHER PUBLICATIONS

Anonymous: "CVD Diamond—FAQ", Feb. 8, 2024, Retrieved from the Internet on Feb. 9, 2024, http://www.cvd-diamond.com/faq_en.htm (4 pages).

Anonymous: "Diamond-like carbon—Wikipedia", Jan. 9, 2024, Retrieved from the Internet on Feb. 9, 2024, https://en.wikipedia.org/wiki/Diamond-like_carbon (10 pages).

Bovenkerk, Dr. H. P.; Bundy, Dr. F. P.; Hall, Dr. H. T.; Strong, Dr. H. M.; Wentorf, Jun., Dr. R. H.; Preparation of Diamond, Nature, Oct. 10, 1959, pp. 1094-1098, vol. 184.

Chen, Y.; Nguyen, T; Zhang, L.C.; Polishing of polycrystalline diamond by the technique of dynamic friction—Part 5: Quantitative analysis of material removal, International Journal of Machine Tools & Manufacture, 2009, pp. 515-520, vol. 49, Elsevier.

Chen, Y.; Zhang, L.C.; Arsecularatne, J.A.; Montross, C.; Polishing of polycrystalline diamond by the technique of dynamic friction, part 1: Prediction of the interface temperature rise, International Journal of Machine Tools & Manufacture, 2006, pp. 580-587, vol. 46, Elsevier.

Chen, Y.; Zhang, L.C.; Arsecularatne, J.A.; Polishing of polycrystalline diamond by the technique of dynamic friction. Part 2: Material removal mechanism, International Journal of Machine Tools & Manufacture, 2007, pp. 1615-1624, vol. 47, Elsevier.

Chen, Y.; Zhang, L.C.; Arsecularatne, J.A.; Zarudi, I., Polishing of polycrystalline diamond by the technique of dynamic friction, part 3: Mechanism exploration through debris analysis, International Journal of Machine Tools & Manufacture, 2007, pp. 2282-2289, vol. 47, Elsevier.

Chen, Y.; Zhang, L.C.; Polishing of polycrystalline diamond by the technique of dynamic friction, part 4: Establishing the polishing map, International Journal of Machine Tools & Manufacture, 2009, pp. 309-314, vol. 49, Elsevier.

Dobrzhinetskaya, Larissa F.; Green, II, Harry W.; Diamond Synthesis from Graphite in the Presence of Water and SiO2: Implications for Diamond Formation in Quartzites from Kazakhstan, International Geology Review, 2007, pp. 389-400, vol. 49.

Element six, The Element Six CVD Diamond Handbook, Accessed on Nov. 1, 2019, 28 pages.

Grossman, David, What the World Needs Now is Superhard Carbon, Popular Mechanics, https://www.popularmechanics.com/science/environment/a28970718/superhard-materials/, Sep. 10, 2019, 7 pages, Hearst Magazine Media, Inc.

Hudson Bearings Air Cargo Ball Transfers brochure, accessed on Jun. 23, 2018, 8 Pages, Columbus, Ohio.

Hudson Bearings Air Cargo Ball Transfers Installation and Maintenance Protocols, accessed on Jun. 23, 2018, pp. 1-5.

International Search Report and Written Opinion mailed Aug. 3, 2020 (issued in PCT Application No. PCT/US20/21549) [11 pages].

International Search Report and Written Opinion mailed Aug. 4, 2020 (issued in PCT Application No. PCT/US2020/034437) [10 pages].

International Search Report and Written Opinion mailed Jan. 15, 2021 (issued in PCT Application No. PCT/US2020/049382) [18 pages].

International Search Report and Written Opinion mailed Oct. 21, 2019 (issued in PCT Application No. PCT/US2019/043746) [14 pages].

International Search Report and Written Opinion mailed Oct. 22, 2019 (issued in PCT Application No. PCT/US2019/043744) [11 pages].

International Search Report and Written Opinion mailed Oct. 25, 2019 (issued in PCT Application No. PCT/US2019/044682) [20 pages].

International Search Report and Written Opinion mailed Oct. 29, 2019 (issued in PCT Application No. PCT/US2019/043741) [15 pages].

International Search Report and Written Opinion mailed Sep. 2, 2020 (issued in PCT Application No. PCT/US20/37048) [8 pages].

International Search Report and Written Opinion mailed Sep. 8, 2020 (issued in PCT Application No. PCT/US20/35316) [9 pages].

International Search Report and Written Opinion mailed Sep. 9, 2019 (issued in PCT Application No. PCT/US2019/043732) [10 pages].

International Search Report and Written Opinion mailed Sep. 9, 2020 (issued in PCT Application No. PCT/US20/32196) [13 pages].

Liao, Y.; Marks, L.; In situ single asperity wear at the nanometre scale, International Materials Reviews, 2016, pp. 1-17, Taylor & Francis.

(56) References Cited

OTHER PUBLICATIONS

Linear Rolling Bearings ME EN 7960—Precision Machine Design Topic 8, Presentation, Accessed on Jan. 26, 2020, 23 Pages, University of Utah.
Linear-motion Bearing, Wikipedia, https://en.wikipedia.org/w/index.php?title=Linear-motion_bearing&oldid=933640111, Jan. 2, 2020, 4 Pages.
Machinery's Handbook 30th Edition, Copyright Page and Coefficients of Friction Page, 2016, p. 158 (2 Pages total), Industrial Press, Inc., South Norwalk, U.S.A.
Machinery's Handbook, 2016, Industrial Press, Inc., 30th edition, pp. 843 and 1055 (6 pages total).
McCarthy, J. Michael; Cam and Follower Systems, PowerPoint Presentation, Jul. 25, 2009, pp. 1-14, UCIrvine The Henry Samueli School of Engineering.
McGill Cam Follower Bearings brochure, 2005, p. 1-19, Back Page, Brochure MCCF-05, Form #8991 (20 Pages total).
Motion & Control NSK Cam Followers (Stud Type Track Rollers) Roller Followers (Yoke Type Track Rollers) catalog, 1991, Cover Page, pp. 1-18, Back Page, CAT. No. E1421 2004 C-11, Japan.
Product Catalogue, Asahi Diamond Industrial Australia Pty. Ltd., accessed on Jun. 23, 2018, Cover Page, Blank Page, 2 Notes Pages, Table of Contents, pp. 1-49 (54 Pages total).
RBC Aerospace Bearings Rolling Element Bearings catalog, 2008, Cover Page, First Page, pp. 1-149, Back Page (152 Pages total).
RGPBalls Ball Transfer Units catalog, accessed on Jun. 23, 2018, pp. 1-26, 2 Back Pages (28 Pages total).
Sandvik Coromant Hard part turning with CBN catalog, 2012, pp. 1-42, 2 Back Pages (44 Pages total).
Sexton, Timothy N.; Cooley, Craig H.; Diamond Bearing Technology for Deep and Geothermal Drilling, PowerPoint Presentation, 2010, 16 Pages.
SKF Ball transfer units catalog, Dec. 2006, Cover Page, Table of Contents, pp. 1-36, 2 Back Pages (40 Pages total), Publication 940-711.
Sowers, Jason Michael, Examination of the Material Removal Rate in Lapping Polycrystalline Diamond Compacts, A Thesis, Aug. 2011, 2 Cover Pages, pp. iii-xiv, pp. 1-87 (101 Pages total).
Sun, Liling; Wu, Qi; Dai, Daoyang; Zhang, Jun; Qin, Zhicheng; Wang, Wenkui; Non-metallic catalysts for diamond synthesis under high pressure and high temperature, Science in China (Series A), Aug. 1999, pp. 834-841, vol. 42 No. 8, China.
Superhard Material, Wikipedia, https://en.wikipedia.org/wiki/Superhard_material, Retrieved from https://en.wikipedia.org/w/index.php?title=Superhard_material&oldid=928571597, Nov. 30, 2019, 14 pages.
Surface Finish, Wikipedia, https://en.wikipedia.org/wiki/Surface_finish,Retrieved from https://en.wikipedia.org/w/index.php?title=Surface_finish&oldid=919232937, Oct. 2, 2019, 3 pages.
United States Defensive Publication No. T102,901, published Apr. 5, 1983, in U.S. Application No. 298,271 [2 Pages].
USSynthetic Bearings and Waukesha Bearings brochure for Diamond Tilting Pad Thrust Bearings, 2015, 2 Pages.
USSynthetic Bearings brochure, accessed on Jun. 23, 2018, 12 Pages, Orem, Utah.
Zeidan, Fouad Y.; Paquette, Donald J., Application of High Speed and High Performance Fluid Film Bearings in Rotating Machinery, 1994, pp. 209-234.
Zhigadlo, N. D., Spontaneous growth of diamond from MnNi solvent-catalyst using opposed anvil-type high-pressure apparatus, accessed on Jun. 28, 2018, pp. 1-12, Laboratory for Solid State Physics, Switzerland.
Zou, Lai; Huang, Yun; Zhou, Ming; Xiao, Guijian; Thermochemical Wear of Single Crystal Diamond Catalyzed by Ferrous Materials at Elevated Temperature, Crystals, 2017, pp. 1-10, vol. 7.
International Preliminary Report on Patentability mailed Oct. 24, 2024 (issued in PCT Application No. PCT/US23/65667) [7 pages].

* cited by examiner

DOWNHOLE DRILLING TOOL WITH A POLYCRYSTALLINE DIAMOND BEARING

CROSS-REFERENCE TO RELATED APPLICATIONS

The present application is a Continuation of U.S. application Ser. No. 18/300,819, filed Apr. 14, 2024 (now Allowed), which is a Continuation of U.S. application Ser. No. 17/518,315, filed Nov. 3, 2021, (now U.S. Pat. No. 11,655,679), which is a Continuation of U.S. application Ser. No. 16/561,335, filed Sep. 5, 2019 (now U.S. Pat. No. 11,187,040), which is a Continuation-in-Part of U.S. patent application Ser. No. 16/049,608, filed Jul. 30, 2018, (now U.S. Pat. No. 10,738,821), entitled "Polycrystalline Diamond Radial Bearing", which are incorporated herein by reference for all purposes and made a part of the present disclosure.

FIELD

The present disclosure relates to tools having polycrystalline diamond radial bearings, systems including the same, and methods of making and using the same.

BACKGROUND

Radial bearings are used in tools, machines, and components to bear load. One application of radial bearings is in motors, including drilling motors. When drilling a wellbore, a drill bit is sometimes rotated via a drilling motor, which may be coupled with the drill bit via a drive shaft extending from the motor, through a bearing housing, and to the drill bit. Such couplings typically include bearings positioned between the bearing housing and the drive shaft to allow rotation of the drive shaft while the bearing housing remains generally stationary within the wellbore or rotates with the drill string.

When polycrystalline diamond elements are used as radial bearings in drilling motors, typically the spacing between adjacent polycrystalline diamond elements is minimized in order to avoid edge contact between the engagement surface of the polycrystalline diamond elements and the opposing engagement surface. Minimizing the spacing between adjacent bearing elements reduces the space on the drill string available for sensors, actuators, or other discrete downhole components.

Also, when polycrystalline diamond elements are used as radial bearings in drilling tools, typically both the engagement surface and the opposing engagement surface are composed of polycrystalline diamond. This is, at least in part, because thermally stable polycrystalline diamond (TSP), either supported or unsupported by tungsten carbide, and polycrystalline diamond compact (PDC or PCD) have been considered as contraindicated for use in the machining of diamond reactive materials. Diamond reactive materials include ferrous metals, and other metals, metal alloys, composites, hardfacings, coatings, or platings that contain more than trace amounts of diamond catalyst or solvent elements including cobalt, nickel, ruthenium, rhodium, palladium, chromium, manganese, copper, titanium, or tantalum. Further, this prior contraindication of the use of polycrystalline diamond extends to so called "superalloys", including iron-based, cobalt-based and nickel-based superalloys containing more than trace amounts of diamond catalyst or solvent elements. The surface speeds typically used in machining of such materials typically ranges from about 0.2 m/s to about 5 m/s. Although these surface speeds are not particularly high, the load and attendant temperature generated, such as at a cutting tip, often exceeds the graphitization temperature of diamond (i.e., about 700° C.), which can, in the presence of diamond catalyst or solvent elements, lead to rapid wear and failure of components. Without being bound by theory, the specific failure mechanism is believed to result from the chemical interaction of the carbon bearing diamond with the carbon attracting material that is being machined. An exemplary reference concerning the contraindication of polycrystalline diamond for diamond catalyst or solvent containing metal or alloy machining is U.S. Pat. No. 3,745,623, which is incorporated herein by reference in its entirety. The contraindication of polycrystalline diamond for machining diamond catalyst or diamond solvent containing materials has long caused the avoidance of the use of polycrystalline diamond in all contacting applications with such materials.

Polycrystalline diamond radial bearings have been developed that have polycrystalline diamond bearing surfaces that mate with non-ferrous superhard materials or, much more commonly, with tightly-matched complementary polycrystalline diamond surfaces. As used herein, a "superhard material" is a material that is at least as hard as tungsten carbide (e.g., cemented tungsten carbide or tungsten carbide tiles). An exemplary reference concerning polycrystalline diamond radial bearings, either in contact with superhard materials or with matching polycrystalline diamond, is U.S. Pat. No. 4,764,036, to McPherson and assigned to Smith International Inc., the entirety of which is incorporated herein by reference. As would be understood by one skilled in the art, hardness may be determined using the Vickers hardness test, which may be performed, for example, in accordance with ASTM E92-17.

So called high-performance polycrystalline diamond bearings are designed particularly for harsh environments, such as downhole drilling and pumping environments or wind turbine energy units, and utilize sliding, mated, overlapping polycrystalline diamond elements. This requires a large number of polycrystalline diamond elements, each shaped with an exacting outer profile. For example, rotor mounted polycrystalline diamond elements are shaped with a convex outer profile substantially matched to an outer diameter of the rotor. Stator polycrystalline diamond elements are shaped with a concave outer profile substantially matched to an inner diameter of the stator. This shaping of the polycrystalline diamond elements requires exacting precision and is expensive, requiring, for example, cutting with electrical discharge machining (EDM), lasers, or diamond grinding. The polycrystalline diamond elements must then be mounted in precise locations, at precise alignments and at precisely prescribed heights or exposures to ensure mated sliding engagement. The goal in such components is full-face contact of the polycrystalline diamond elements as bearing areas. Thus, the processes used to prepare such polycrystalline diamond elements are expensive and time consuming, with significant opportunities for variance resulting in scrapped parts. Failures in alignment and/or exposure are likely to produce so called "edge clashing" as the polycrystalline diamond elements rotate against each other producing fractured elements and ultimately resulting in bearing failure.

Less expensive radial bearings utilizing polycrystalline diamond have been proposed where a nearly full circumferential array of contoured polycrystalline diamond elements are mounted on a rotor with superhard material mounted on the stator. Although this approach requires fewer polycrystalline diamond elements than the previously described approaches, it still requires contouring of the rotor mounted elements. In addition, such so called superhard materials tend to be more brittle and prone to impact damage than the diamond reactive materials disclosed herein.

Additional significant references that inform the background of the technology of this application are from the International Journal of Machine Tools & Manufacture 46 and 47 titled "Polishing of polycrystalline diamond by the technique of dynamic friction, part 1: Prediction of the interface temperature rise" and "Part 2, Material removal mechanism" 2005 and 2006. These references report on the dynamic friction polishing of PDC faces utilizing dry sliding contact under load with a carbon attractive steel disk. Key findings in these references indicate that polishing rate is more sensitive to sliding rate than load and that the rate of thermo-chemical reaction between the steel disk and the diamond surface reduces significantly as the surface finish of the diamond surface improves. It is indicated that the thermo-chemical reaction between the steel disk and the PDC face does not occur at sliding speeds below 10.5 m/s at a pressure of 27 MPa. These references are incorporated herein by reference, as if set out in full. Copper and titanium were not typically listed in the early General Electric documentation on diamond synthesis but have been added later. Relevant references include "Diamond Synthesis from Graphite in the Presence of Water and $SiO_2$"; Dobrzhinetskaya and Green, II International Geology Review Vol. 49, 2007 and "Non-metallic catalysts for diamond synthesis under high pressure and high temperature", Sun et al, Science in China August 1999.

BRIEF SUMMARY

Some embodiments of the present disclosure include a downhole drilling tool (e.g., motor) for use in a downhole drill string. The downhole drilling motor includes a rotor movably coupled within a stator. A drive shaft is movably coupled within a bearing housing. The drive shaft has a first end coupled with the rotor and a second end coupled with a drill bit. A bearing assembly interfaces engagement between the drive shaft and the bearing housing. The bearing assembly includes a plurality of polycrystalline diamond elements. Each polycrystalline diamond element has an engagement surface. The bearing assembly includes an opposing engagement surface that includes a metal that is softer than tungsten carbide. The opposing engagement surface is movably engaged with each of the engagement surfaces. Either the plurality of polycrystalline diamond elements are coupled with the drive shaft and the opposing engagement surface is a surface on the bearing housing, or the plurality of polycrystalline diamond elements are coupled with the bearing housing and the opposing engagement surface is a surface on the drive shaft.

Other embodiments include a bearing assembly for use in a downhole drill string. The bearing assembly includes a drive shaft movably coupled within a bearing housing. The drive shaft has a first end and a second end. A bearing assembly interfaces engagement between the drive shaft and the bearing housing. The bearing assembly includes a plurality of polycrystalline diamond elements, each having an engagement surface, and an opposing engagement surface that includes a metal that is softer than tungsten carbide. The opposing engagement surface is movably engaged with each of the engagement surfaces. Either the plurality of polycrystalline diamond elements are coupled with the drive shaft and the opposing engagement surface is a surface on the bearing housing, or the plurality of polycrystalline diamond elements are coupled with the bearing housing and the opposing engagement surface is a surface on the drive shaft.

Other embodiments include a method of bearing radial and thrust load in a drill string bearing assembly. The method includes coupling a drive shaft within a bearing housing. The drive shaft has a first end and a second end. Coupling the drive shaft within the bearing housing includes interfacing engagement between the drive shaft and the bearing housing with a bearing assembly. The bearing assembly includes a plurality of polycrystalline diamond elements, each having an engagement surface, and an opposing engagement surface including a metal that is softer than tungsten carbide. The opposing engagement surface is movably engaged with each of the engagement surfaces. Either the plurality of polycrystalline diamond elements are coupled with the drive shaft and the opposing engagement surface is a surface on the bearing housing, or the plurality of polycrystalline diamond elements are coupled with the bearing housing and the opposing engagement surface is a surface on the drive shaft. The method includes bearing radial and thrust loads on the drive shaft with the bearing assembly.

Other embodiments of the present disclosure includes a method of designing a bearing assembly for a drive shaft and bearing housing of a downhole drilling motor. The bearing assembly includes polycrystalline diamond elements, each including an engagement surface in sliding engagement with an opposing engagement surface. The opposing engagement surface includes a metal that is softer than tungsten carbide. The method includes determining if a maximum sliding speed of the drive shaft and the bearing housing is less than a preset limit. If the maximum sliding speed is less than the preset limit, the method includes selecting a configuration of the bearing assembly within the drive shaft and bearing housing. The method includes calculating a maximum contact pressure per polycrystalline diamond element based on a selected number of polycrystalline diamond elements in the selected configuration of the bearing assembly within the drive shaft and bearing housing, and based on anticipated load. The calculated maximum contact pressure is optionally multiplied by a safety factor. The method includes determining if the calculated maximum contact pressure, optionally multiplied by the safety factor, is below a preset maximum allowable pressure. If the calculated maximum contact pressure is determined to be below the preset maximum allowable pressure, the method includes deploying at least a minimum number of the polycrystalline diamond elements on the selected configuration of the bearing assembly within the drive shaft and bearing housing. If the number of the polycrystalline diamond elements fit on the selected configuration of the bearing assembly within the drive shaft and bearing housing, the method includes making the bearing assembly for the drive shaft and bearing housing.

BRIEF DESCRIPTION OF THE DRAWINGS

So that the manner in which the features and advantages of the systems, apparatus, and/or methods of the present disclosure may be understood in more detail, a more particular description briefly summarized above may be had by reference to the embodiments thereof which are illustrated in the appended drawings that form a part of this specification. It is to be noted, however, that the drawings illustrate only various exemplary embodiments and are therefore not to be considered limiting of the disclosed concepts as it may include other effective embodiments as well.

Figure 1:
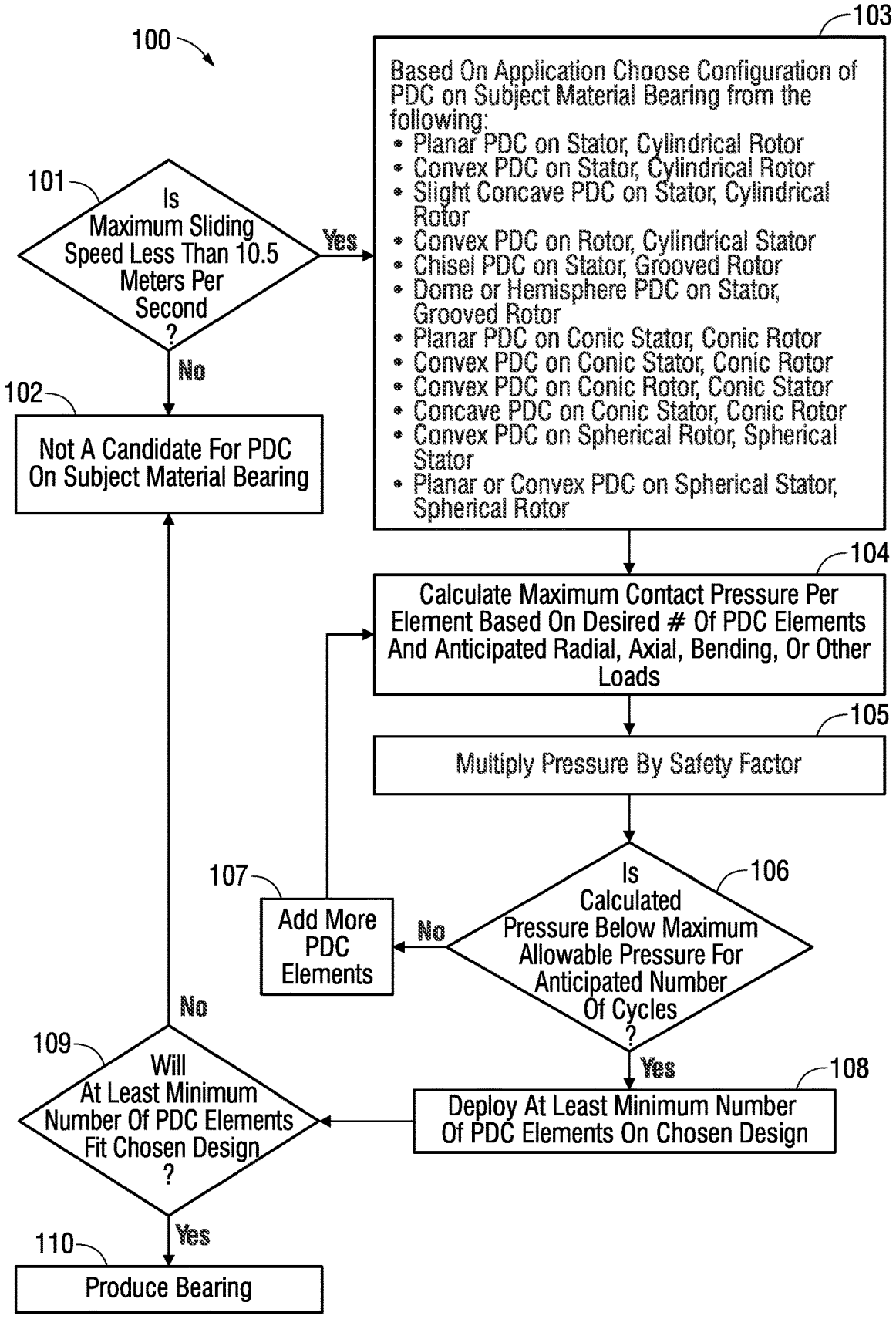
FIG. 1 is a flow chart showing generalized evaluation criteria for the use of the technology disclosed herein.

Systems, apparatus, and methods according to present disclosure will now be described more fully with reference to the accompanying drawings, which illustrate various exemplary embodiments. Concepts according to the present disclosure may, however, be embodied in many different forms and should not be construed as being limited by the illustrated embodiments set forth herein. Rather, these embodiments are provided so that this disclosure will be thorough as well as complete and will fully convey the scope of the various concepts to those skilled in the art and the best and preferred modes of practice.

DETAILED DESCRIPTION

Certain embodiments of the present disclosure include tools (e.g., motors) and components thereof having polycrystalline radial bearings, systems including the same, and methods of making and using the same. The motors disclosed herein may be drilling motors for downhole drilling, including directional drilling, such as mud motors. Certain embodiments include drives shafts having polycrystalline diamond radial bearings thereon. For convenience, certain parts of the following descriptions disclose a stator component and a rotor component. However, it would be understood by one skilled in the technology disclosed herein may be applied to parts that are movably engaged other than stators and rotors, such as a drive shaft movably coupled within a housing. Also, for convenience, certain parts of the following descriptions present an outer stator component and an inner rotor component. However, it would be understood by one skilled in the art that the inner component may be held static and the outer component may be rotated. Additionally, it would be understood by one skilled in the art that, although the descriptions of the disclosure are directed to rotor and stator configurations, the technology disclosed herein is not limited to such applications and may be applied in various other applications including discrete bearings with an inner and outer race where the outer and inner races both rotate or where either one or the other of the outer and inner races is held stationary.

Definitions, Examples, and Standards

Diamond Reactive Materials—As used herein, a "diamond reactive material" is a material that contains more than trace amounts of diamond catalyst or diamond solvent. As used herein, a diamond reactive material that contains more than "trace amounts" of diamond catalyst or diamond solvent, contains at least 2 percent by weight (wt. %) diamond catalyst or diamond solvent. In some aspects, the diamond reactive materials disclosed herein contain from 2 to 100 wt. %, or from 5 to 95 wt. %, or from 10 to 90 wt. %, or from 15 to 85 wt. %, or from 20 to 80 wt. %, or from 25 to 75 wt. %, or from 25 to 70 wt. %, or from 30 to 65 wt. %, or from 35 to 60 wt. %, or from 40 to 55 wt. %, or from 45 to 50 wt. % of diamond catalyst or diamond solvent. As used herein, a "diamond catalyst" is a chemical element, compound, or material capable of catalyzing graphitization of polycrystalline diamond, such as under load and at a temperature at or exceeding the graphitization temperature of diamond (i.e., about 700° C.). As used herein, a "diamond solvent" is a chemical element, compound, or material capable of solubilizing polycrystalline diamond, such as under load and at a temperature at or exceeding the graphitization temperature of diamond. Thus, diamond reactive materials include materials that, under load and at a temperature at or exceeding the graphitization temperature of diamond, can lead to wear, sometimes rapid wear, and failure of components formed of or including polycrystalline diamond, such as diamond tipped tools. Diamond reactive materials include, but are not limited to, metals, metal alloys, and composite materials that contain more than trace amounts of diamond catalyst or solvent elements. In some aspects, the diamond reactive materials are in the form of hardfacings, coatings, or platings. For example, and without limitation, the diamond reactive material may be ferrous, cobalt, nickel, ruthenium, rhodium, palladium, chromium, manganese, copper, titanium, tantalum, or alloys thereof. In some aspects, the diamond reactive material is a superalloy including, but not limited to, iron-based, cobalt-based and nickel-based superalloys. In certain aspects, the diamond reactive material is not and/or does not include (i.e., specifically excludes) so called "superhard materials." As would be understood by one skilled in the art, "superhard materials" are a category of materials defined by the hardness of the material, which may be determined in accordance with the Brinell, Rockwell, Knoop and/or Vickers scales. For example, superhard materials include materials with a hardness value exceeding 40 gigapascals (GPa) when measured by the Vickers hardness test. As used herein, superhard materials include materials that are at least as hard as tungsten carbide tiles and/or cemented tungsten carbide, such as is determined in accordance with one of these hardness scales, such as the Brinell scale. One skilled in the art would understand that a Brinell scale test may be performed, for example, in accordance with ASTM E10-18; the Vickers hardness test may be performed, for example, in accordance with ASTM E92-17; the Rockwell hardness test may be performed, for example, in accordance with ASTM E18; and the Knoop hardness test may be performed, for example, in accordance with ASTM E384-17. The "superhard materials" disclosed herein include, but are not limited to, tungsten carbide (e.g., tile or cemented), infiltrated tungsten carbide matrix, silicon carbide, silicon nitride, cubic boron nitride, and polycrystalline diamond. Thus, in some aspects, the "diamond reactive material" is partially or entirely composed of material(s) (e.g., metal, metal alloy, composite) that is softer (less hard) than superhard materials, such as less hard than tungsten carbide (e.g., tile or cemented), as determined in accordance with one of these hardness tests, such as the Brinell scale.

Interfacing Polycrystalline Diamond with Diamond Reactive Materials—In some aspects, the present disclosure provides for interfacing the engagement between a rotor and stator with a polycrystalline diamond element in contact with a diamond reactive material. For example, the polycrystalline diamond element may be positioned and arranged on the stator for sliding contact with the rotor, where the rotor is formed of or includes at least some diamond reactive material. Alternatively, the polycrystalline diamond element may be positioned and arranged on the rotor for sliding contact with the stator, where the stator is formed of or includes at least some diamond reactive material. The polycrystalline diamond element may have an engagement surface for engagement with an opposing engagement surface of the diamond reactive material. As used herein, "engagement surface" refers to the surface of a material (e.g., polycrystalline diamond or diamond reactive materials) that is positioned and arranged within a bearing assembly such that, in operation of the bearing assembly, the engagement surface interfaces the contact between the two components (e.g., between the stator and the rotor). The "engagement surface" may also be referred to herein as the "bearing surface". In some aspects the opposing engagement surface includes or is composed of at least 2 wt. % of diamond reactive material, or from 2 to 100 wt. %, or from 5 to 95 wt. %, or from 10 to 90 wt. %, or from 15 to 85 wt. %, or from 20 to 80 wt. %, or from 25 to 75 wt. %, or from 25 to 70 wt. %, or from 30 to 65 wt. %, or from 35 to 60 wt. %, or from 40 to 55 wt. %, or from 45 to 50 wt. % of diamond reactive material.

Lapped or Polished—In certain applications, the polycrystalline diamond element, or at least the engagement surface thereof, is lapped or polished, optionally highly lapped or highly polished. Although highly polished polycrystalline diamond elements are preferred in at least some applications, the scope of this disclosure is not limited to highly polished polycrystalline diamond elements and includes polycrystalline diamond elements that are highly lapped or polished. As used herein, a surface is defined as "highly lapped" if the surface has a surface finish of 20 μin or about 20 μin, such as a surface finish ranging from about 18 to about 22 μin. As used herein, a surface is defined as "polished" if the surface has a surface finish of less than about 10 μin, or of from about 2 to about 10 μin. As used herein, a surface is defined as "highly polished" if the surface has a surface finish of less than about 2 μin, or from about 0.5 μin to less than about 2 μin. In some aspects, engagement surface 101 has a surface finish ranging from 0.5 μin to 40 μin, or from 2 μin to 30 μin, or from 5 μin to 20 μin, or from 8 μin to 15 μin, or less than 20 μin, or less than 10 μin, or less than 2 μin, or any range therebetween. Polycrystalline diamond that has been polished to a surface finish of 0.5 μin has a coefficient of friction that is about half of standard lapped polycrystalline diamond with a surface finish of 20-40 μin. U.S. Pat. Nos. 5,447,208 and 5,653,300 to Lund et al., the entireties of which are incorporated herein by reference, provide disclosure relevant to polishing of polycrystalline diamond. As would be understood by one skilled in the art, surface finish may be measured with a profilometer or with Atomic Force Microscopy. Table 1, below, sets for a summary of coefficients of friction for various materials, including polished polycrystalline diamond, in both a dry, static state and a lubricated, static state, where the "first material" is the material that is moved relative to the "second material" to determine the CoF of the first material.

TABLE 1

| First Material | Second Material | Dry Static | Lubricated Static |
|---|---|---|---|
| Hard Steel | Hard Steel | 0.78 | 0.05-0.11 |
| Tungsten Carbide | Tungsten Carbide | 0.2-0.25 | 0.12 |
| Diamond | Metal | 0.1-0.15 | 0.1 |
| Diamond | Diamond | 0.1 | 0.05-0.1 |
| Polished | Polished | Estimated | Estimated |
| PDC | PDC | 0.08-1 | 0.05-0.08 |
| Polished | Hard Steel | Estimated | Estimated |
| PDC | | 0.08-0.12 | 0.08-0.1 |

*References include Machinery's Handbook; Sexton TN, Cooley CH. Polycrystalline diamond thrust bearings for down-hole oil and gas drilling tools. Wear 2009; 267:1041-5.

Evaluation Criteria

FIG. 1 depicts flow chart 100 of an emblematic generalized set of evaluation criteria for the use of the technology of this application in a dry, non-lubricated environment. As indicated by box 101, first it is evaluated if the maximum sliding speed in an application is less than 10.5 m/s. As used herein the "sliding speed", also referred to as the "sliding interface speed", is the speed with which two components in contact move relative to one another (e.g., the speed at which a rotor, in contact with a stator, moves relative to the stator). While FIG. 1 is described with respect to a rotor and stator, the same method may be applied a drive shaft and a bearing housing, or other components that are movably engaged.

If it is determined that the maximum sliding speed is not be less than 10.5 m/s, then, as indicated by box 102, it is determined that the evaluated application is not a candidate for use of a polycrystalline diamond element is sliding engagement with a diamond reactive material because the sliding speed is too high. One skilled in the art would understand that, in a lubricated or wet environment, the sliding interface speed can be significantly higher than in a dry, non-lubricated environment (as is herein evaluated).

If it is determined that the maximum sliding speed is less than 10.5 m/s, then, as indicated by box 103, the configuration (e.g., shape, size, and arrangement) of the polycrystalline diamond element is selected depending on the particular application at hand. Box 103 sets forth various non-limiting polycrystalline diamond element configurations for sliding engagement with diamond reactive materials in various bearing configurations. For example, a planar polycrystalline diamond element may be selected for use on a stator that is engaged with a cylindrical rotor formed of or including at least some diamond reactive material; a convex polycrystalline diamond element may be selected for use on a stator that is engaged with a cylindrical rotor formed of or including at least some diamond reactive material; a polycrystalline diamond element having a concave, or at least slightly concave, surface may be selected for use on a stator that is engaged with a cylindrical rotor formed of or including at least some diamond reactive material; a polycrystalline diamond element having a convex, or at least slightly convex, surface may be selected for use on a rotor that is engaged with a cylindrical stator formed of or including at least some diamond reactive material; a chisel shaped polycrystalline diamond element may be selected for use on a stator that is engaged with a grooved rotor formed of or including at least some diamond reactive material; a dome or hemisphere shaped polycrystalline diamond element may be selected for use on a stator that is engaged with a grooved rotor formed of or including at least some diamond reactive material; a planar polycrystalline diamond element may be selected for use on a conic shaped stator that is engaged with a conic shaped rotor formed of or including at least some diamond reactive material; a polycrystalline diamond element having a convex, or at least slightly convex, surface may be selected for use on a conic shaped stator that is engaged with a conic shaped rotor formed of or including at least some diamond reactive material; a polycrystalline diamond element having a convex, or at least slightly convex, surface may be selected for use on a conic shaped rotor that is engaged with a conic shaped stator formed of or including at least some diamond reactive material; a polycrystalline diamond element having a concave, or at least slightly concave, surface may be selected for use on a conic shaped stator that is engaged with a conic shaped rotor formed of or including at least some a diamond reactive material; a polycrystalline diamond element having a convex, or at least slightly convex, surface may be selected for use on a spherical shaped rotor that is engaged with a spherical shaped stator formed of or including at least some diamond reactive material; or a polycrystalline diamond element having a planar, convex, or at least slightly convex surface may be selected for use on a spherical shaped stator that is engaged with a spherical shaped rotor formed of or including at least some diamond reactive material. One skilled in the art would understand that the present disclosure is not limited to these particular selected shapes and contours, and that the shapes, including surface contouring, of the rotors, stators, polycrystalline diamond elements, and other application specific components may vary depending on the particular application.

After selecting the configuration, as set forth in box 103, the maximum contact pressure per polycrystalline diamond element is calculated. As set forth in box 104, the maximum contact pressure per polycrystalline diamond element is calculated based on the number of polycrystalline diamond elements and the anticipated load, including radial, axial, bending, or other loads. The maximum contact pressure may be determined by methods known to those skilled in the art.

After calculation of the maximum contact pressure per polycrystalline diamond element, the calculated maximum pressure per polycrystalline diamond element is multiplied by a safety factor, as set forth in box 105. The application of the safety factor, over and above the maximum pressure determined in box 104, may be set and applied at the discretion of a designer, for example. Thus, the safety factor, if applied, provides for a reduced pressure per polycrystalline diamond element relative to the maximum contact pressure per polycrystalline diamond element.

In box 106, it is determined whether the calculated maximum pressure is below maximum allowable pressure for anticipated cycles of the apparatus. As would be understood by those skilled in the art, the fatigue on the diamond reactive material is the limiting factor. The load is at the diamond/diamond reactive material (e.g., metal) interface. The more the PDC elements in an assembly, the lower the instant load on the metal. S-N curves (contact stress to cycles) can be used to facilitate making the determination in box 106.

If, per box 106, it is determined that the calculated pressure is not below the maximum allowable pressure, then, as indicated in box 107, additional polycrystalline diamond elements are deployed to the design configuration that was selected in box 103. After these additional polycrystalline diamond elements are deployed, the thus modified design configuration is evaluated per boxes 104 and 105 before being, once again, assessed per the criteria of box 106.

If, per box 106, it is determined that the calculated pressure is below the maximum allowable pressure, then, as indicated in box 108, the proposed design configuration is then created by deploying at least the minimum number of polycrystalline diamond elements indicated as required by the prior boxes 101-106 onto the components of the chosen design configuration of box 103 (e.g., attaching the minimum number of polycrystalline diamond elements onto the stator or rotor).

At box 109, it is determined whether the minimum number of polycrystalline diamond elements, per box 108, will fit on the chosen configuration of box 103. If it is determined that, the minimum number of polycrystalline diamond elements will fit on the chosen configuration of box 103, then the bearing assembly in the rotor and stator is produced, as shown in box 110. If it determined that the minimum number of polycrystalline diamond elements will not fit on the chosen configuration of box 103, then the chosen configuration of box 103 is determined to not be a candidate for use of a polycrystalline diamond element in sliding engagement with a diamond reactive material, per box 102.

The designer of the bearing configuration would also have the option (not shown) of choosing an alternative bearing configuration from box 103 if the required minimum number of polycrystalline diamond elements will not fit on the originally chosen design configuration. Alternatively, the safety factor can be lowered to reduce the minimum number of polycrystalline diamond elements required. One skilled in the art would understand that the criteria set forth in FIG. 1 is exemplary only, that other criteria may be evaluated depending on the particular application, and that, for at least some applications, some of the criteria set forth in FIG. 1 may be left out without departing from the scope of this disclosure.

Various exemplary rotor and stator radial bearing assemblies will now be described with reference to FIGS. 2A-13B. In FIGS. 2A-13B, like reference numerals refer to like elements. For example, an exemplary assembly is identified with reference numeral "200" in FIGS. 2A and 2B and is identified with reference numeral "300" in FIGS. 3A and 3B.

Stator with Planar Polycrystalline Diamond Element

Figure 2A:
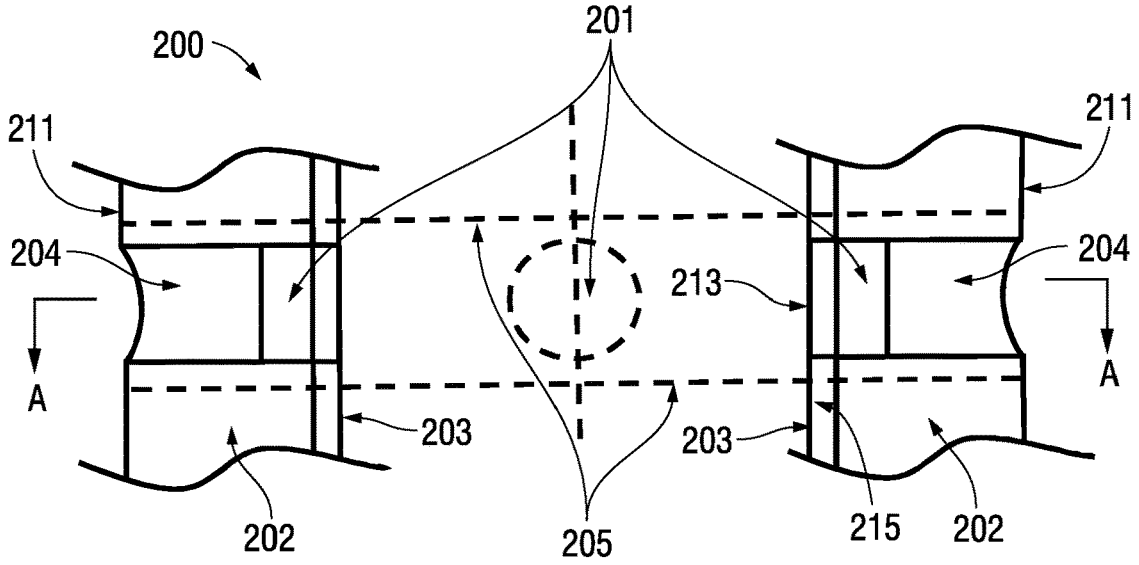
FIG. 2A is a partial side view of a rotor and stator radial bearing assembly of an embodiment of the technology of this application.
Figure 2B:
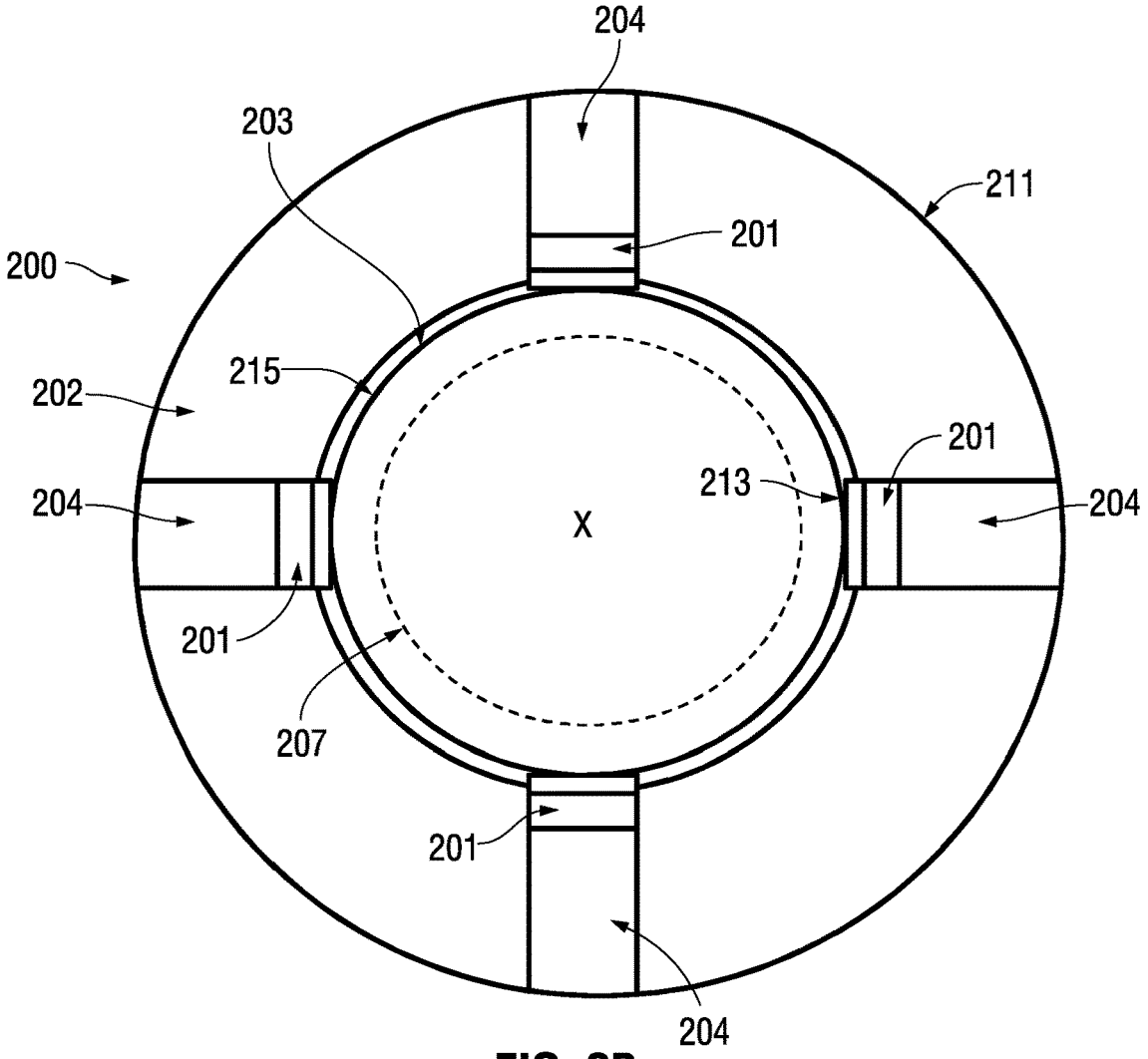
FIG. 2B is a cross-sectional view of the rotor and stator radial bearing assembly of FIG. 2A taken along line A-A.

FIG. 2A is a partial side view of a rotor and stator radial bearing assembly, and FIG. 2B is a cross-sectional view of the rotor and stator radial bearing assembly of FIG. 2A taken along line A-A. With reference to both FIGS. 2A and 2B, rotor and stator radial bearing assembly 200 will be described.

Rotor and stator radial bearing assembly 200 includes stator 202 engaged with rotor 203. Four planar polycrystalline diamond elements 201 are fitted into stator 202 to provide for sliding engagement between stator 202 and rotor 203, where rotor 203 is formed of or includes at least some diamond reactive material. Polycrystalline diamond elements 201 are deployed (e.g., mechanically fitted) in stator 202 within loading ports 204, which are ports formed in and/or positioned within stator body 211. For example, and without limitation, each polycrystalline diamond element 201 may be press fit, glued, brazed, threaded, or otherwise mounted on stator 202 (or rotor in other applications) via methods known to those skilled in the art. One skilled in the art would understand that the present disclosure is not limited to these particular attachment methods or to the use of ports within the stator body, and that the polycrystalline diamond elements may be attached to the stator or rotor by any of a variety of methods. Further, while shown as including equally spaced, planar polycrystalline diamond elements, one skilled in the art would understand that the number, spacing, armament, shape, and size of the polycrystalline diamond elements may vary depending upon any number of various design criteria including, but not limited to, the criteria set forth in FIG. 1. In some aspects, polycrystalline diamond elements are composed of thermally stable polycrystalline diamond, either supported or unsupported by tungsten carbide, or polycrystalline diamond compact.

Each polycrystalline diamond element 201 includes an engagement surface 213 (here shown as planar surfaces), and rotor 203 includes opposing engagement surface 215. Polycrystalline diamond elements 201 are positioned on stator 202 in secure contact with rotor 203, to limit lateral movement of rotor 203 while allowing for free sliding rotation of rotor 203 during operation. Polycrystalline diamond elements 201 are positioned and arranged such that engagement surfaces 213 are in contact (e.g., sliding contact) with opposing engagement surface 215. Thus, engagement surfaces 213 and opposing engagement surface 215 interface the sliding contact between rotor 203 and stator 202. In some embodiments, rotor 203 has a rotational velocity, engagement between engagement surface 213 and opposing engagement surface 215 defines a contact area that is independent of the rotational velocity of rotor 203. In some embodiments, rotor 203 has a variable rotational velocity, and engagement surface 213 follows an engagement path on opposing engagement surface 215 that is constant through the variable rotational velocities.

FIGS. 2A and 2B depict a rotor and stator such as would be used in a downhole pump or motor. However, one skilled in the art would understand that radial bearings for other applications, as well as discrete radial bearings, may be designed and manufactured in the same or similar manner in accordance with this disclosure. Non-limiting proximal and distal dimensions for such a discrete bearing are indicated by dashed lines 205 shown in FIG. 2A. As shown in FIG. 2B, optionally, a through bore 207 is provided in rotor 203, which could be used in a discrete bearing, for example. As is evident in FIG. 2B, polycrystalline diamond elements 201 are deployed in stator 202 to radially support and provide sliding engagement with rotor 203.

Although FIGS. 2A and 2B depict an assembly that includes four polycrystalline diamond elements 201, one skilled in the art would understand that less than four polycrystalline diamond elements, such as three polycrystalline diamond elements, or more than four polycrystalline diamond elements may be used depending on the particular application and configuration, such as the space available such polycrystalline diamond elements on the stator or rotor. Further, although FIGS. 2A and 2B show a single circumferential set of polycrystalline diamond elements 201, it would be understood by those skilled in the art that one or more additional circumferential sets of polycrystalline diamond elements may be deployed in the stator (or rotor) to increase lateral support and lateral load taking capability of the bearing assembly.

Stator with Convex Polycrystalline Diamond Element

Figure 3A:
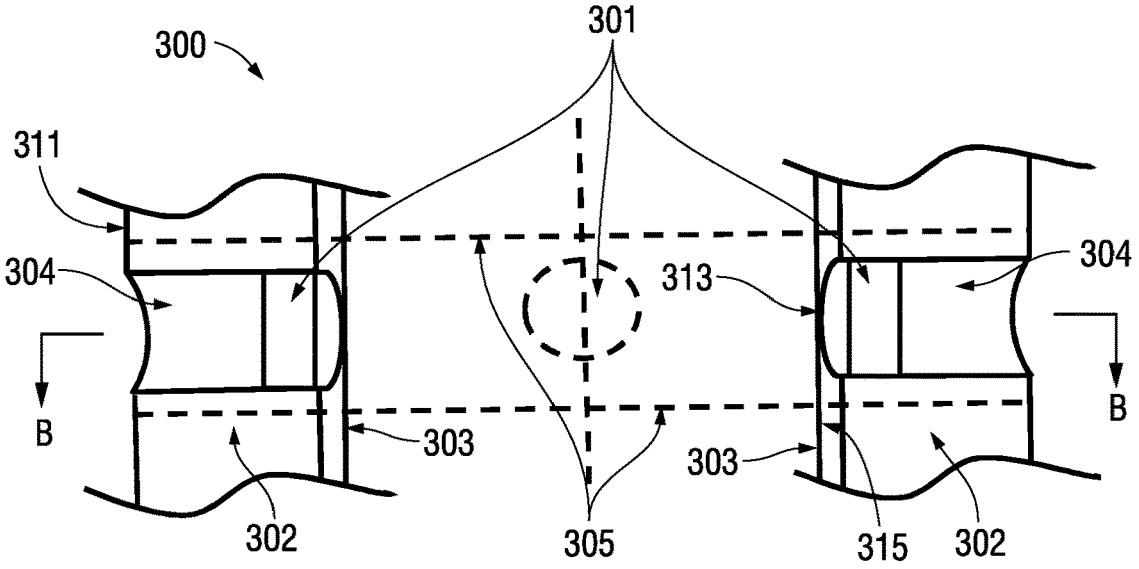
FIG. 3A is a partial side view of a rotor and stator radial bearing assembly of an embodiment of the technology of this application.
Figure 3B:
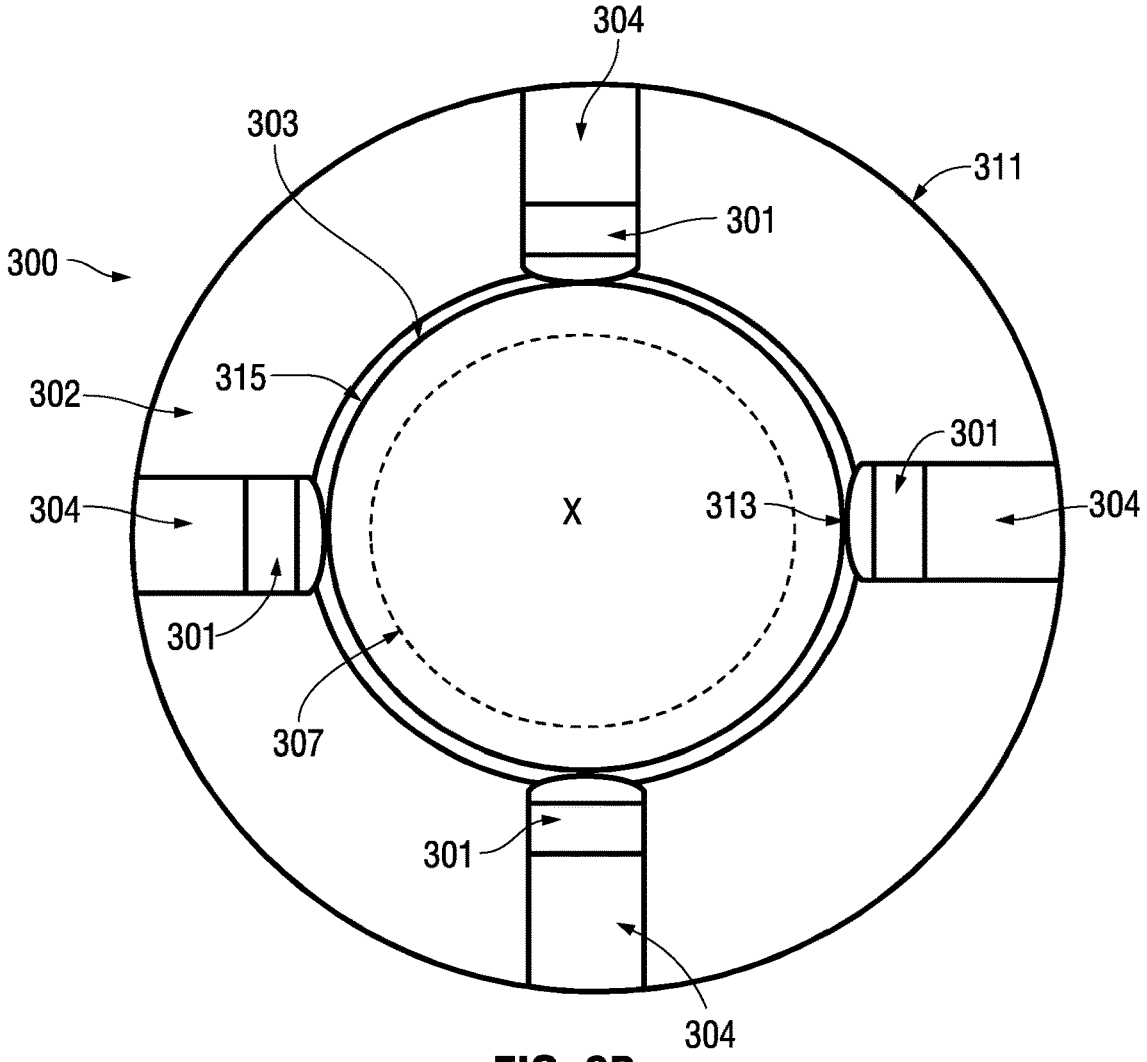
FIG. 3B is a cross-sectional view of the assembly of FIG. 3A taken along line B-B.

FIGS. 3A and 3B depict rotor and stator radial bearing assembly 300, which is substantially similar to that of FIGS. 2A and 2B, with the exception that polycrystalline diamond elements 301 have convex engagement surfaces 313 rather than the flat, planar engagement surfaces of FIGS. 2A and 2B.

With reference to FIGS. 3A and 3B, rotor and stator radial bearing 300 includes convex polycrystalline diamond elements 301 fitted into stator body 311 of stator 302 to provide for sliding engagement with rotor 303, formed of or including at least some diamond reactive material. Polycrystalline diamond elements 301 are deployed in stator 302 through loading ports 304, and may be press fit, glued, brazed, threaded, or otherwise mounted using methods known to those skilled in the art. Polycrystalline diamond elements 301 are placed into a secure contacting position with rotor 303 to limit lateral movement of rotor 303 while allowing for free sliding rotation of rotor 303 during operation. As is evident from FIG. 3B, polycrystalline diamond elements 301 are deployed in stator 302 to radially support and provide sliding engagement with rotor 303. FIG. 3B also shows optional through bore 307 such as could be used in a discrete bearing.

Although FIGS. 3A and 3B depict a rotor and stator such as would be used in a downhole pump or motor, other assemblies, including discrete radial bearing assemblies, may be designed and manufactured in the same or substantially the same way. Non-limiting proximal and distal dimensions for such a discrete bearing are indicated by dashed lines 305. Further, although FIGS. 3A and 3B show four polycrystalline diamond elements 301, it would be understood by those skilled in the art that fewer (e.g., three) or more polycrystalline diamond elements may be deployed in stator 302. Additionally, although FIGS. 3A and 3B show a single circumferential set of polycrystalline diamond elements 301, it would be understood by those skilled in the art that one or more additional circumferential sets of polycrystalline diamond elements may be deployed in the stator to increase lateral support and lateral load taking capability of the bearing assembly.

As with assembly 200, in operation engagement surface 313 interfaces with opposing engagement surface 315 to bear load between rotor 303 and stator 302.

Stator with Concave Polycrystalline Diamond Element

Figure 4A:
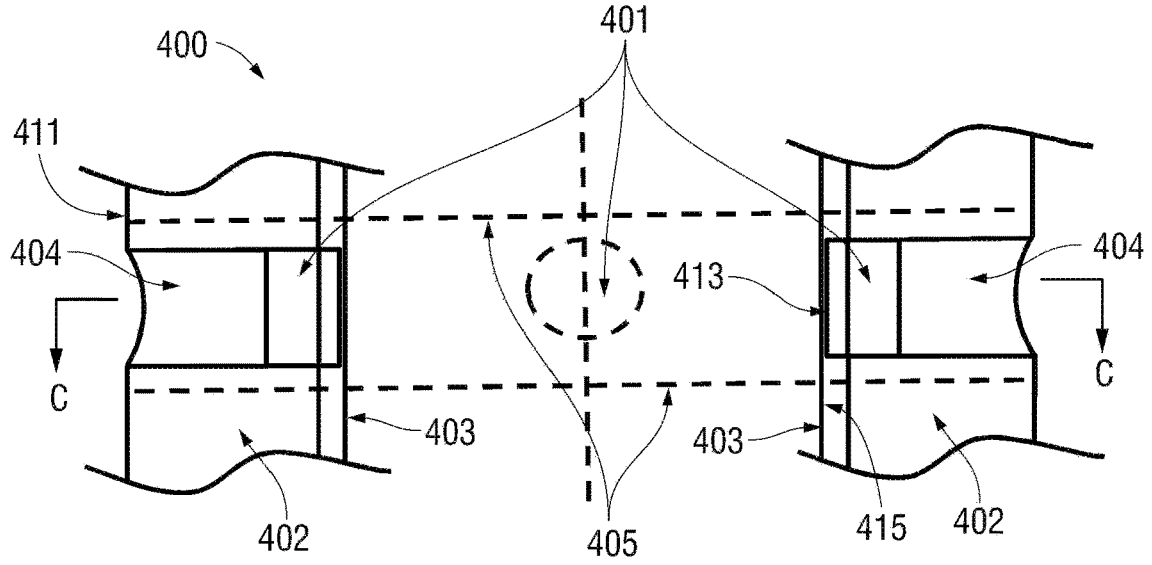
FIG. 4A is a partial side view of a rotor and stator radial bearing assembly of an embodiment of the technology of this application.
Figure 4B:
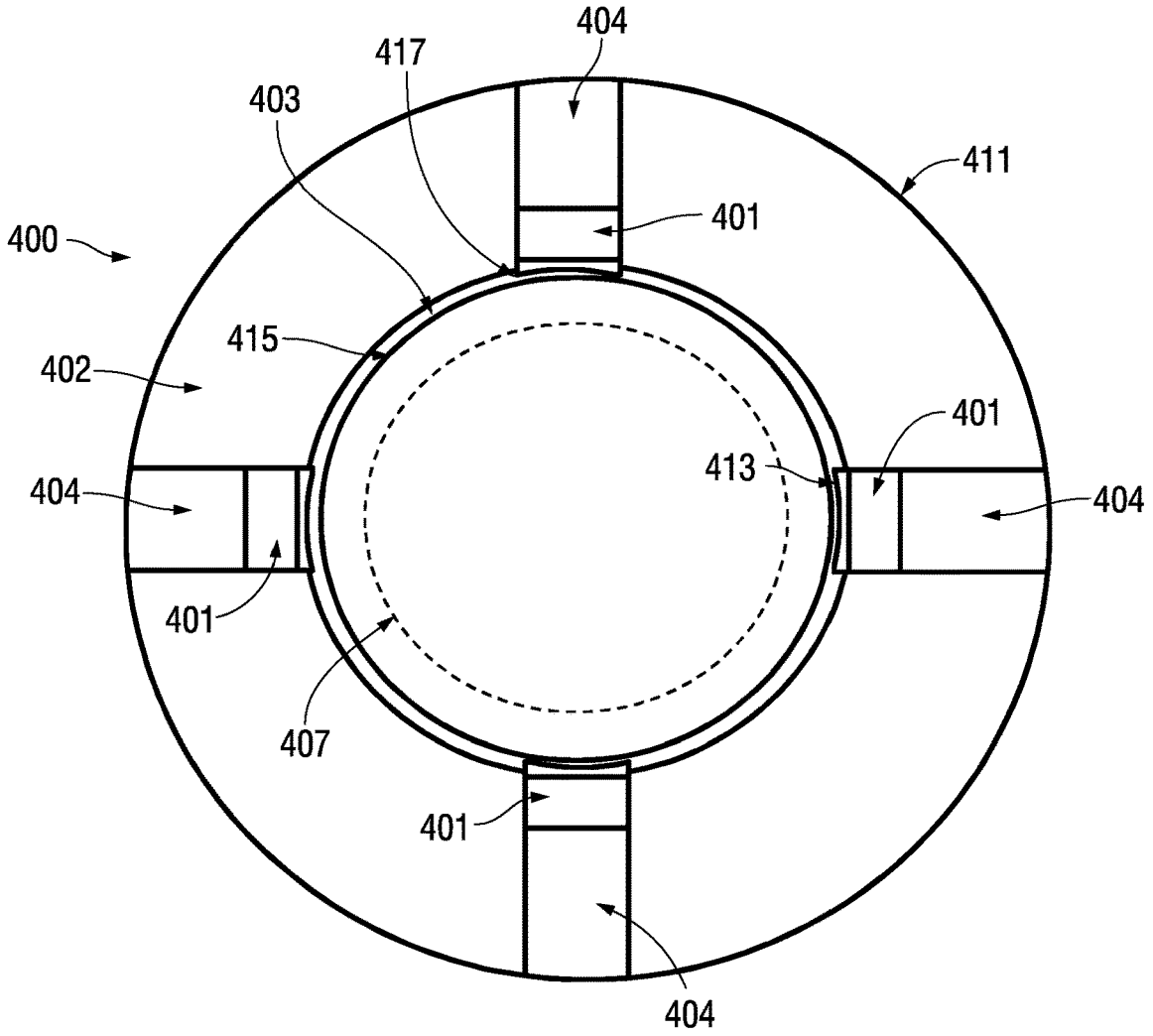
FIG. 4B is a cross-sectional view of the assembly of FIG. 4A taken along line C-C.

FIGS. 4A and 4B depict rotor and stator radial bearing assembly 400, which is substantially similar to that of FIGS. 2A-3B, with the exception that polycrystalline diamond elements 401 has concave, or at least slightly concave, engagement surfaces 413 rather than the flat, planar engagement surfaces of FIGS. 2A and 2B or the convex engagement surfaces of FIGS. 3A and 3B.

Slightly concave polycrystalline diamond elements 401 are fitted into stator body 411 of stator 402 to provide for sliding engagement with rotor 403. Polycrystalline diamond elements 401 are deployed in stator 402 through loading ports 404. Polycrystalline diamond elements 401 may be press fit, glued, brazed, threaded, or otherwise mounted using methods known to those skilled in the art. Polycrystalline diamond elements 401 are placed into secure contacting position with rotor 403 to limit lateral movement of rotor 403 while allowing for free sliding rotation of rotor 403 during operation.

As with assembly 300, in operation engagement surface 413 interfaces with opposing engagement surface 415 to bear load between rotor 403 and stator 402. The at least slight concavity of each polycrystalline diamond element 401 is oriented with the axis of the concavity, in line with the circumferential rotation of rotor 403; thereby ensuring no edge contact between polycrystalline diamond elements 401 and rotor 403 and providing for linear area contact between polycrystalline diamond elements 401 and rotor 403, generally with the deepest portion of the concavity. That is, engagement between polycrystalline diamond elements 401 and rotor 403 is exclusively interfaced by engagement surface 413 and opposing engagement surface 415, such that edge or point 417 of polycrystalline diamond elements 401 do not make contact with rotor 403. As such, only linear area contact, and no edge or point contact, occurs between polycrystalline diamond elements 401 and rotor 403. As is evident from FIG. 4B, polycrystalline diamond elements 401 are deployed in stator 402 to radially support and provide sliding engagement with rotor 403. FIG. 4B also shows optional through bore 407 such as could be used in a discrete bearing.

Although FIGS. 4A and 4B depict a rotor and stator such as would be used in a downhole pump or motor, assemblies, including a discrete radial bearing assembly, may be designed and manufactured in the same or substantially the same way. Non-limiting proximal and distal dimensions for such a discrete bearing are indicated by dashed lines 405. Further, although FIGS. 4A and 4B show four polycrystalline diamond elements 401, it would be understood by those skilled in the art that fewer (e.g., three) or more polycrystalline diamond elements may be deployed in stator 402. Additionally, although FIGS. 4A and 4B show a single circumferential set of polycrystalline diamond elements 401, it would be understood by those skilled in the art that one or more additional circumferential sets of polycrystalline diamond elements may be deployed in the stator to increase lateral support and lateral load taking capability of the bearing assembly.

Rotor with Convex Polycrystalline Diamond Element

Figure 5A:
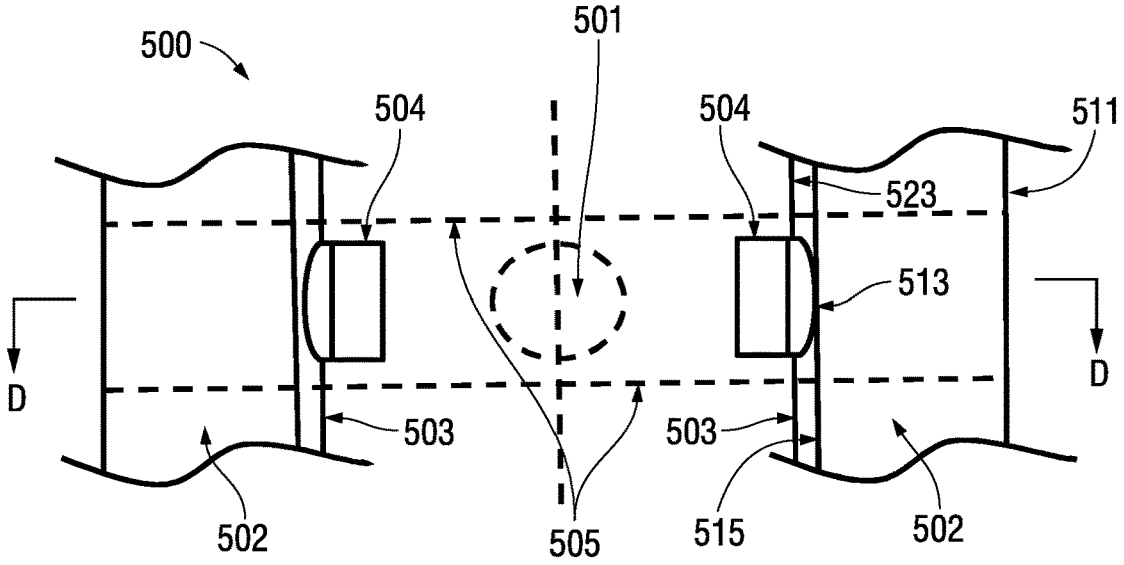
FIG. 5A is a partial side view of a rotor and stator radial bearing assembly of an embodiment of the technology of this application.
Figure 5B:
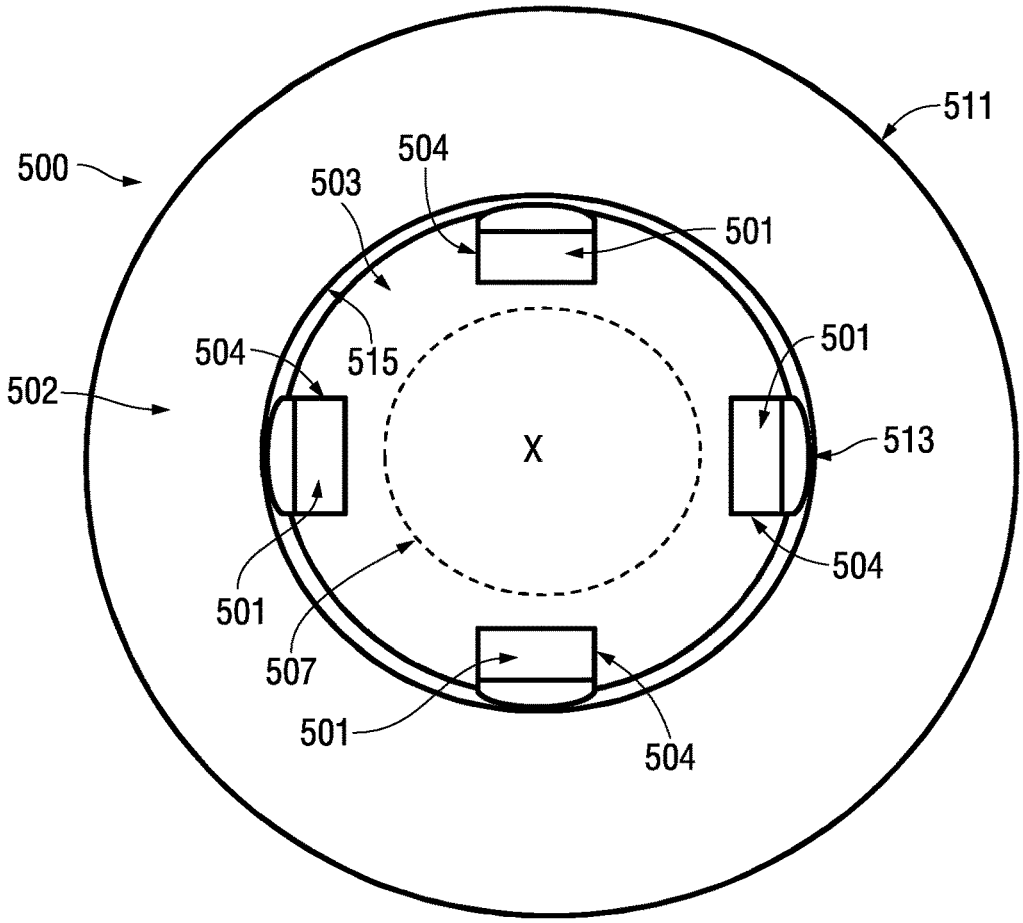
FIG. 5B is a cross-sectional view of the assembly of FIG. 5A taken along line D-D.

FIGS. 5A and 5B depict rotor and stator radial bearing assembly 500, which is substantially similar to that of FIGS. 3A and 3B, with the exception that polycrystalline diamond elements 501, having the convex, dome shaped engagement surfaces 513, are installed on rotor 503 rather than on the stator.

Convex polycrystalline diamond elements 501 are fitted into rotor body 523 of rotor 503 to provide for sliding engagement with stator 502, which is formed of or includes at least some diamond reactive material. Polycrystalline diamond elements 501 are deployed in rotor 503 in sockets 504 formed into and/or positioned in rotor body 523. Polycrystalline diamond elements 501 may be press fit, glued, brazed, threaded, or otherwise mounted using methods known to those skilled in the art. Polycrystalline diamond elements 501 are placed into a secure contacting position relative to stator 502 to limit lateral movement of rotor 503 while allowing for free sliding rotation of rotor 503 during operation. As is evident from FIG. 5B, polycrystalline diamond elements 501 are deployed in rotor 503 to radially support and provide sliding engagement with stator 502. FIG. 5B also shows optional through bore 507 such as could be used in a discrete bearing.

Although FIGS. 5A and 5B depict a rotor and stator such as would be used in a downhole pump or motor, other assemblies, including a discrete radial bearing assembly, may be designed and manufactured in the same or similar way. Non-limiting proximal and distal dimensions for such a discrete bearing are indicated by dashed lines 505. Further, although FIGS. 5A and 5B show four polycrystalline diamond elements 501, one skilled in the art would understand that fewer (e.g., three) or more polycrystalline diamond elements may be deployed in rotor 503. Additionally, although FIGS. 5A and 5B show a single circumferential set of polycrystalline diamond elements 501, it would be understood by one skilled in the art that one or more additional circumferential sets of polycrystalline diamond elements may be deployed in the rotor to increase lateral support and lateral load taking capability of the bearing assembly.

Thus, contrary to the embodiments shown in FIGS. 2A-4B, in the embodiment shown in FIGS. 5A and 5B, the engagement surfaces 513 are on the rotor 503, and the opposing engagement surface 515 is on the stator 502.

Stator with Chisel Shaped Polycrystalline Diamond Element

Figure 6A:
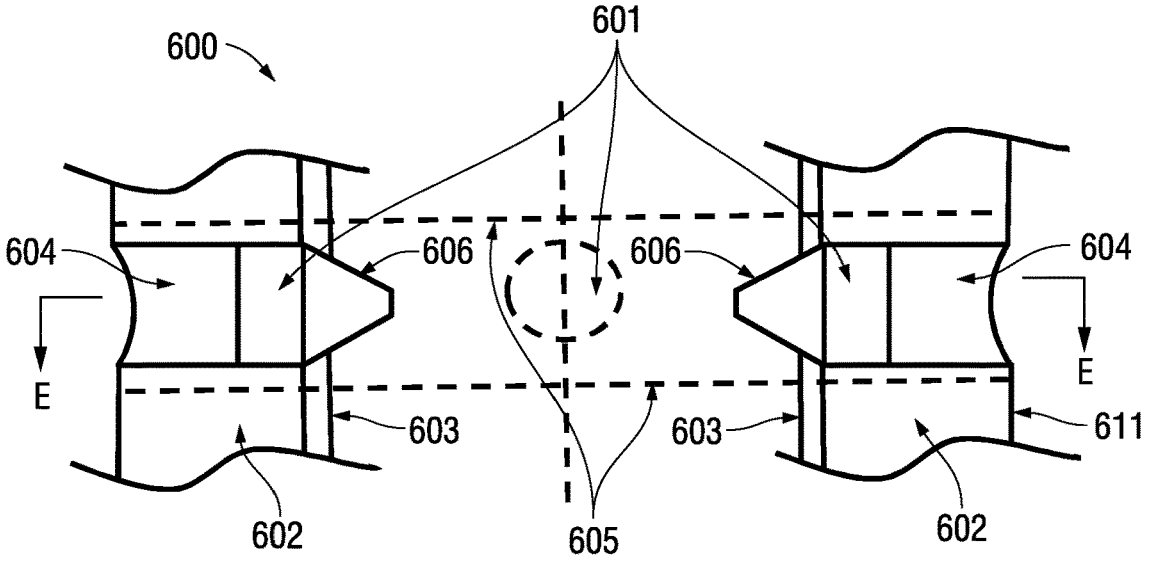
FIG. 6A is a partial side view of a rotor and stator radial bearing assembly of an embodiment of the technology of this application.
Figure 6B:
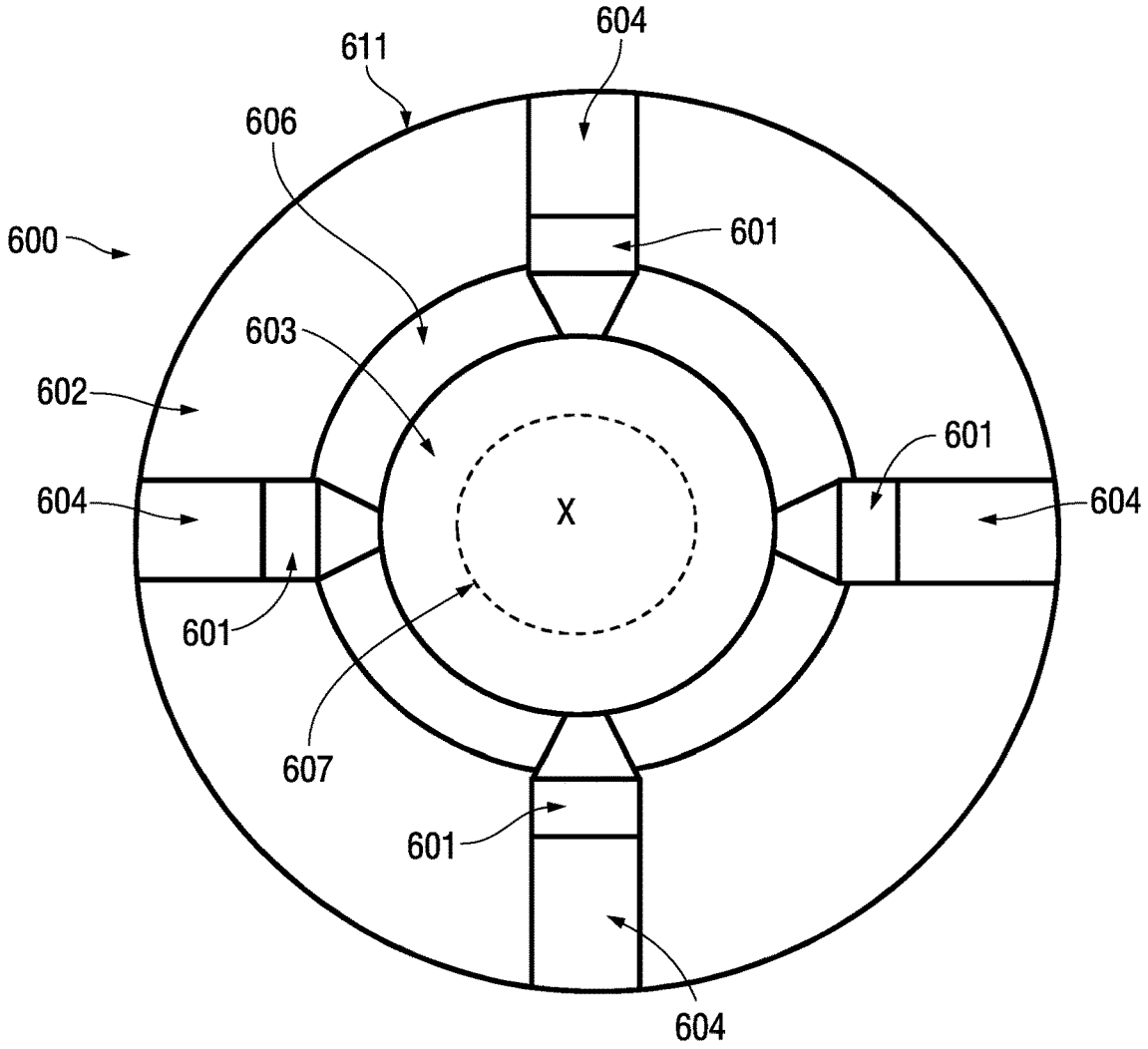
FIG. 6B is a cross-sectional view of the assembly of FIG. 6A taken along line E-E.

FIGS. 6A and 6B depict rotor and stator radial bearing assembly 600 with chisel shaped polycrystalline diamond elements 601 fitted into stator body 611 of stator 602 to provide for sliding engagement with rotor 603, which is formed of or includes at least some diamond reactive material. Polycrystalline diamond elements 601 are deployed in stator 602 through loading ports 604, which are formed in and/or positioned in stator body 611. Polycrystalline diamond elements 601 may be press fit, glued, brazed, threaded, or otherwise mounted using methods known to those skilled in the art.

Polycrystalline diamond elements 601 are placed into a secure contacting position within radial/thrust surface groove 606 of rotor 603 to limit lateral and axial movement of rotor 603 while allowing for free sliding rotation of rotor 603 during operation. Chisel shaped polycrystalline diamond elements 601 are positioned, arranged, shaped, sized, and oriented to slidingly engage into the mating radial/thrust surface groove 606 of rotor 603. Chisel shaped polycrystalline diamond elements 601 include engagement surface (defined by the chisel shaped polycrystalline diamond elements 601), which interfaces in contact with opposing engagement surface, here the surface of radial/thrust surface groove 606. It is evident from FIG. 6B that chisel shape polycrystalline diamond elements 601 are deployed in stator 602 to radially and axially support and provide sliding engagement with rotor 603. FIG. 6B also depicts optional through bore 607 such as could be used in a discrete bearing. The embodiment shown in FIGS. 6A and 6B may further act as a rotor catch.

Although FIGS. 6A and 6B depict a rotor and stator such as would be used in a downhole pump or motor, other assemblies, including a discrete radial bearing assembly, may be designed and manufactured in the same or similar way. Non-limiting proximal and distal dimensions for such a discrete bearing are indicated by dashed lines 605. Further, although FIGS. 6A and 6B depict four polycrystalline diamond elements 601, it would be understood by one skilled in the art that fewer (e.g., three) or more polycrystalline diamond elements 601 may be deployed in stator 602. Additionally, although FIGS. 6A and 6B depict a single circumferential set of polycrystalline diamond elements 601, it would be understood by one skilled in the art that one or more additional circumferential sets of polycrystalline diamond elements may be deployed in the stator to increase lateral and axial support and lateral and axial load taking capability of the bearing assembly.

Stator with Dome or Hemisphere Shaped Polycrystalline Diamond Element

Figure 7A:
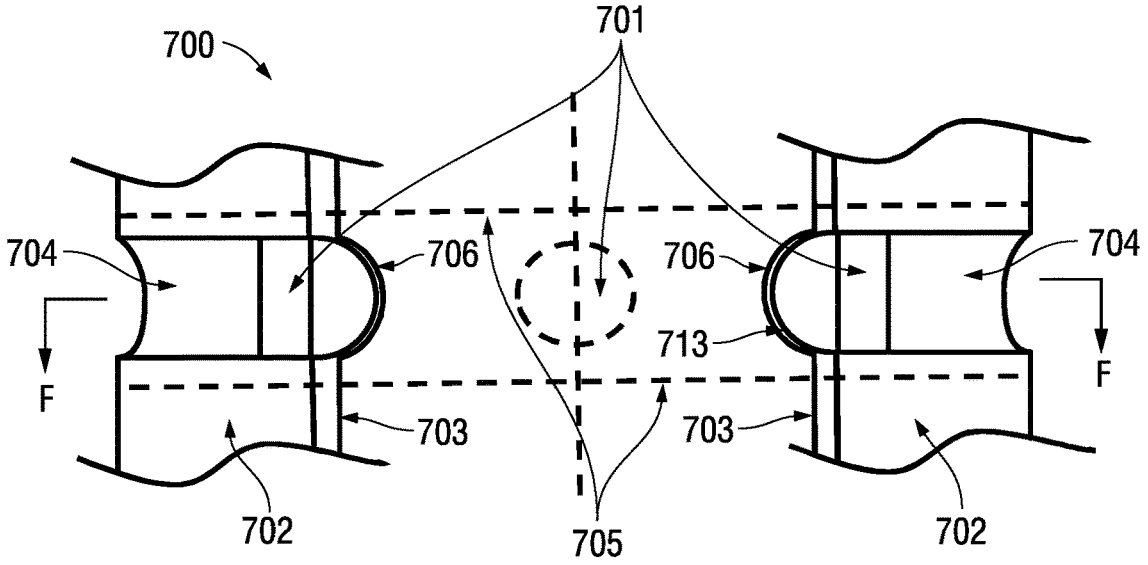
FIG. 7A is a partial side view of a rotor and stator radial bearing assembly of an embodiment of the technology of this application.
Figure 7B:
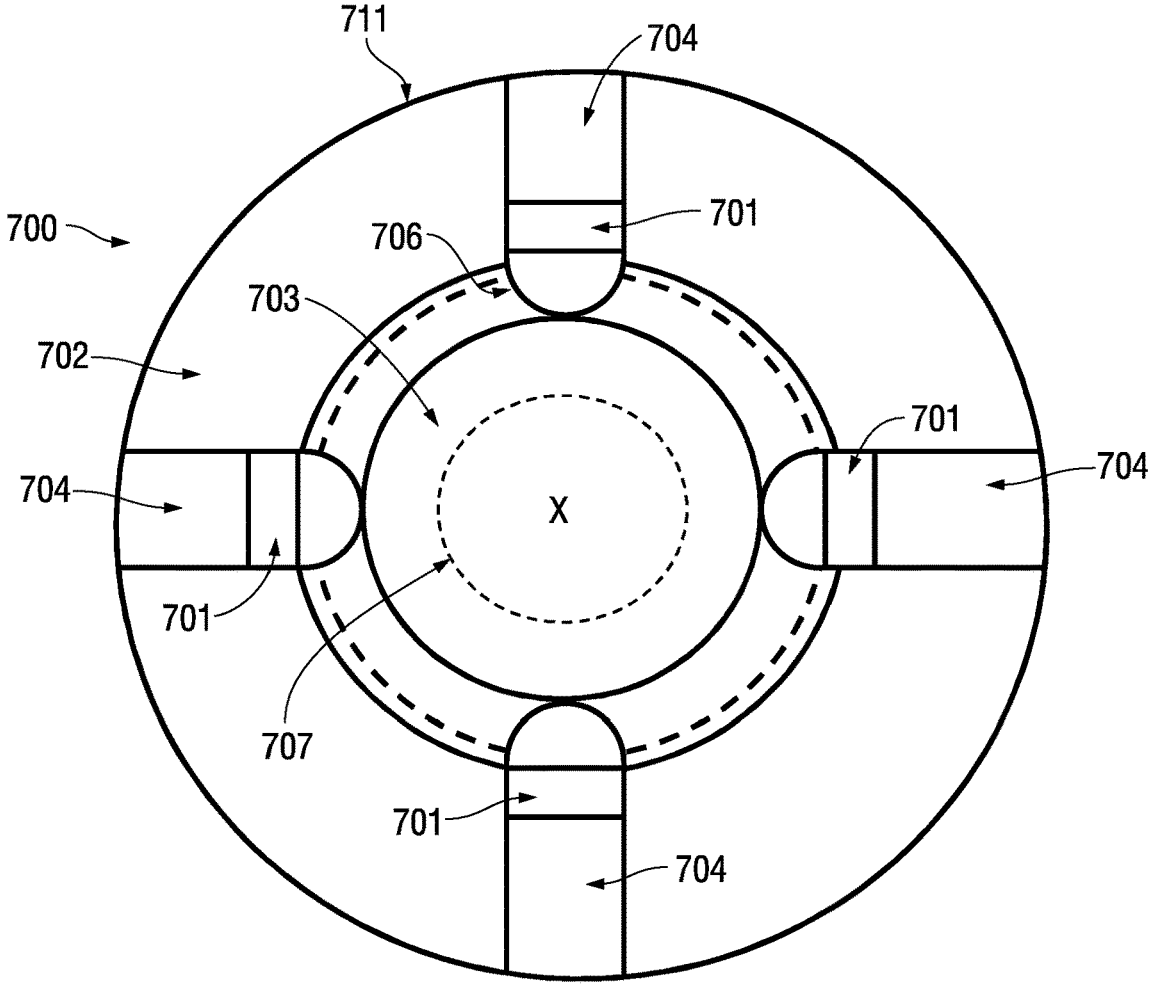
FIG. 7B is a cross sectional view of the assembly of FIG. 7A taken along line F-F.

FIGS. 7A and 7B depict rotor and stator radial bearing assembly 700, which is substantially similar to that of FIGS. 6A and 6B, with the exception that polycrystalline diamond elements 701 have dome or hemisphere shaped engagement surfaces 713 rather chisel shaped polycrystalline diamond elements.

Dome or hemisphere shaped polycrystalline diamond elements 701 are fitted into stator housing 711 of stator 702 to provide for sliding engagement with rotor 703. Polycrystalline diamond elements 701 are deployed in stator 702 through loading ports 704 formed in and/or positioned in stator body 711. Polycrystalline diamond elements 701 may be press fit, glued, brazed, threaded, or otherwise mounted using methods known to those skilled in the art. Polycrystalline diamond elements 701 are placed into a secure contacting position relative to radial/thrust surface groove 706 of rotor 703 to limit lateral and axial movement of rotor 703 while allowing for free sliding rotation of rotor 703 during operation. Dome or hemisphere polycrystalline diamond elements 701 slidingly engage the mating radial/thrust surface groove 706 of rotor 703. Dome or hemisphere polycrystalline diamond elements 701 define engagement surface, which interfaces in contact with opposing engagement surface, here the surface of radial/thrust surface groove 706. As is evident from FIG. 7B, dome or hemisphere polycrystalline diamond elements 701 are deployed in stator 702 to radially and axially support and provide sliding engagement with rotor 703. FIG. 7B also shows optional through bore 707 such as could be used in a discrete bearing. The embodiment shown in FIGS. 7A and 7B may further act as a rotor catch.

Although FIGS. 7A and 7B depict a rotor and stator such as would be used in a downhole pump or motor, other assemblies, including a discrete radial bearing assembly, may be designed and manufactured in the same or similar way. Non-limiting proximal and distal dimensions for such a discrete bearing are indicated by dashed lines 705. Further, although FIGS. 7A and 7B depict four polycrystalline diamond elements 701, it would be understood by those skilled in the art that fewer (e.g., three) or more polycrystalline diamond elements may be deployed in stator 702. Additionally, although FIGS. 7A and 7B depict a single circumferential set of polycrystalline diamond elements, it would be understood by those skilled in the art that one or more additional circumferential sets of polycrystalline diamond elements may be deployed in the stator to increase lateral and axial support and lateral and axial load taking capability of the bearing assembly.

Stator with Planar Polycrystalline Diamond Element

Figure 8A:
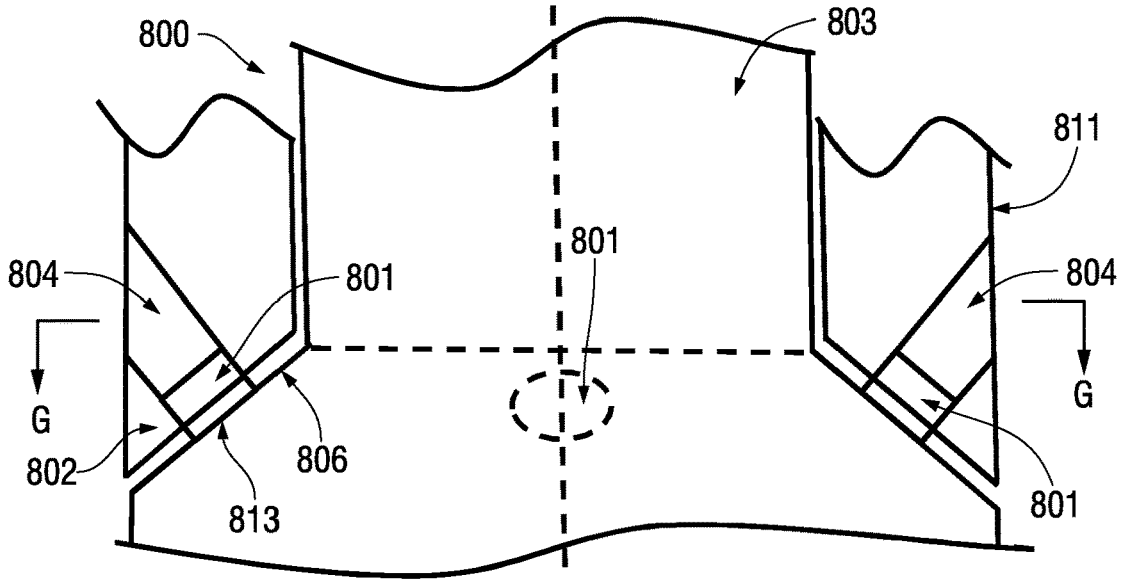
FIG. 8A is a partial side view of a rotor and stator radial bearing assembly of an embodiment of the technology of this application.
Figure 8B:
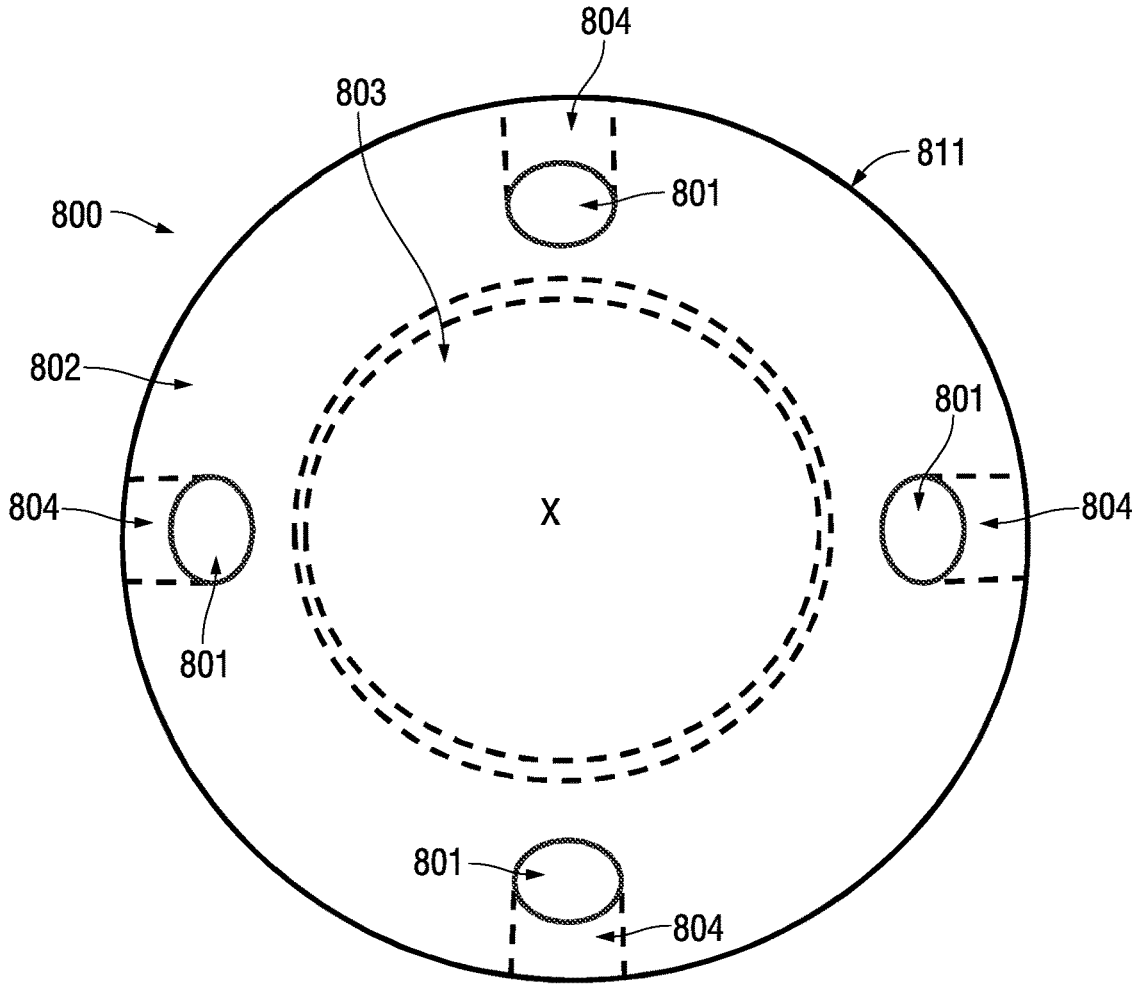
FIG. 8B is a cross-sectional view of the assembly of FIG. 8A taken along line G-G.

FIGS. 8A and 8B depict rotor and stator radial bearing assembly 800 including planar polycrystalline diamond elements 801 fitted into stator body 811 of stator 802 to provide for sliding engagement with rotor 803, which is formed of or includes at least some diamond reactive material. Polycrystalline diamond elements 801 are deployed in stator 802 through loading ports 804 formed in and/or positioned in stator body 811. Polycrystalline diamond elements 801 may be press fit, glued, brazed, threaded, or otherwise mounted using methods known to those skilled in the art.

Polycrystalline diamond elements 801 are placed into a secure contacting position relative to radial/thrust conical surface 806 of rotor 803 to limit lateral and upward axial movement of rotor 803 while allowing for free sliding rotation of rotor 803 during operation.

The planar polycrystalline diamond elements 801 slidingly engage the mating radial/thrust conical surface of rotor 803, such that engagement surfaces 813 contact and interface with opposing engagement surface 806. As is evident from FIG. 8B, polycrystalline diamond elements 801 are deployed in stator 802 to radially and axially support and provide sliding engagement with rotor 803.

Although FIGS. 8A and 8B depict four polycrystalline diamond elements 801, it would be understood by those skilled in the art that fewer (e.g., three) or more polycrystalline diamond elements may be deployed in stator 802. Further, although FIGS. 8A and 8B depict a single circumferential set of polycrystalline diamond elements 801, it would be understood that one or more additional circumferential sets of polycrystalline diamond elements may be deployed in the stator to increase lateral and axial support and lateral and axial load taking capability of the bearing assembly.

While FIGS. 8A and 8B are described as a bearing arrangement between a rotor 803 and stator 802, one skilled in the art would understand that the rotor may, instead, be a drive shaft, and the stator may, instead, be a bearing housing.

Stator with Convex Polycrystalline Diamond Element

Figure 9A:
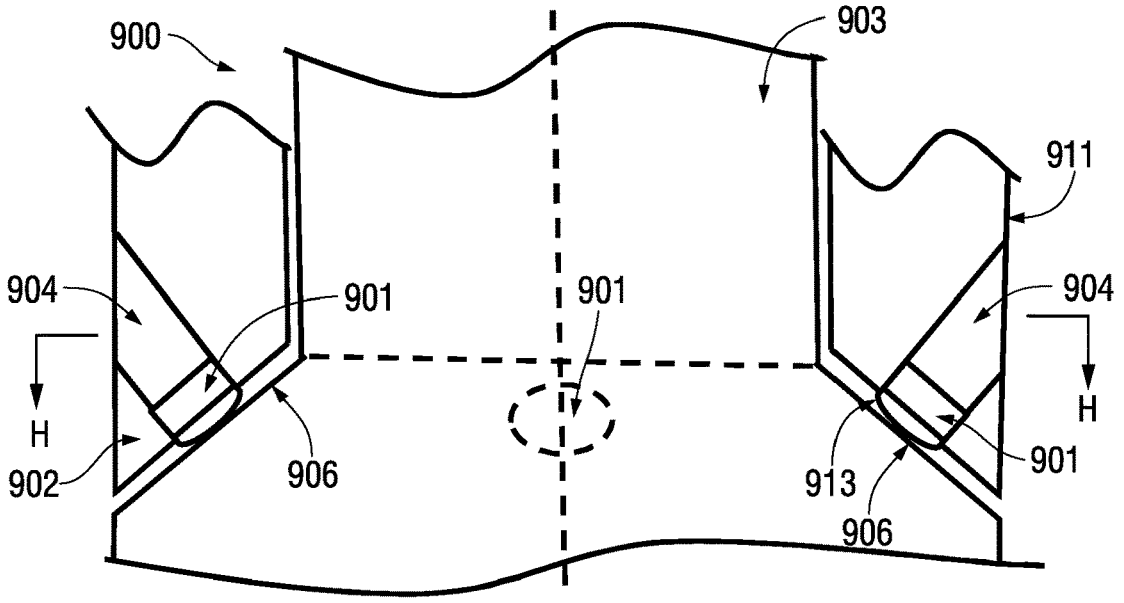
FIG. 9A is a partial side view of a rotor and stator radial bearing assembly of an embodiment of the technology of this application.
Figure 9B:
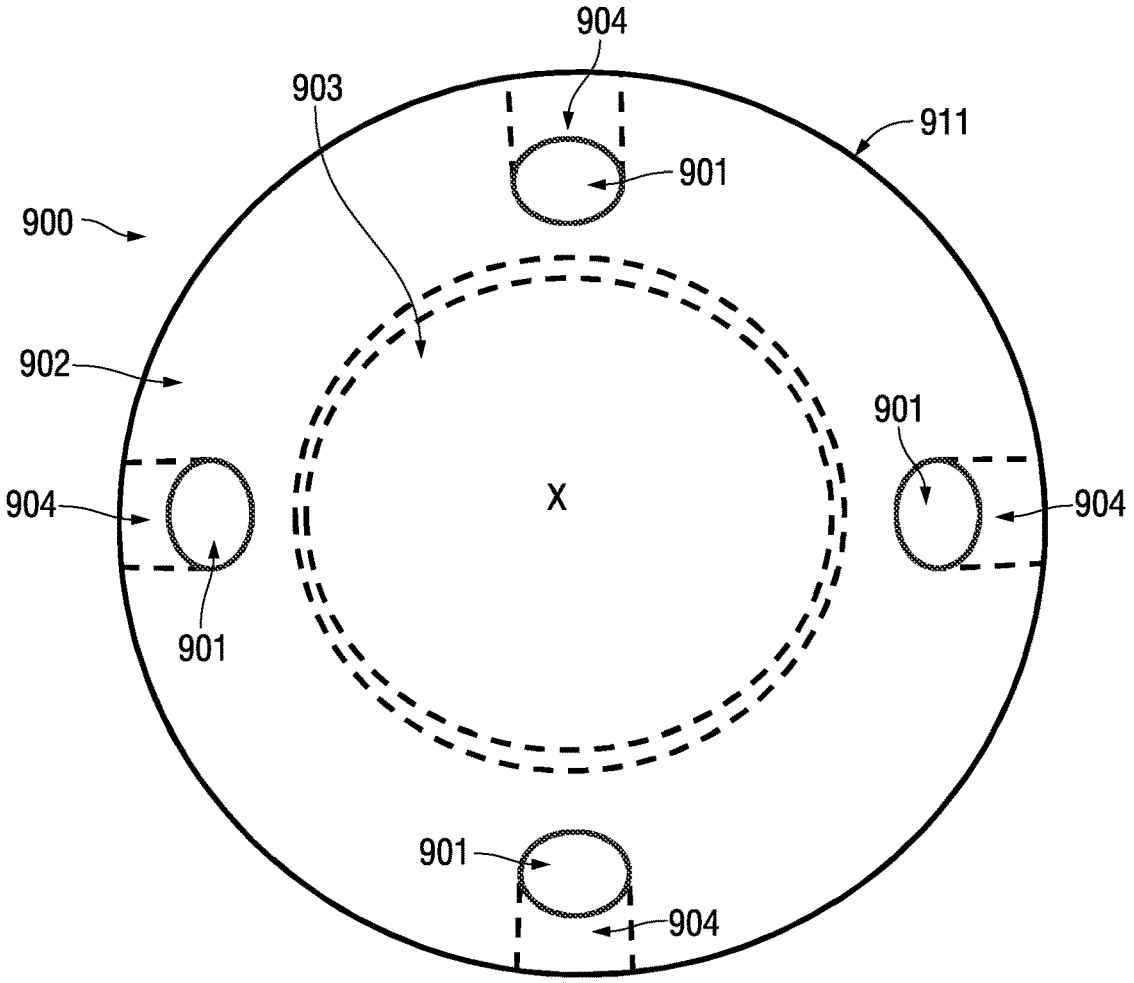
FIG. 9B is a cross-sectional view of the assembly of FIG. 9A taken along line H-H.

FIGS. 9A and 9B depict rotor and stator radial bearing assembly 900, which is substantially similar to that of FIGS. 8A and 8B, with the exception that polycrystalline diamond elements 901 have convex engagement surfaces 913 rather than planar engagement surfaces.

Convex polycrystalline diamond elements 901 are fitted into stator body 911 of stator 902 to provide for sliding engagement with rotor 903. Polycrystalline diamond elements 901 are deployed in stator 902 through loading ports 904 formed in and/or positioned in stator body 911. Polycrystalline diamond elements 901 may be press fit, glued, brazed, threaded, or otherwise mounted using methods known to those skilled in the art.

Convex polycrystalline diamond elements 901 are placed into secure contacting position with radial/thrust conical surface 906 of rotor 903 to limit lateral and upward axial movement of rotor 903 while allowing for free sliding rotation of rotor 903 during operation. Polycrystalline diamond elements 901 slidingly engage the mating radial/thrust conical surface of rotor 903, such that engagement surfaces 913 contact and interface with opposing engagement surface 906.

As is evident from FIG. 9B, convex polycrystalline diamond elements 901 are deployed in stator 902 to radially and axially support and provide sliding engagement with rotor 903.

Although FIGS. 9A and 9B depict four polycrystalline diamond elements 901, it would be understood by those skilled in the art that fewer (e.g., three) or more polycrystalline diamond elements may be deployed in stator 902. Further, although FIGS. 9A and 9B depict a single circumferential set of polycrystalline diamond elements 901, it would be understood by those skilled in the art that one or more additional circumferential sets of polycrystalline diamond elements may be deployed in the stator to increase lateral and axial support and lateral and axial load taking capability of the bearing assembly.

While FIGS. 9A and 9B are described as a bearing arrangement between a rotor 903 and stator 902, one skilled in the art would understand that the rotor may, instead, be a drive shaft, and the stator may, instead, be a bearing housing.

Rotor with Convex Polycrystalline Diamond Element

Figure 10A:
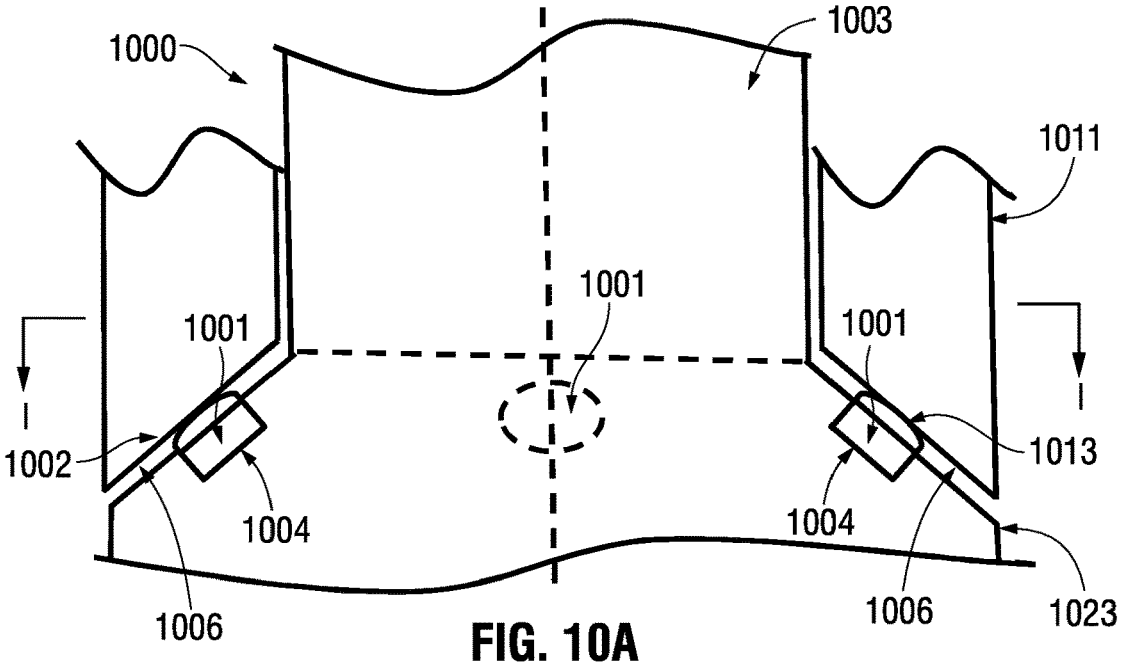
FIG. 10A is a partial side view of a rotor and stator radial bearing assembly of an embodiment of the technology of this application.
Figure 10B:
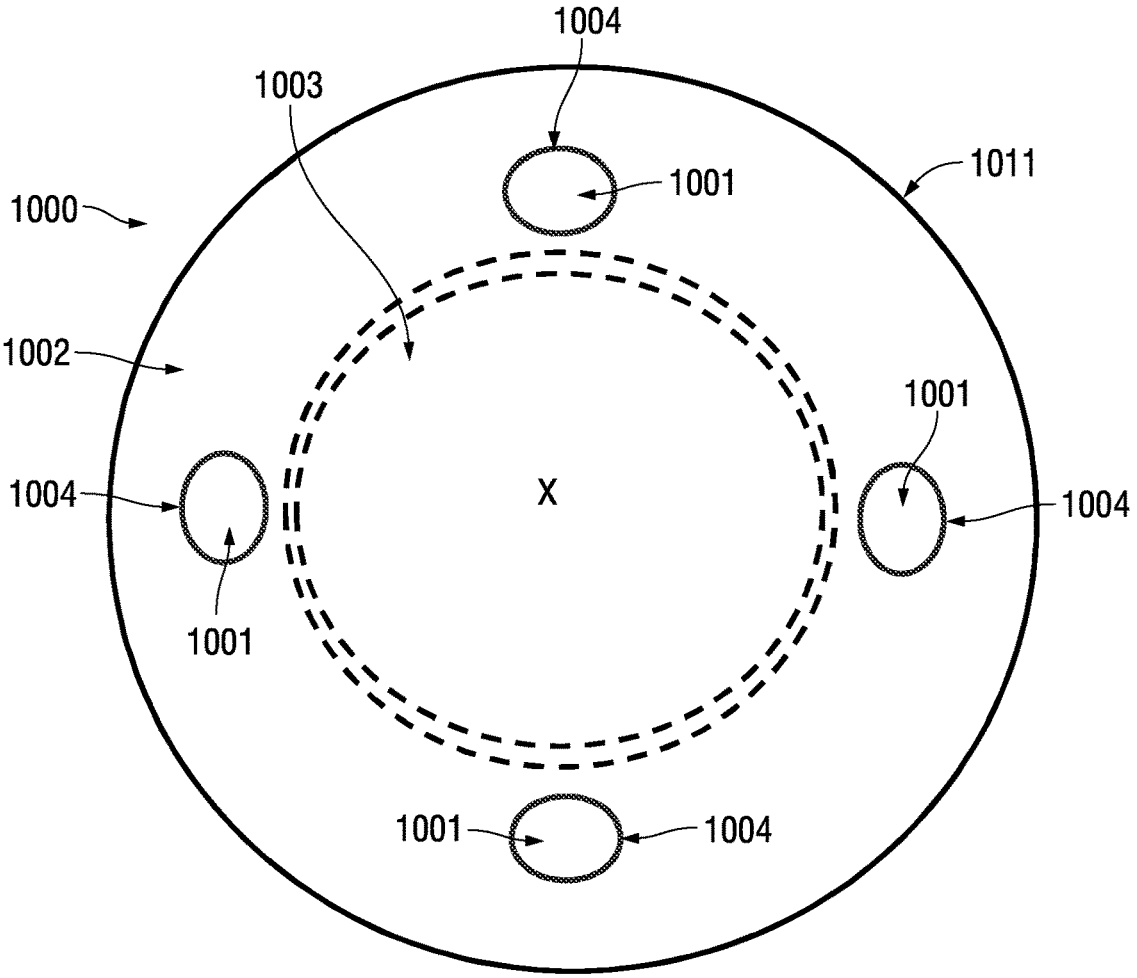
FIG. 10B is a top cross-sectional view of the assembly of FIG. 10A taken along line I-I.

FIGS. 10A and 10B depict a rotor and stator radial and thrust bearing assembly 1000 including convex polycrystalline diamond elements 1001 fitted into rotor body 1023 of rotor 1003 to provide for sliding engagement with stator 1002, which is formed of or includes at least some diamond reactive material. Polycrystalline diamond elements 1001 are deployed in rotor 1003 in sockets 1004 formed in and/or positioned in rotor body 1023. Polycrystalline diamond elements 1001 may be press fit, glued, brazed, threaded, or otherwise mounted using methods known to those skilled in the art.

Convex polycrystalline diamond elements 1001 are placed into a secure contacting position within radial/thrust conical surface 1006 of stator 1002 to limit lateral and upward axial movement of rotor 1003 while allowing for free sliding rotation of rotor 1003 during operation. The convex polycrystalline diamond elements 1001 slidingly engage the mating radial/thrust conical surface of stator 1002, such that engagement surfaces 1013 contact and interface with opposing engagement surface 1006. As is evident from FIG. 10B, convex polycrystalline diamond elements 1001 are deployed in rotor 1003 to radially and axially support and provide sliding engagement with subject material stator 1002.

Although FIGS. 10A and 10B depict four polycrystalline diamond elements 1001, it would be understood by those skilled in the art that fewer (e.g., three) or more polycrystalline diamond elements may be deployed in rotor 1003. Further, although FIGS. 10A and 10B depict a single circumferential set of polycrystalline diamond elements 1001, it would be understood by those skilled in the art that one or more additional circumferential sets of polycrystalline diamond elements may be deployed in the rotor to increase lateral and axial support and lateral and axial load taking capability of the bearing assembly.

While FIGS. 10A and 10B are described as a bearing arrangement between a rotor 1003 and stator 1002, one skilled in the art would understand that the rotor may, instead, be a drive shaft, and the stator may, instead, be a bearing housing.

Stator with Planar Polycrystalline Diamond Element

Figure 11A:
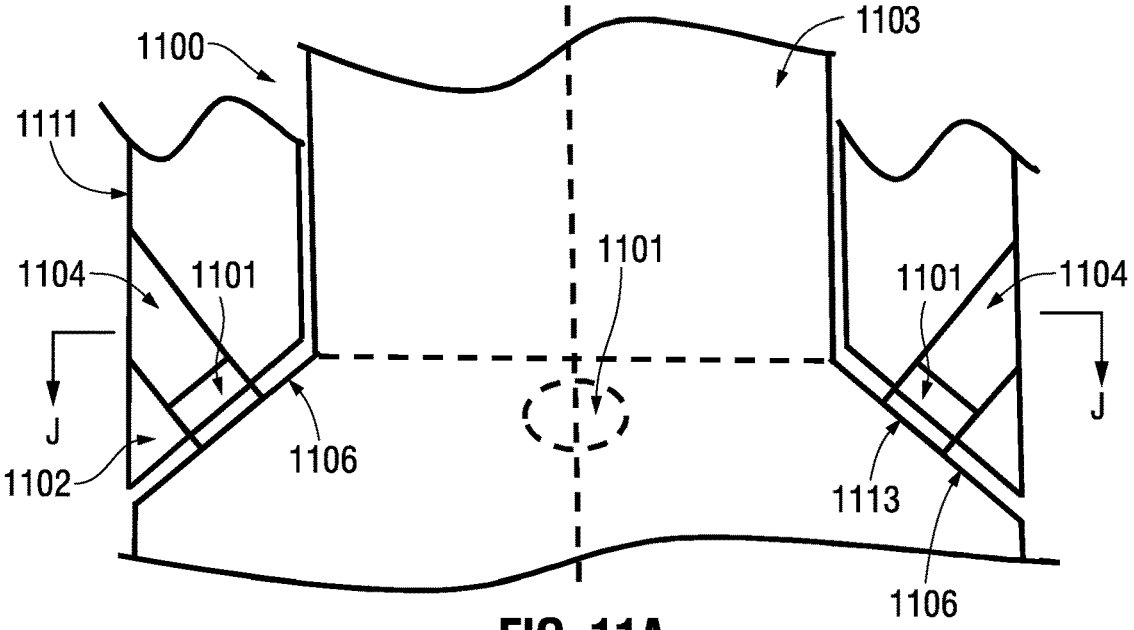
FIG. 11A is a partial side view of a rotor and stator radial bearing assembly of an embodiment of the technology of this application.
Figure 11B:
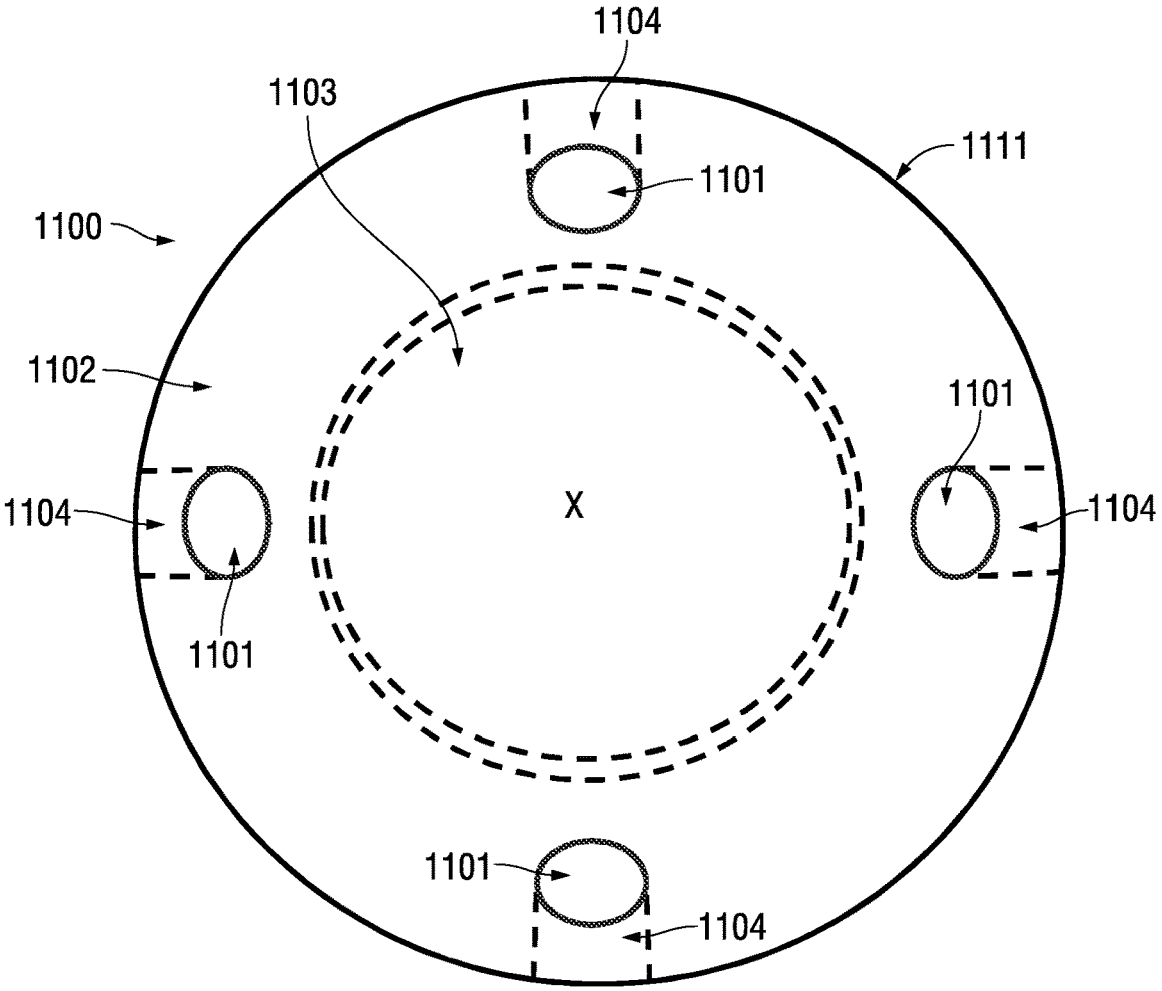
FIG. 11B is a cross-sectional view of the assembly of FIG. 11A taken along line J-J.

FIGS. 11A and 11B depict rotor and stator radial and thrust bearing assembly 1100 including concave, or at least slightly concave, polycrystalline diamond elements 1101 fitted into stator body 1111 of stator 1102 to provide for sliding engagement with rotor 1103, which is formed of or includes at least some diamond reactive material. Polycrystalline diamond elements 1101 are deployed in stator 1102 through loading ports 1104 formed and/or positioned therethrough. Polycrystalline diamond elements 1101 may be press fit, glued, brazed, threaded, or otherwise mounted using methods known to those skilled in the art.

Polycrystalline diamond elements 1101 are placed into a secure contacting position within radial/thrust conical surface 1106 of rotor 1103 to limit lateral and upward axial movement of rotor 1103 while allowing for free sliding rotation of rotor 1103 during operation. Polycrystalline diamond elements 1101 are oriented with the axis of the concavity in line with the circumferential rotation of the rotor 1103 to ensure no edge or point contact, and thus ensure only linear area contact generally with the deepest portion of the concavity. The slightly concave polycrystalline diamond elements 1101 slidingly engage the radial/thrust conical surface of rotor 1103, such that engagement surfaces 1113 contact and interface with opposing engagement surface 1106.

As is evident from FIG. 11B, slightly concave polycrystalline diamond elements 1101 are deployed in stator 1102 to radially and axially support and provide sliding engagement with rotor 1103.

Although FIGS. 11A and 11B depict four polycrystalline diamond elements 1101, it would be understood by those skilled in the art that fewer (e.g., three) or more polycrystalline diamond elements may be deployed in stator 1102. Further, although FIGS. 11A and 11B show a single circumferential set of polycrystalline diamond elements 1101, it would be understood by those skilled in the art that one or more additional circumferential sets of polycrystalline diamond elements may be deployed in the stator to increase lateral and axial support and lateral and axial load taking capability of the bearing assembly.

While FIGS. 11A and 11B are described as a bearing arrangement between a rotor 1103 and stator 1102, one skilled in the art would understand that the rotor may, instead, be a drive shaft, and the stator may, instead, be a bearing housing.

Rotor with Convex Polycrystalline Diamond Elements

Figure 12A:
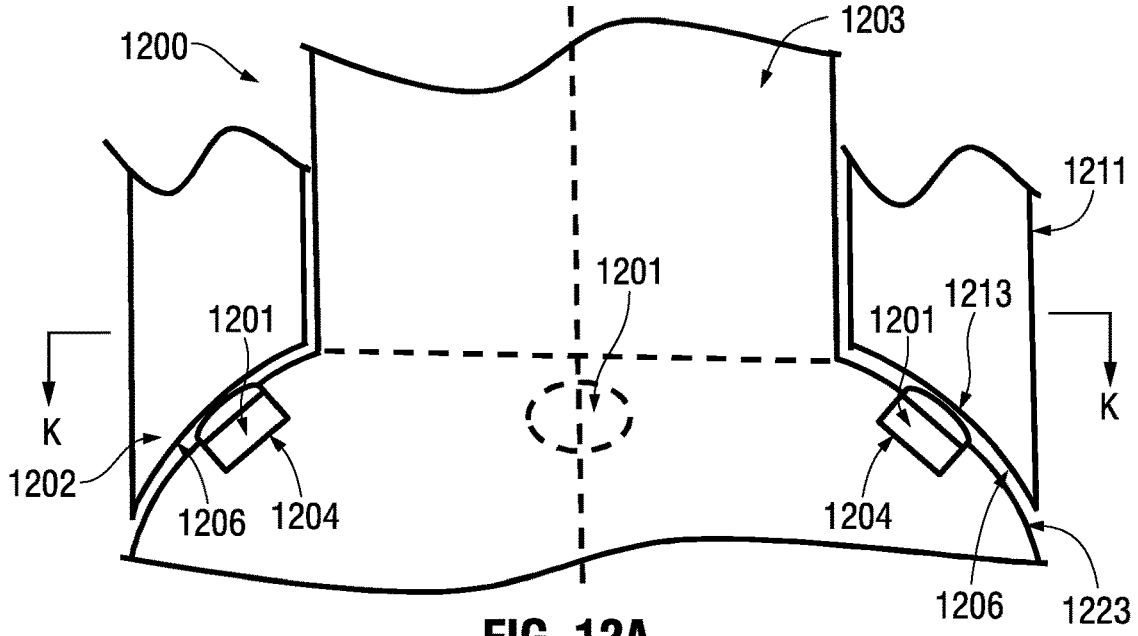
FIG. 12A is a partial side view of a rotor and stator radial bearing assembly of an embodiment of the technology of this application.
Figure 12B:
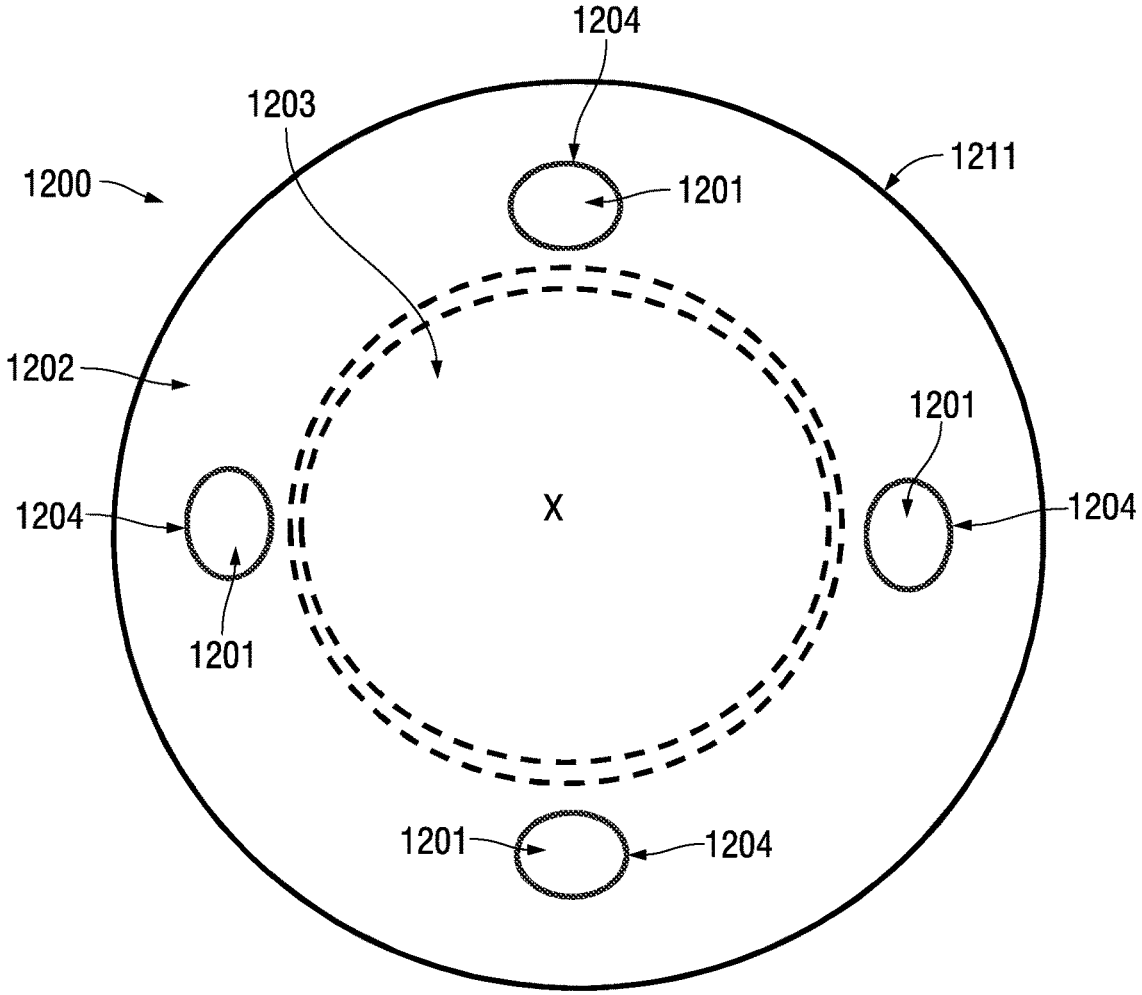
FIG. 12B is a cross-sectional view of the assembly of FIG. 12A taken along line K-K.

FIGS. 12A and 12B depict rotor and stator radial and thrust bearing assembly 1200, including convex polycrystalline diamond elements 1201 are fitted into rotor body 1223 of rotor 1203 to provide for sliding engagement with stator 1202. Polycrystalline diamond elements 1201 are deployed in rotor 1203 in sockets 1204 formed in and/or positioned in rotor body 1223. Polycrystalline diamond elements 1201 may be press fit, glued, brazed, threaded, or otherwise mounted using methods known to those skilled in the art.

Convex polycrystalline diamond elements 1201 are placed into a secure contacting position within radial/thrust concave curved surface 1206 of stator 1202 to limit lateral and upward axial movement of rotor 1203 while allowing for free sliding rotation of rotor 1203 during operation. Convex polycrystalline diamond elements 1201 slidingly engage the mating radial/thrust concave curved surface of stator 1202, such that engagement surfaces 1213 engage with radial/thrust concave curved surface 1206. In the embodiment of FIGS. 12A and 121B, the radial/thrust concave curved surface 1206 is or forms the opposing engagement surface. In the assembly 1200, the contact areas on the convex polycrystalline diamond elements 1201 are generally circular. However, one skilled in the art would understand that the polycrystalline diamond elements are not limited to having such a contact area.

As is evident from FIG. 12B, convex polycrystalline diamond elements 1201 are deployed in rotor 1203 to radially and axially support and provide sliding engagement with stator 1202.

Although FIGS. 12A and 12B depict four polycrystalline diamond elements 1201, it would be understood by those skilled in the art that fewer (e.g., three) or more polycrystalline diamond elements may be deployed in rotor 1203. Further, although FIGS. 12A and 12B depict a single circumferential set of polycrystalline diamond elements 1201, it would be understood by those skilled in the art that one or more additional circumferential sets of polycrystalline diamond elements may be deployed in the rotor to increase lateral and axial support and lateral and axial load taking capability of the bearing assembly.

While FIGS. 12A and 12B are described as a bearing arrangement between a rotor 1203 and stator 1202, one skilled in the art would understand that the rotor may, instead, be a drive shaft, and the stator may, instead, be a bearing housing.

Stator with Planar Polycrystalline Diamond Elements

Figure 13A:
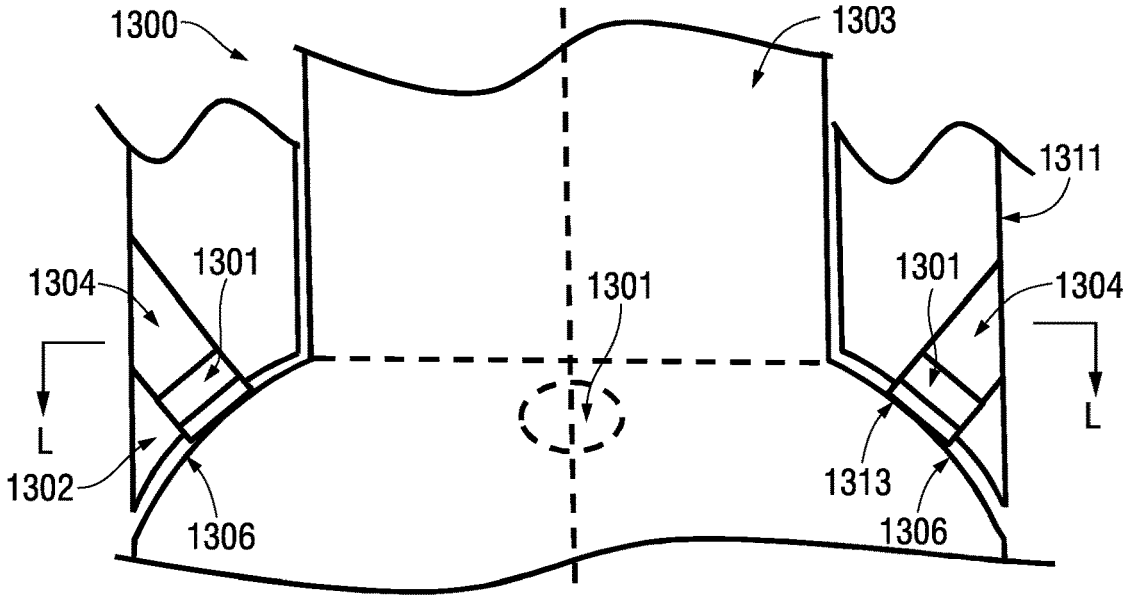
FIG. 13A is a partial side view of a rotor and stator radial bearing assembly of an embodiment of the technology of this application.
Figure 13B:
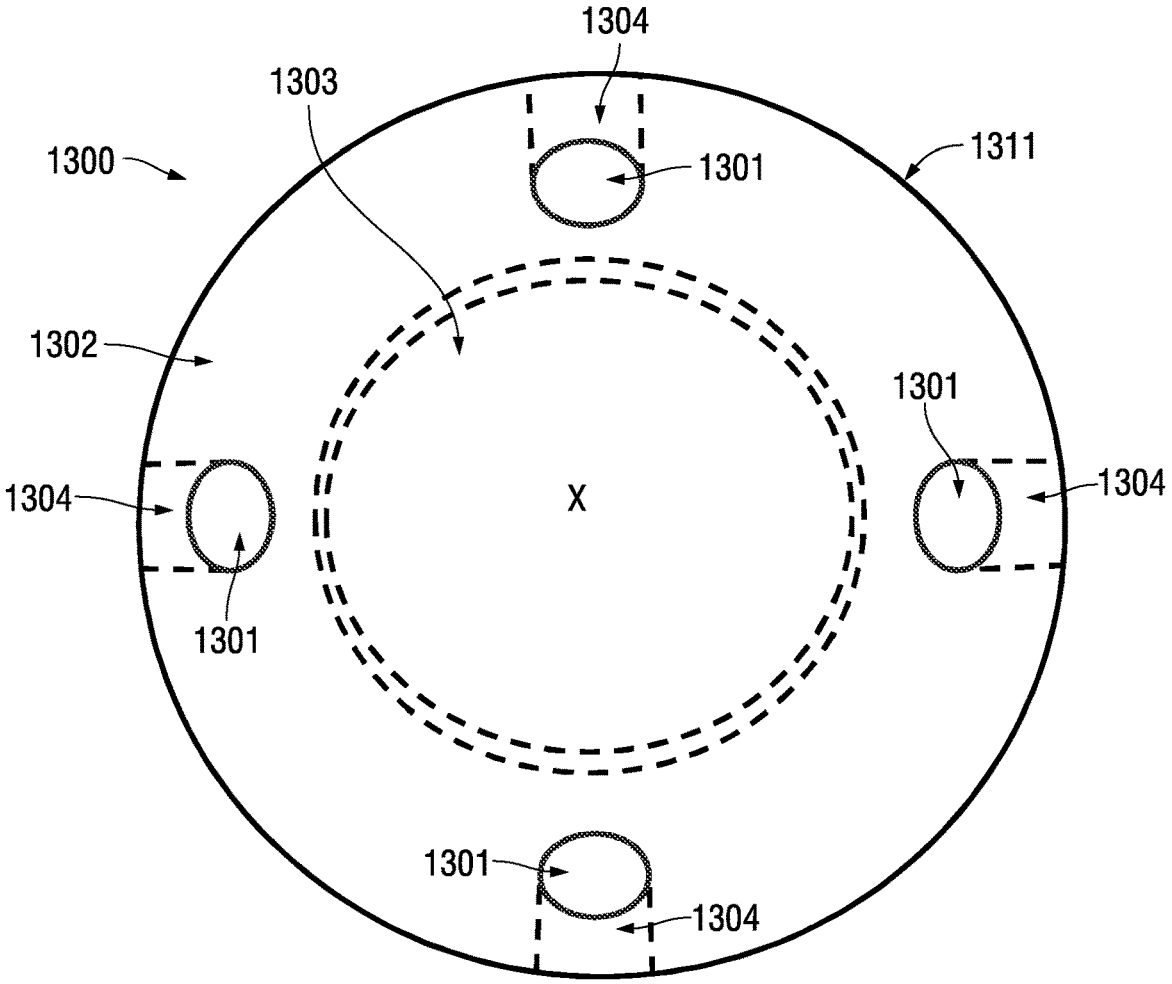
FIG. 13B is a cross-sectional view of the assembly of FIG. 13A taken along line L-L.

FIGS. 13A and 13B depict a partial side view of a rotor and stator radial and thrust bearing assembly 1300 including planar (or domed, not shown) polycrystalline diamond elements 1301 fitted into stator body 1311 of stator 1302 to provide for sliding engagement with rotor 1303, which is formed of or includes at least some diamond reactive material. Polycrystalline diamond elements 1301 are deployed in stator 1302 through loading ports 1304 formed in and/or positioned in stator body 1311. Polycrystalline diamond elements 1301 may be press fit, glued, brazed, threaded, or otherwise mounted using methods known to those skilled in the art.

Polycrystalline diamond elements 1301 are placed into a secure contacting position with radial/thrust convex curved surface 1306 of rotor 1303 to limit lateral and upward axial movement of rotor 1303 while allowing for free sliding rotation of rotor 1303 during operation. Radial/thrust convex curved surface 1306 is or forms the opposing engagement surface. Polycrystalline diamond elements 1301 slidingly engage the radial/thrust convex curved surface 1306 of rotor 1403, such that engagement surface 1313 is engaged with the opposing engagement surface (i.e., radial/thrust convex curved surface 1306). In the assembly 1300, the contact areas on the planar or domed polycrystalline diamond elements are typically circular. However, one skilled in the art would understand that the polycrystalline diamond elements may have different contact areas.

As is evident from FIG. 13B, planar polycrystalline diamond elements 1301 are deployed in stator 1302 to radially and axially support and provide sliding engagement with rotor 1303.

Although FIGS. 13A and 13B show four polycrystalline diamond elements 1301, it would be understood by those skilled in the art that fewer (e.g., three) or more polycrystalline diamond elements may be deployed in stator 1302. Further, although FIGS. 13A and 13B depict a single circumferential set of polycrystalline diamond elements 1301, it would be understood by those skilled in the art that one or more additional circumferential sets of polycrystalline diamond elements may be deployed in the stator to increase lateral and axial support and lateral and axial load taking capability of the bearing assembly.

While FIGS. 13A and 13B are described as a bearing arrangement between a rotor 1303 and stator 1302, one skilled in the art would understand that the rotor may, instead, be a drive shaft, and the stator may, instead, be a bearing housing.

As is evident in view of FIGS. 2A-13B, some aspects of the present disclosure include high-performance radial bearings incorporating polycrystalline diamond elements in sliding engagement with curved or cylindrical surfaces formed of or including at least some diamond reactive material. Some such aspects include high-performance radial bearings where a diamond reactive material containing rotor is put into sliding contact with preferably three or more polycrystalline diamond elements mounted on a stator. The polycrystalline diamond elements of the stator are preferably planar faced, but may also be slightly concave, convex, or any combination of the three. The facial contours of the polycrystalline diamond elements of the stator need not, and preferably do not, match the curve of the circumference of the stator. Although three or more polycrystalline diamond elements are preferred, the technology of the application may be practiced with as few as one or two polycrystalline diamond elements, such as where the polycrystalline diamond elements are used to reduce wear and friction on the gravitational low side of a stator in a horizontally oriented positive displacement pump or opposite the scribe side of a directional drilling assembly.

In certain applications, the bearing assemblies disclosed herein are configured to resist thrust load. At least some embodiments of the bearing assemblies disclosed herein are capable of simultaneously handling components of both radial and thrust loads.

At least some embodiments of the bearing assemblies disclosed are economically viable and of a relatively large diameter.

Edge Radius Treatment

In some aspects, the polycrystalline diamond elements are subjected to edge radius treatment. Edge radius treatment of polycrystalline diamond elements are well known in the art. In some embodiments of the technology of this application that employ planar or concave polycrystalline diamond elements, it is preferred to employ edge radius treatment of such polycrystalline diamond elements. One purpose of employing an edge radius treatment is to reduce or avoid potential for outer edge cutting or scribing at the outer limits of the linear engagement area of a given polycrystalline diamond elements with the opposing engagement surface (e.g., a curved surface.

Polycrystalline Diamond Element

In certain applications, the polycrystalline diamond elements disclosed herein have increased cobalt content transitions layers between the outer polycrystalline diamond surface and a supporting tungsten carbide slug, as is known in the art.

The polycrystalline diamond elements may be supported by tungsten carbide, or may be unsupported, "standalone" polycrystalline diamond elements that are mounted directly to the bearing component.

The polycrystalline diamond elements may by non-leached, leached, leached and backfilled, thermally stable, coated via chemical vapor deposition (CVD), or processed in various ways as known in the art.

Polycrystalline Diamond Element—Shapes, Sizes, and Arrangements

The polycrystalline diamond elements may have diameters as small as 3 mm (about ⅛") or as large as 75 mm (about 3"), depending on the application and the configuration and diameter of the bearing. Typically, the polycrystalline diamond elements have diameters between 8 mm (about 5/16") and 25 mm (about 1").

Although the polycrystalline diamond elements are most commonly available in cylindrical shapes, it is understood that the technology of the application may be practiced with polycrystalline diamond elements that are square, rectangular, oval, any of the shapes described herein with reference to the Figures, or any other appropriate shape known in the art. In some applications, the radial bearings have one or more convex, contoured polycrystalline diamond elements mounted on a rotor (or stator) in sliding contact with a stator (or rotor).

In some applications, the polycrystalline diamond elements are deployed in rings along the bearing component. A non-limiting example is a ring of five planar face polycrystalline diamond elements deployed on a distal portion of a stator and another ring of five planar face polycrystalline diamond elements deployed on a proximal portion of the stator. Thus, the high-performance polycrystalline diamond elements bearing assemblies can be deployed to ensure stable operation along the length of the stator/rotor interface, while requiring less total polycrystalline diamond elements than are used in prior, existing assemblies.

The polycrystalline diamond elements may be arranged in any pattern, layout, spacing or staggering within the bearing assembly to provide the desired support, without concern for the need for overlapping contact with polycrystalline diamond elements engagement surfaces on the opposing bearing component.

Polycrystalline Diamond Element—Contact Area of Engagement Surface

The polycrystalline diamond elements disclosed herein are, in some embodiments, not shaped to conform precisely to the opposing engagement surface. In certain embodiments, the sliding interface contact area of the engagement surface of the polycrystalline diamond element is less than 80%, or less than 75%, or less than 70%, or less than 60% of the total surface area of the polycrystalline diamond element. As used herein, the "contact area" of the engagement surface refers to the surface area of the engagement surface that is in contact with the opposing engagement surface. In some embodiments, the engagement surface is in sliding engagement with the opposing engagement surface along a contact area, the opposing engagement surface rotates about an axis of rotation, and any imaginary line extending from and normal to the contact area surface is at an angle relative to the axis of rotation. In some embodiments, the engagement surface is in sliding contact with the opposing engagement surface through a substantial portion of its use profile.

A key performance criterion is that the polycrystalline diamond element is configured and positioned in such a way as to preclude any edge or point contact with the opposing engagement surface or component. For a planar faced polycrystalline diamond element placed on the stator, such polycrystalline diamond elements typically experience less than full face contact with the rotor. That is, as the rotor rotates against the polycrystalline diamond elements, the engagement surface contact area is less than full face. For polycrystalline diamond elements, mounted on either the rotor or stator, that are at least slightly domed or convex, such polycrystalline diamond elements exhibit a small, generally circular engagement surface contact area. If the convex polycrystalline diamond elements, mounted on either the rotor or stator, are saddle shaped, then the polycrystalline diamond elements exhibit a small linear area engagement surface contact area. For slightly concave polycrystalline diamond elements that are deployed on the stator, a somewhat narrow linear engagement surface contact area is exhibited on each polycrystalline diamond element.

Polycrystalline Diamond Element—Mounting

As previously described, the polycrystalline diamond elements may be mounted directly to the bearing element (e.g., stator or rotor) via methods known in the art including, but not limited to, brazing, gluing, press fitting, shrink fitting, or threading. Additionally, the polycrystalline diamond elements may be mounted in a separate ring or rings. The ring or rings may then be deployed on the bearing element (rotor or stator) via methods known in the art including, but not limited to, gluing, press fitting, thread locking, or brazing.

Planar face or domed polycrystalline diamond elements may be mounted in a manner to allow them to rotate about their own axis. Reference is made to U.S. Pat. No. 8,881,849, to Shen et. al., as a non-limiting example of a method to allow the polycrystalline diamond element to spin about its own axis while in facial contact with subject material.

Treatment of Opposing Engagement Surface

In some aspects, the opposing engaging surface of the diamond reactive material is pre-saturated with carbon (e.g., prior to engagement with the engagement surface). Such pre-saturation reduces the ability of the diamond reactive material to attract carbon through graphitization of the surface of the polycrystalline diamond. The pre-saturation of the diamond reactive material surface contact area may be accomplished via any method known in the art.

Solid Lubricant Source

In certain applications, a solid lubricant source, for example, a graphite or hexagonal boron nitride stick or inclusion, either energized or not energized, is in contact with the opposing engagement surface formed of or including at least some the diamond reactive material. In some embodiments, the sliding engagement between engagement surface and opposing engagement surface is non-lubricated.

Drive Shaft with Polycrystalline Diamond Elements

Figure 14A:
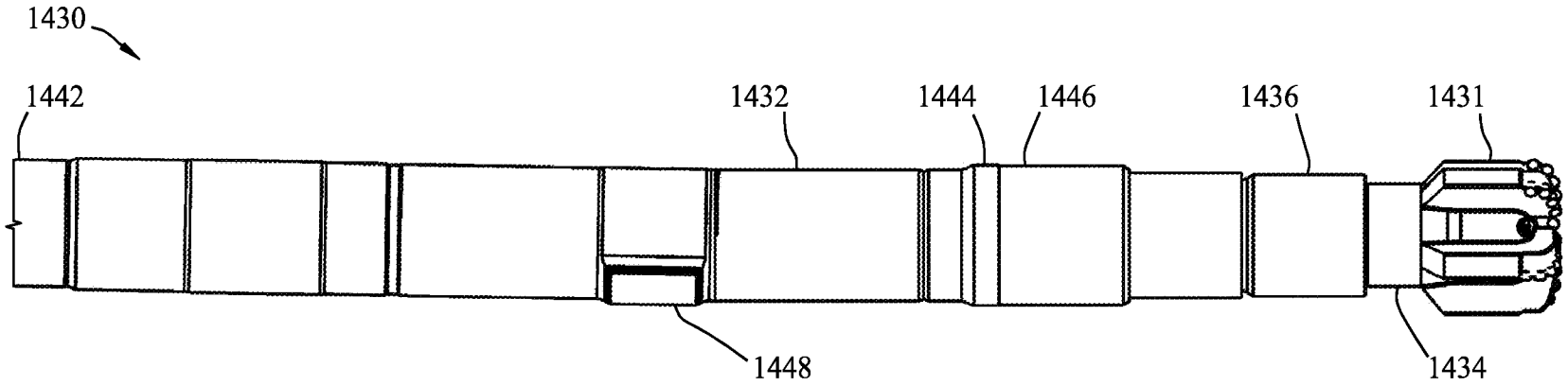
FIG. 14A is a portion of a drill string assembly.
Figure 14B:
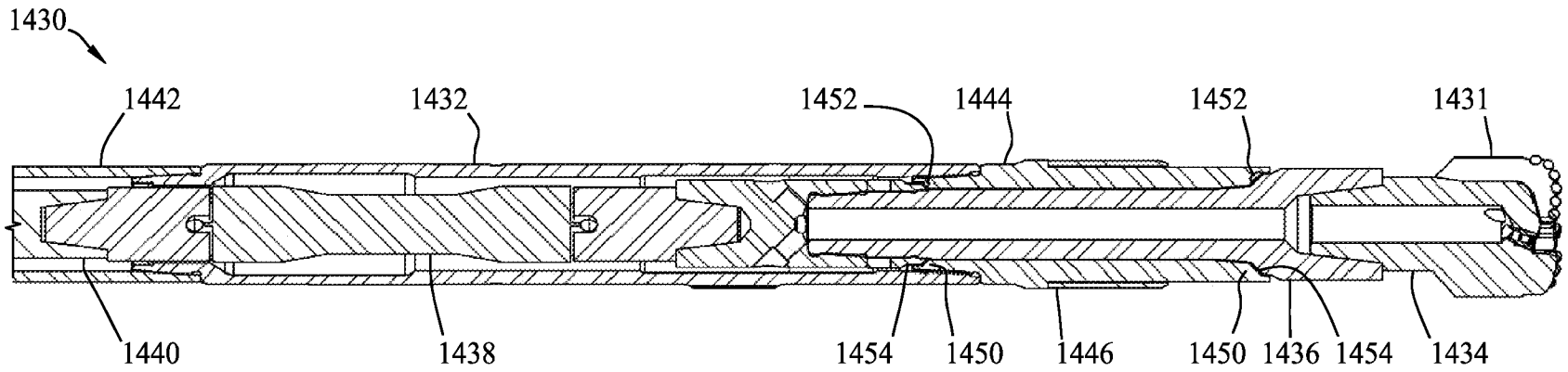
FIG. 14B is a cross-sectional view of a portion of the assembly of FIG. 14A.

Certain embodiments of the present disclosure include drilling tools (e.g., motors) and components thereof, such as drive shafts and bearing housings, that include polycrystalline radial bearing assemblies thereon. As used herein, downhole tools and downhole drilling tools may be or include, but are not limited to, rotary steerable tools, turbines, jars, reamers, agitators, MWD tools, LWD tools, and drilling motors. Drill strings may include a number of segments, including drill piping or tubulars extending from the surface, a mud motor (i.e., a positive displacement progressive cavity mud powered motor) and a drill bit. The mud motor may include a rotor catch assembly, a power section, a transmission, a bearing package (bearing assembly), and a bit drive shaft with a bit box. The power section generally includes a stator housing connected to and part of the drill string, and a rotor. The radial bearings shown and described with reference to FIGS. 1-13B may be incorporated into a such drilling motors (e.g., at the drive shaft and bearing housing). With reference to FIGS. 14A and 14B, some embodiments include a bottom hole assembly (BHA) or a portion thereof, including assembly 1430. Assembly 1430 includes rotor 1440 movably coupled within a bore of stator 1442. Rotor 1440 is coupled with transmission 1438, which is positioned and movably coupled within a bore of transmission housing 1432. Transmission 1438 is coupled with drive shaft 1436, which is positioned and movably coupled within a bore of bearing housing 1444. Drive shaft 1436 is coupled with bit shaft 1434, and bit shaft 1434 is coupled with or integral with drill bit 1431. Stator 1442 is coupled with transmission housing 1432, which is coupled with bearing housing 1444, which is coupled with shaft housing 1446. In operation, the mud motor (rotor 1440 and stator 1442) is powered by energy harvested from drilling mud as the mud passes through the power section. The drilling mud is pumped at high pressures and volumes from the surface down the internal cavities of a drill string and through the power section. Mud passing through the power section rotates rotor 1440 with respect to stator 1442. Rotor 1440, in-turn, drives rotation, through a transmission driveline (transmission 1438), drive shaft 1436, and bit shaft 1434, to drill bit 1431. Assembly 1430 may be generally tubular, and may include one or more tubular subunits or subs to, for example and without limitation, facilitate assembly thereof. One having ordinary skill in the art with the benefit of this disclosure would understand that the specific sub arrangement of assembly 1430 depicted and described herein is merely exemplary and is not intended to limit the scope of this disclosure. In some embodiments, assembly 1430 includes one or more external stabilizers 1448 to, for example and without limitation, position assembly 1430 within a wellbore. External stabilizers 1448 may be, for example and without limitation, one or more radial protrusions. External stabilizers 1448 may be positioned and sized depending on the wellbore in which assembly 1430 is to be used. While drive shaft 1436 is shown as coupled with rotor 1440 via transmission 1438, in some embodiments, drive shaft 1436 is coupled directly to rotor 1440. Also, while drive shaft 1436 is shown as coupled with drill bit 1431 via bit shaft 1434, in some embodiments drive shaft 1436 is coupled directly to drill bit 1431. FIG. 14D is a simplified schematic showing the basic arrangement and coupling between rotor 1440, drive shaft 1436, and drill bit 1431, such that rotor 1440 drives shaft 1436, which in-turn drives bit 1431.

Figure 15B:
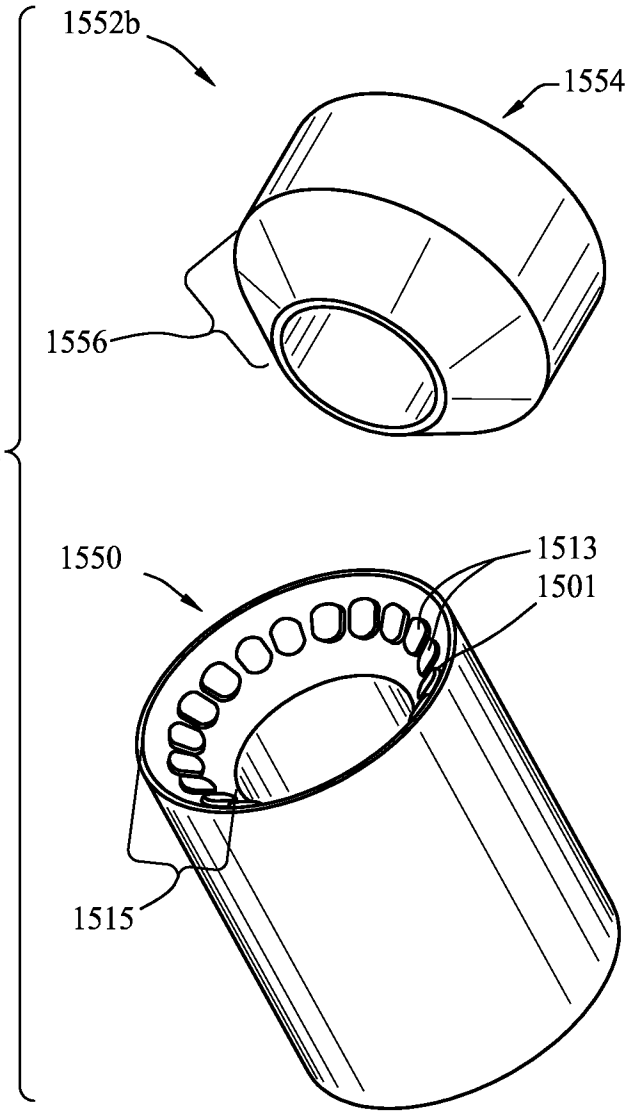
FIG. 15B depicts a cup portion and a cone portion of another radiused conical bearing with polycrystalline diamond elements on the cup portion.
Figure 15A:
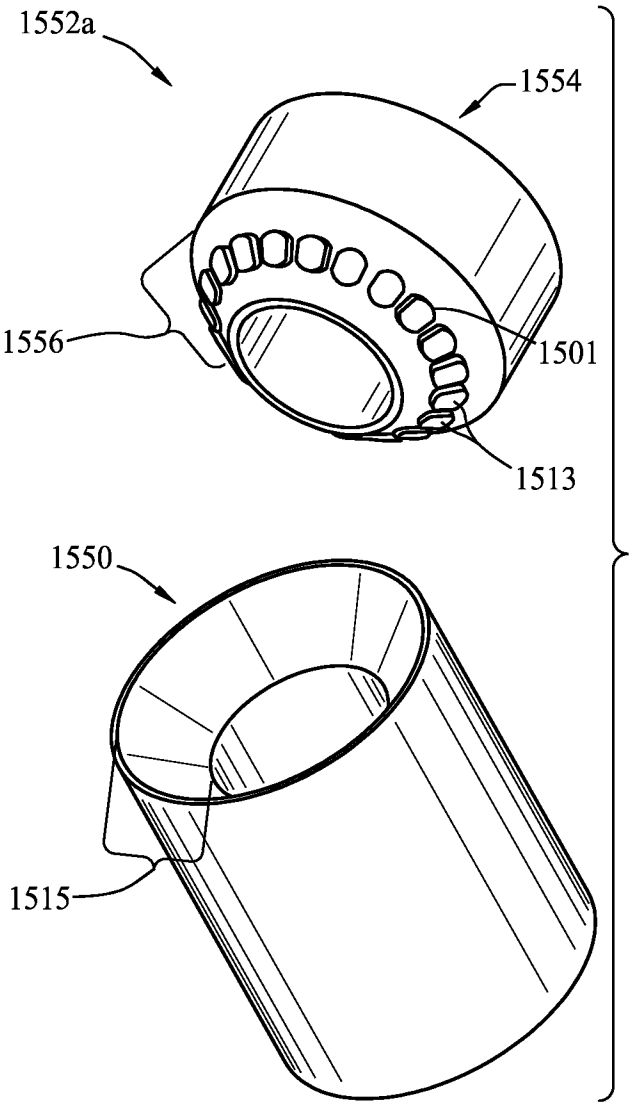
FIG. 15A depicts a cup portion and a cone portion of a radiused conical bearing with polycrystalline diamond elements on the cone portion.
Figure 15D:
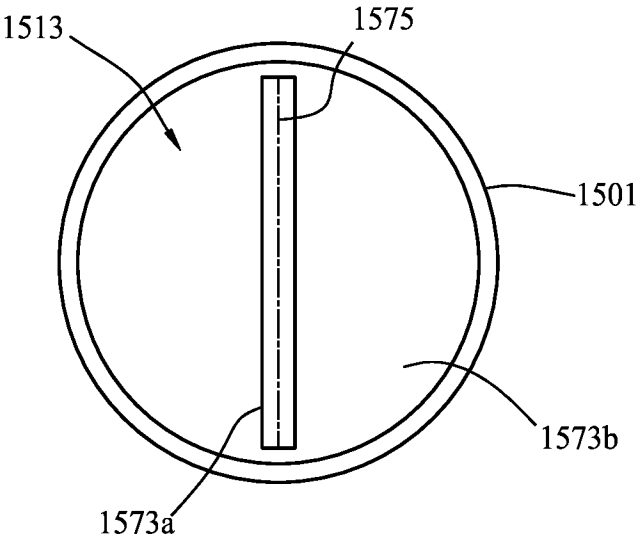
FIG. 15D is a top view of the polycrystalline diamond element of FIG. 15C.
Figure 15C:
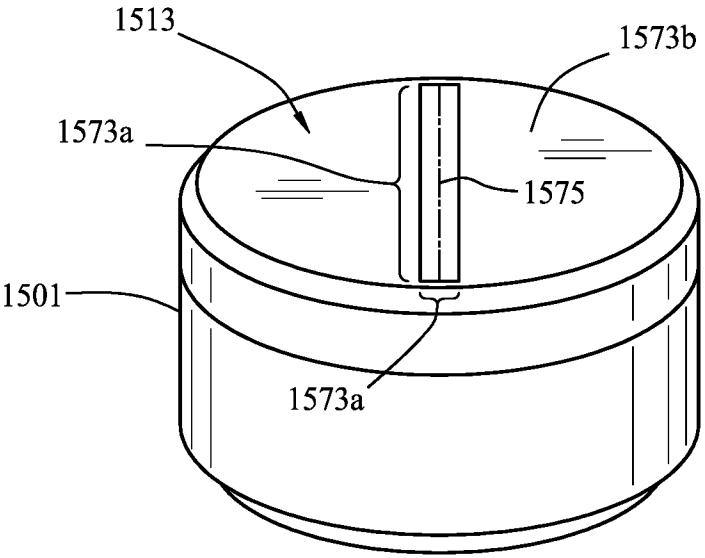
FIG. 15C is a perspective view of a polycrystalline diamond element showing the engagement surface thereof.

Drive shaft 1436 is coupled with bearing housing 1444 via one or more bearings 1452, which are or include polycrystalline diamond elements. In some embodiments, bearings 1452 are radiused conical bearings, also referred to in the art as angle, taper, or cup/cone bearings, including cup portion 1450 coupled with cone portion 1454. FIGS. 15A and 15B depict more detailed views of radiused conical bearings. With reference to FIG. 15A, radiused conical bearing 1552*a* includes cup portion 1550 and cone portion 1554. As shown in FIG. 15A, cone portion 1554 includes bearing surface 1554. Bearing surface 1556 has a plurality of polycrystalline diamond elements 1501 thereon, and extending therefrom. Each polycrystalline diamond element 1501 has an engagement surface 1513, and cup portion 1550 has opposing engagement surface 1515. Cup portion 1550 and cone portion 1554 may be generally annular and configured to contact at engagement surfaces 1513 and opposing engagement surface 1515. Bearing surface 1556 and opposing engaging surface 1515 may be generally frustoconical in shape, such that bearing 1552*a* resists longitudinal or thrust loading as well as resisting radial loading between cup portion 1550 and cone portion 1554, while allowing relative rotation between cup portion 1550 and cone portion 1554. As such, bearing 1552*a* may act as both a radial and thrust bearing. Opposing engagement surface 1515 is or includes a diamond reactive material, such as steel. FIG. 15B depicts bearing 1552*b*, which is identical to bearing 1552*a*, with the exception that polycrystalline diamond elements 1501 are positioned and extend from surface 1515, as opposed to surface 1556. In some embodiments, when engagement surfaces 1513 are engaged with opposing engagement surface (1515 or 1556), less than an entirety of each engagement surface 1513 is engaged with the opposing engagement surface. In some embodiments, less than 90%, less than 80%, less than 70%, less than 60%, less than 50%, less than 40%, or less than 30% of a surface area of each engagement surface 1513 is engaged with the opposing engagement surface. With reference to FIGS. 15C and 15D, engagement surface 1513 of polycrystalline diamond element 1501 is shown, with contact area 1573*a* indicating the portion of the surface area of engagement surface 1513 that would be in contact with the opposing engagement surface in a bearing assembly, with the remainder of contact area 1573*b* of engagement surface 1513 not in contact with the opposing engagement surface. That is, contact area 1573*a* defines the area of contact of engagement surface 1513 after a bearing load is applied thereto. The contact area 1573*a* is, of course, for exemplary purposes only and is only intended to illustrate that the contact area 1573*a* is less than an entirety of available surface area on engagement surface 1513. As shown, contact area 1573*a* may be or define a line contact or linear contact 1575, such that when engagement surface 1513 is in sliding engagement with an opposing engagement surface, the sliding contact occurs along line contact 1575. In some embodiments, engagement surface 1513 is in sliding engagement with an opposing engagement surface along contact area 1573*a*, the opposing engagement surface rotates about an axis of rotation, and any imaginary line extending from and normal to contact area 1573 surface is at an angle relative to said axis of rotation. In some embodiments, engagement surface 1513 is in sliding contact with an opposing engagement surface through a substantial portion of its use profile.

In some embodiments, the opposing engagement surface does not have any polycrystalline diamond elements or any other bearing elements, and is a single, continuous surface. In some such embodiments, the engagement surfaces are multiple, discrete, spaced-apart surfaces that are each positioned to engage with the same opposing engagement surface. When engaged, in operation, the multiple, discrete, spaced-apart engagement surfaces may maintain constant contact with the single continuous, opposing engagement surface. In some embodiments, the sliding engagement between the engagement surfaces and the opposing engagement surface is non-lubricated. In some embodiments, the drive shaft has a rotational velocity, the engagement between the engagement surface and opposing engagement surface defines a contact area, and the contact area is independent of the rotational velocity of the drive shaft. In some such embodiments, the drive shaft has a variable rotational velocity, and the engagement surfaces follow an engagement path on the opposing engagement surface that is constant through the variable rotational velocities.

With reference to FIGS. 14A and 14B, the cup portion shown and described in FIGS. 15A and 15B may be a portion of bearing housing 1444, and the cone portion may be a portion of drive shaft 1436.

Figure 14C:
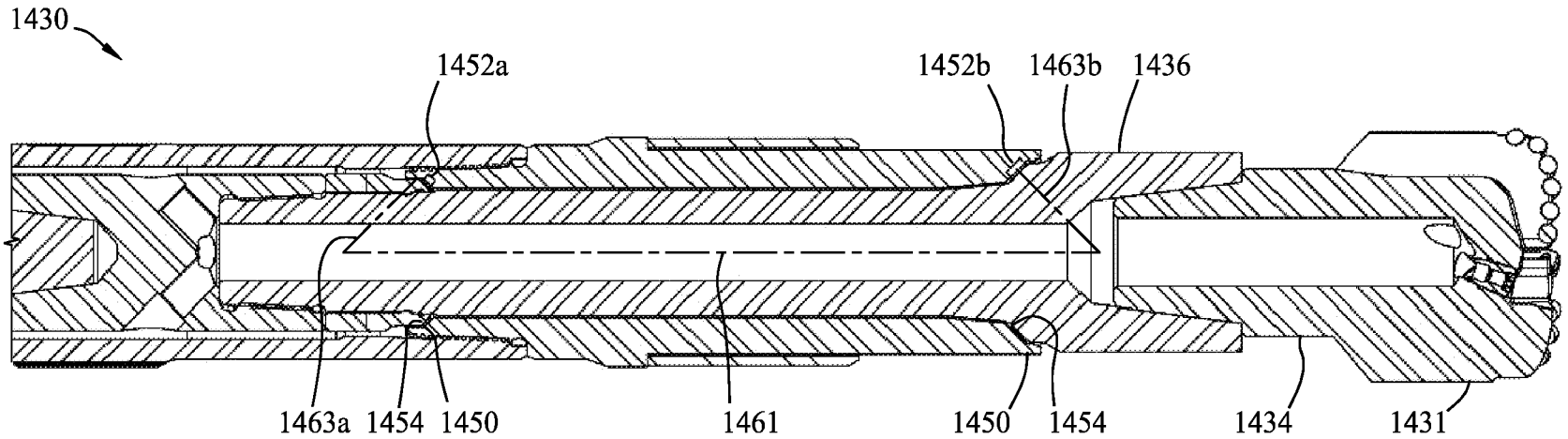
FIG. 14C is another cross-sectional view of a portion of the assembly of FIG. 14A.
Figure 14D:
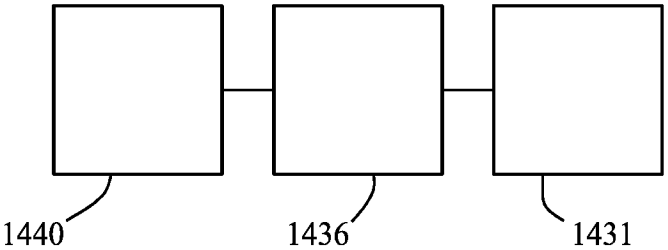
FIG. 14D is a simplified schematic of a drilling motor coupled with a drill bit.

With reference to FIG. 14C, bearings 1452*a* and 1452*b* may be positioned such that bearings 1452*a* and 1452*b* retain drive shaft 1436 both longitudinally and radially. In some embodiments, bearings 1452*a* and 1452*b* may be oriented in opposing directions, as shown by mounting orientations 1463*a* and 1463*b*. Although described herein as utilizing two bearings 1452*a* and 1452*b*, one having ordinary skill in the art with the benefit of this disclosure would understand that any number of bearings may be utilized without deviating from the scope of this disclosure. FIG. 14C also depicts the effective bearing spread 1461.

Figure 16A:
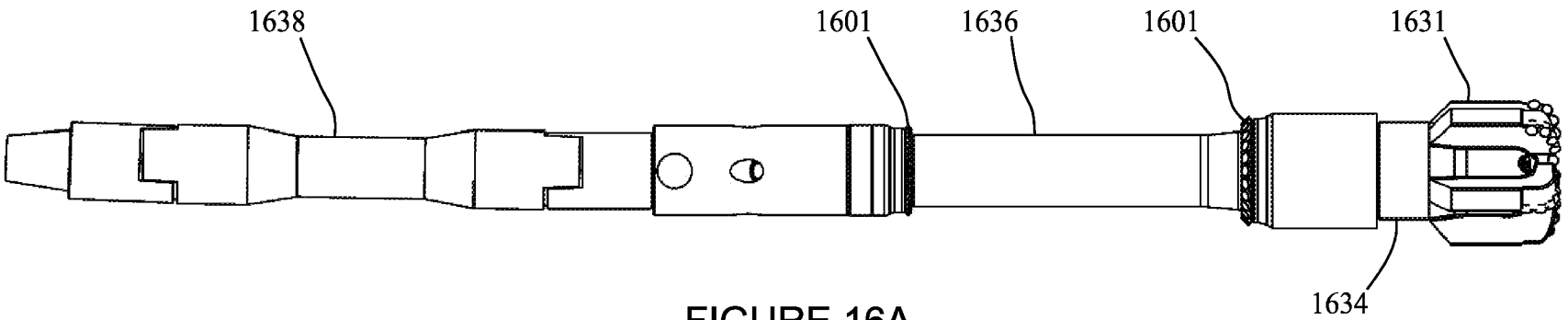
FIG. 16A is a side view of a portion of a drill string assembly.
Figure 16B:
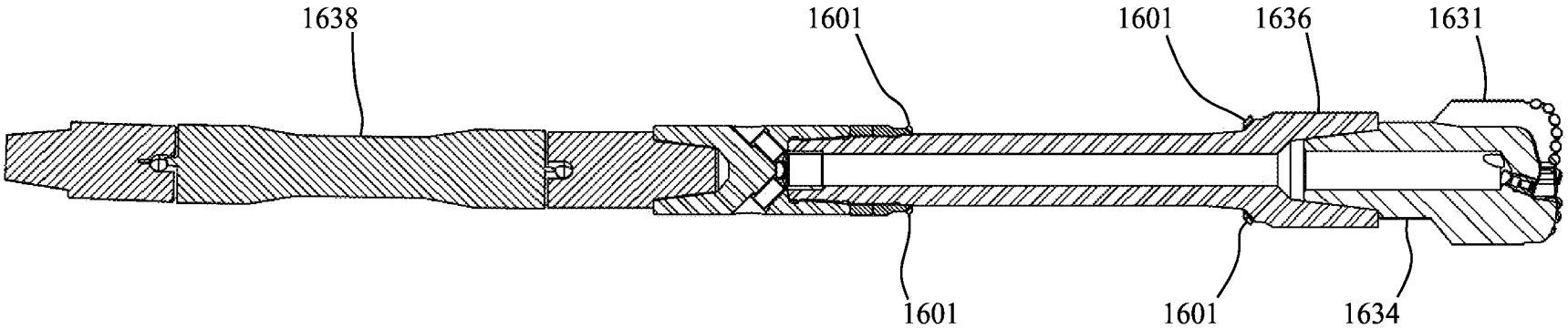
FIG. 16B is a cross-sectional view of the drill string assembly of FIG. 16A.
Figure 16C:
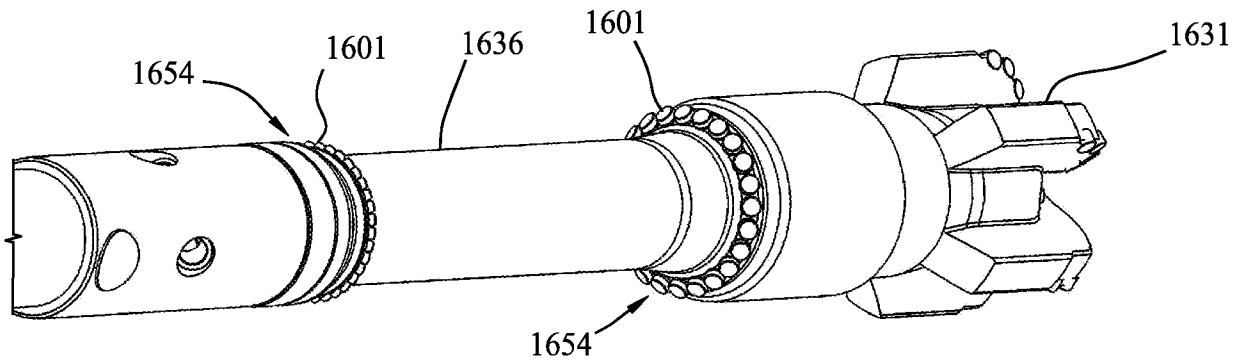
FIG. 16C is a perspective view of a portion of the drill string assembly of FIG. 16A.
Figure 16D:
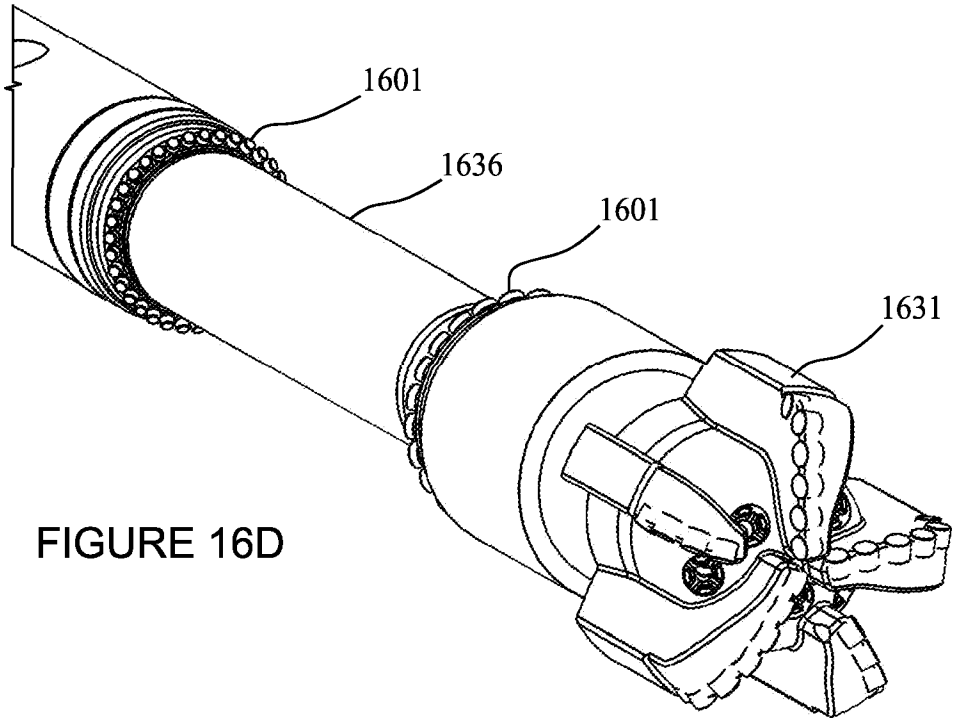
FIG. 16D is another perspective view of a portion of the drill string assembly of FIG. 16A.
Figure 16F:
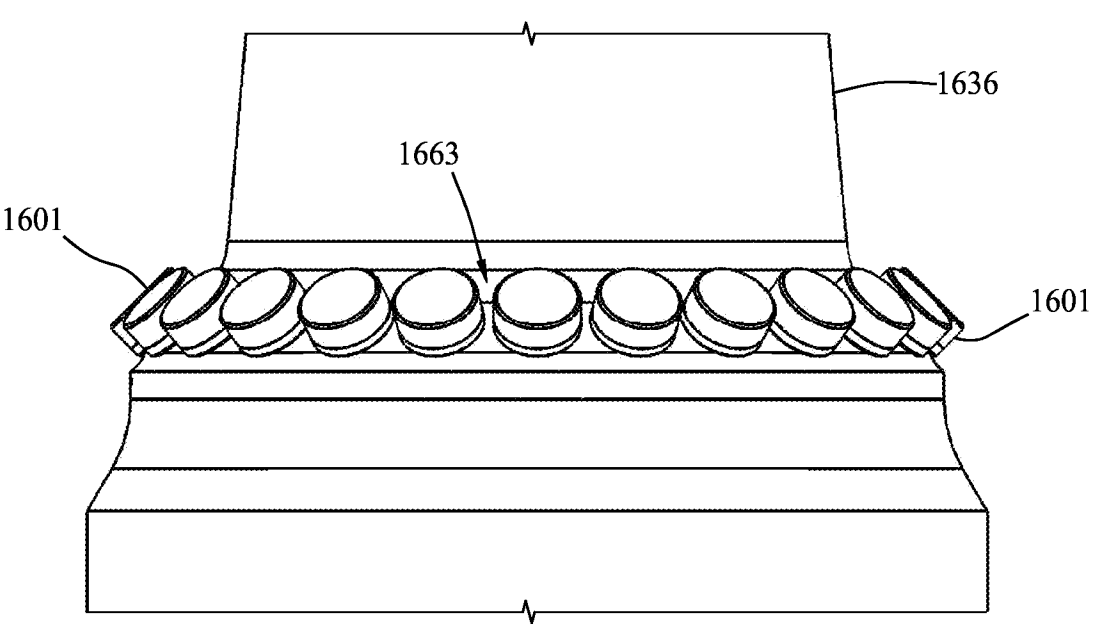
FIG. 16F is a detail view of a portion of the drill string assembly of FIG. 16E.
Figure 16G:
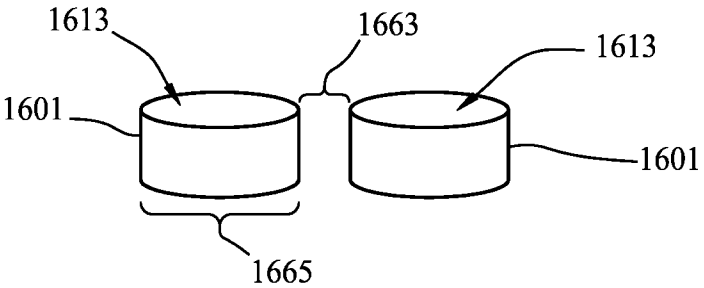
FIG. 16G depicts two, adjacent polycrystalline diamond elements, showing the spacing therebetween.
Figure 16E:
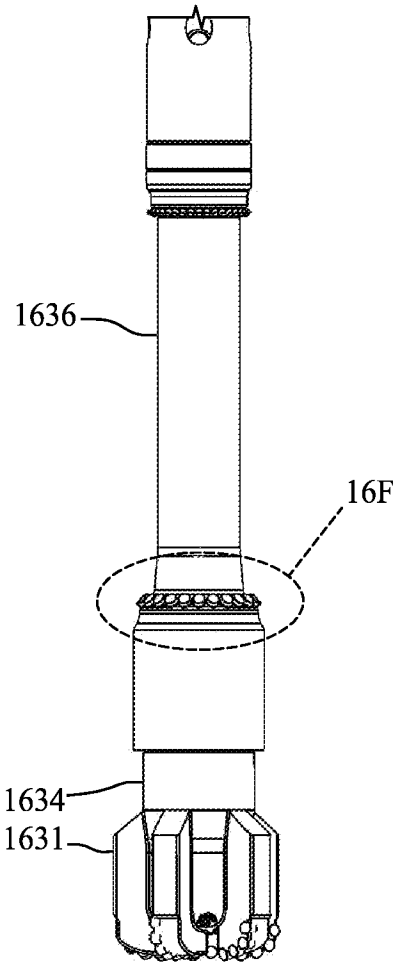
FIG. 16E is another side view of a portion of the drill string assembly of FIG. 16A.

FIGS. 16A-16G depict portions of a drill string assembly without the outer housing thereon, including transmission 1638, drive shaft 1636, bit shaft 1634, and drill bit 1631. Drive shaft 1636 includes cone portions 1654, each engaged with a plurality of polycrystalline diamond elements 1601. While not shown, the polycrystalline diamond elements 1601 are coupled on a cup portion of a bearing housing (not shown) surrounding drive shaft 1636, which may be the same as that shown in FIGS. 14A-14C, and are positioned on the bearing housing such that the polycrystalline diamond elements 1601 engaged with drive shaft 1636. Each polycrystalline diamond element 1601 includes an engagement surface 1613, for engagement with an opposing engagement surface of cone portions 1654. As shown in FIGS. 16F and 16G, the bearing element spacing 1663 between adjacent polycrystalline diamond elements 1601 is relatively narrow. As used herein, "bearing element spacing" refers to the distance between adjacent polycrystalline diamond elements. In some embodiments, the bearing element spacing 1663 is sufficiently narrow, such that bearing element spacing 1663 is less than a width 1665 of each adjacent polycrystalline diamond element 1601.

Figure 17A:
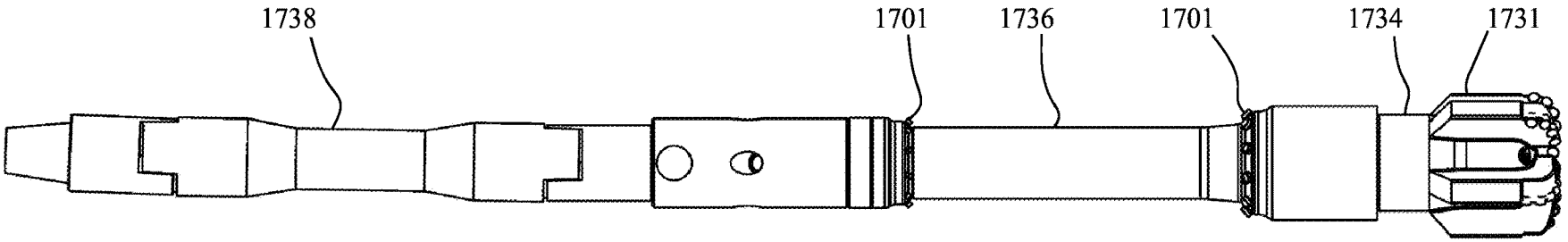
FIG. 17A is a side view of a portion of a drill string assembly.
Figure 17B:
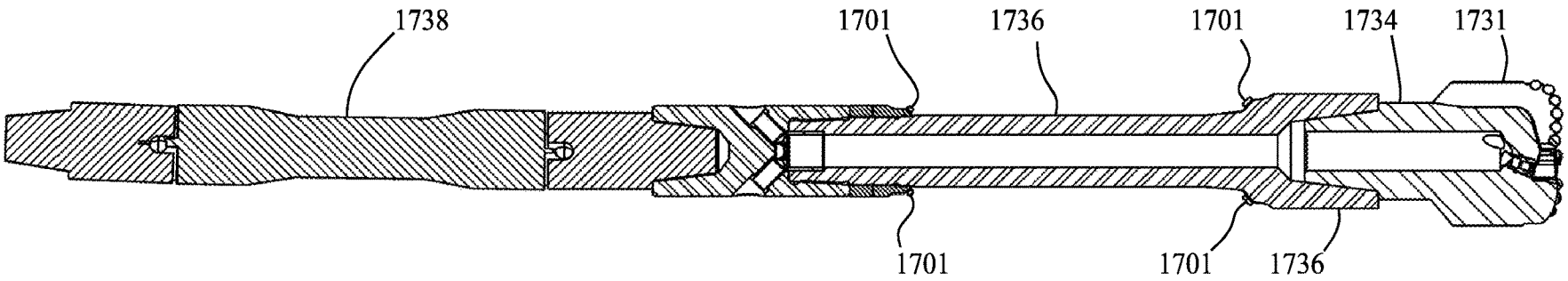
FIG. 17B is a cross-sectional view of the drill string assembly of FIG. 17A.
Figure 17C:
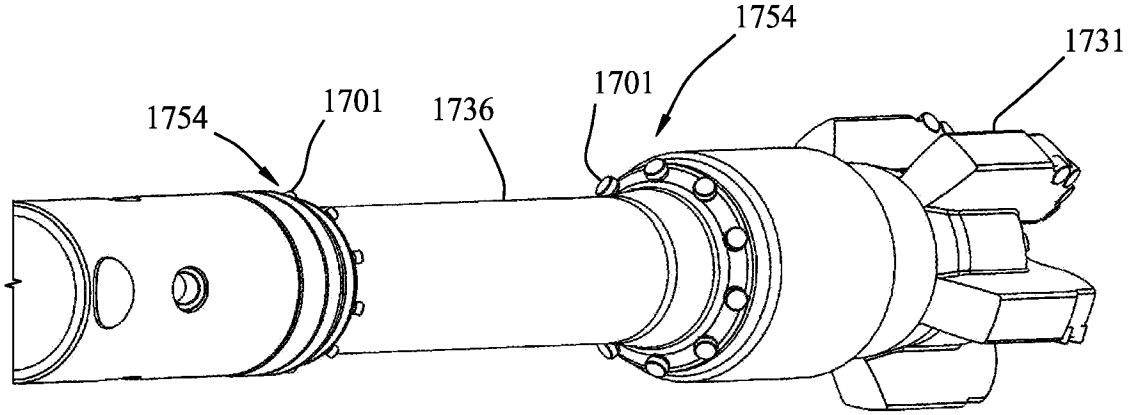
FIG. 17C is a perspective view of a portion of the drill string assembly of FIG. 17A.
Figure 17D:
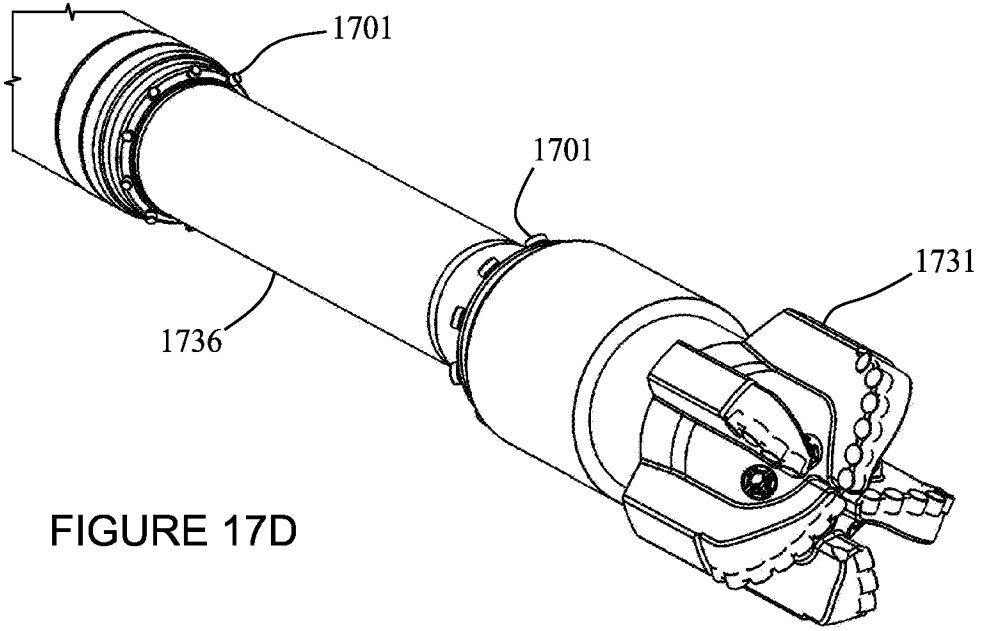
FIG. 17D is another perspective view of a portion of the drill string assembly of FIG. 17A.
Figure 17F:
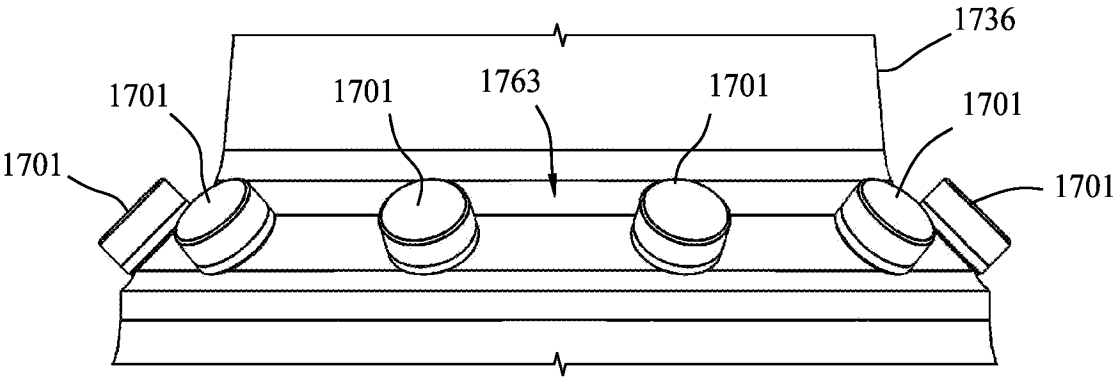
FIG. 17F is a detail view of a portion of the drill string assembly of FIG. 17E.
Figure 17G:
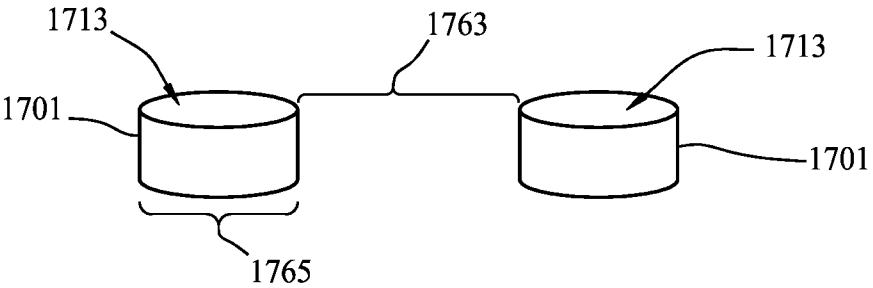
FIG. 17G depicts two, adjacent polycrystalline diamond elements, showing the spacing therebetween.
Figure 17E:
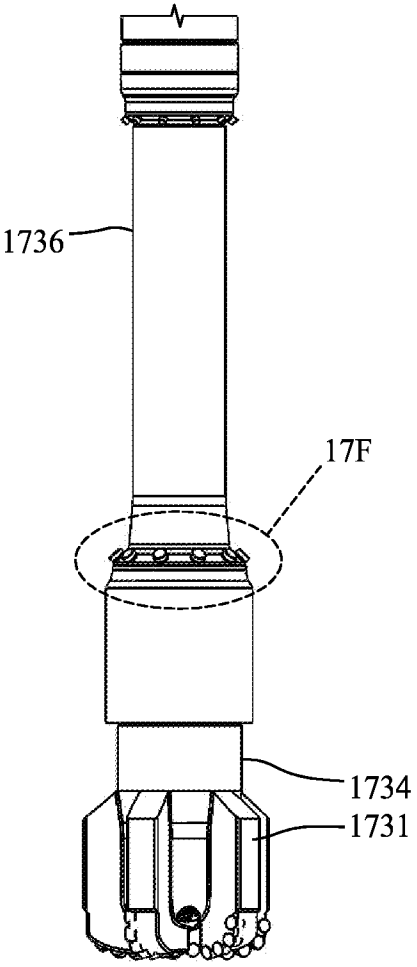
FIG. 17E is another side view of a portion of the drill string assembly of FIG. 17A.

FIGS. 17A-17G depict portions of a drill string assembly without the outer housing thereon. The portion of the drill string assembly shown in FIGS. 17A-17G is identical to that of FIGS. 16A-16G, with the exception that the bearing element spacing in FIGS. 17A-17G is greater than the bearing element spacing in FIGS. 16A-16G. The drill string assembly shown in FIGS. 17A-17G includes transmission 1738, drive shaft 1736, bit shaft 1734, and drill bit 1731. Drive shaft 1736 includes cone portions 1754 engaged with a plurality of polycrystalline diamond elements 1701, which are coupled on cup portion of a bearing housing (not shown), which may be the same as the bearing housing (1444) shown in FIGS. 14A-14C. Each polycrystalline diamond element 1701 includes an engagement surface 1713, for engagement with an opposing engagement surface of cone portions 1754. As shown in FIGS. 17F and 17G, the bearing element spacing 1763 between adjacent polycrystalline diamond elements 1701 is wide relative to that of FIGS. 16F and 16G. In some embodiments, the bearing element spacing 1763 is sufficiently wide, such that bearing element spacing 1763 is greater than a width 1765 of each adjacent polycrystalline diamond element 1701. In some embodiments, bearing element spacing 1763 is at least 50%, at least 75%, at least 100%, at least 150%, at least 200%, or at least 300% greater than width 1765.

Figure 18A:
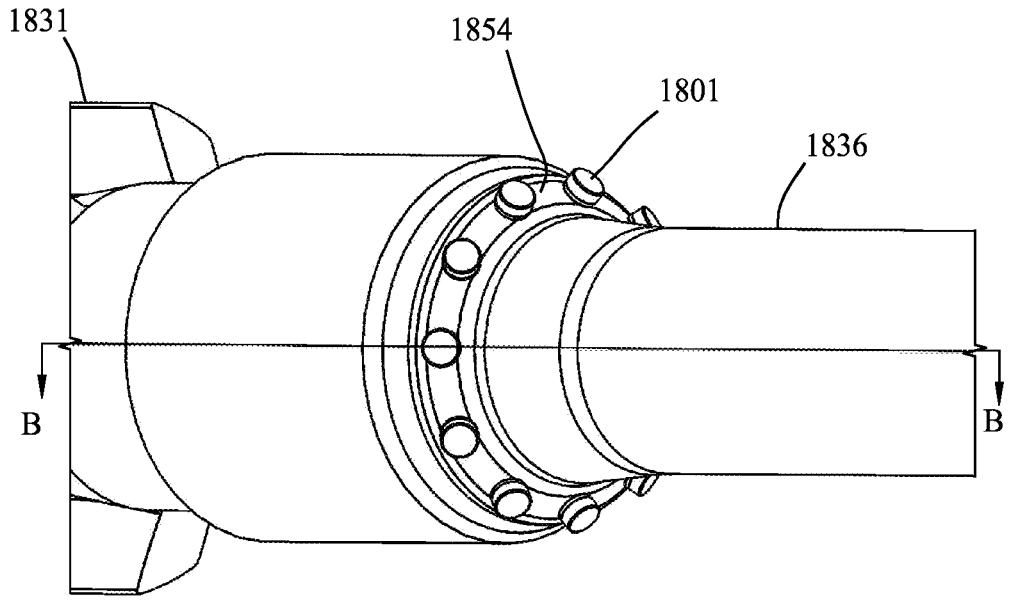
FIG. 18A is a perspective view of a portion of a drill string assembly.
Figure 18B:
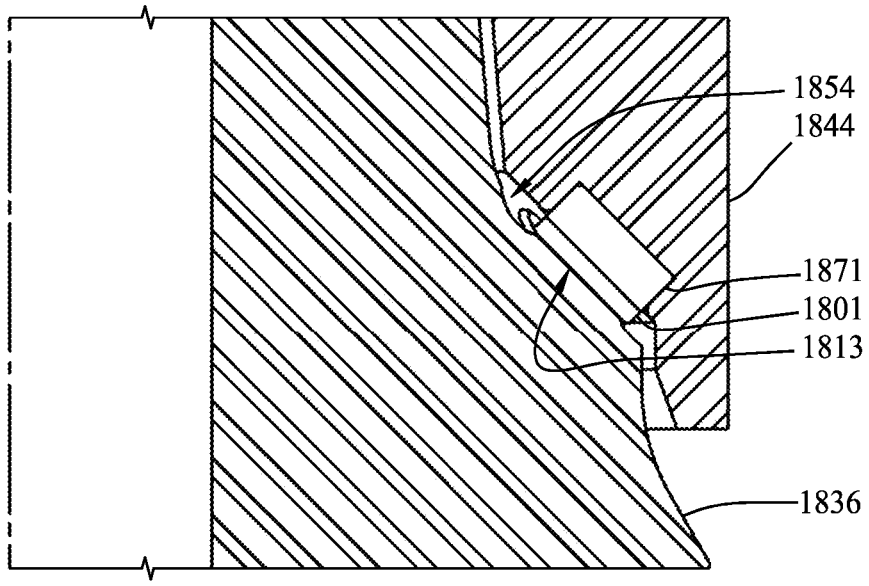
FIG. 18B is a cross-sectional view of FIG. 18A along line B-B.
Figure 18D:
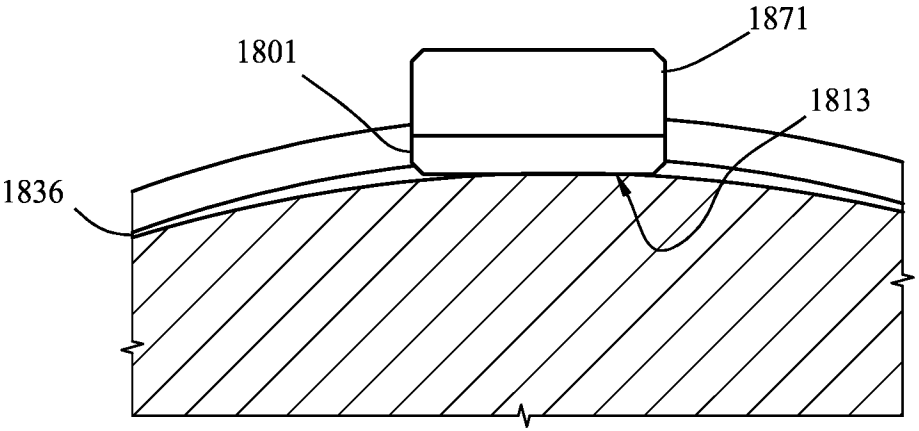
FIG. 18D is a cross-sectional view of FIG. 18C along line D-D.
Figure 18E:
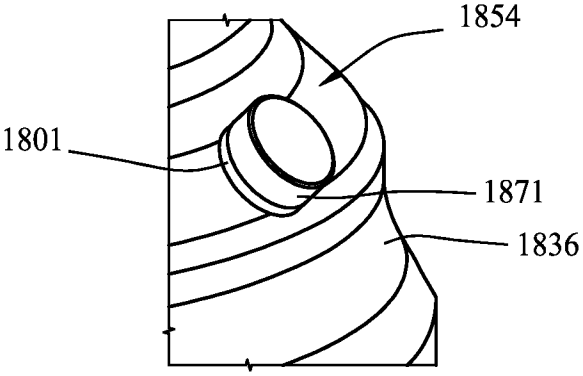
FIG. 18E is a perspective view of a drive shaft having a polycrystalline diamond element engaged therewith.
Figure 18C:
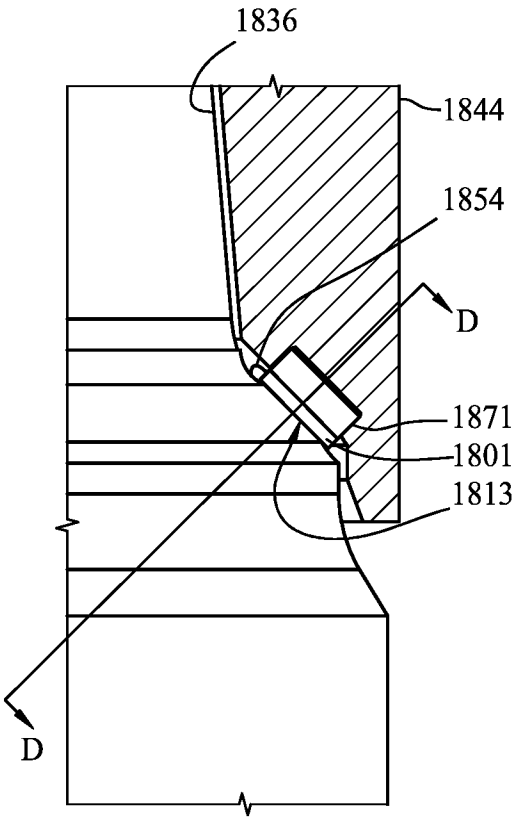
FIG. 18C is a side view of a portion of the drill string assembly of FIG. 18A.

FIGS. 18A-18D depict portions of the drive shaft and bearing elements thereof. Drive shaft 1836 is engaged with, at cup portion 1854, a plurality of polycrystalline diamond elements 1801. Each polycrystalline diamond element 1801 has an engagement surface 1813, is supported via supports 1871 (e.g., tungsten carbide), and is coupled on a cone portion of a bearing housing, 1844, which may be the same as the bearing housing (1444) shown in FIGS. 14A-14C. As shown, each engagement surface 1813 is planar. As shown in FIGS. 18B, edge contact between the polycrystalline diamond and drive shaft 1836 is avoided.

Figure 18G:
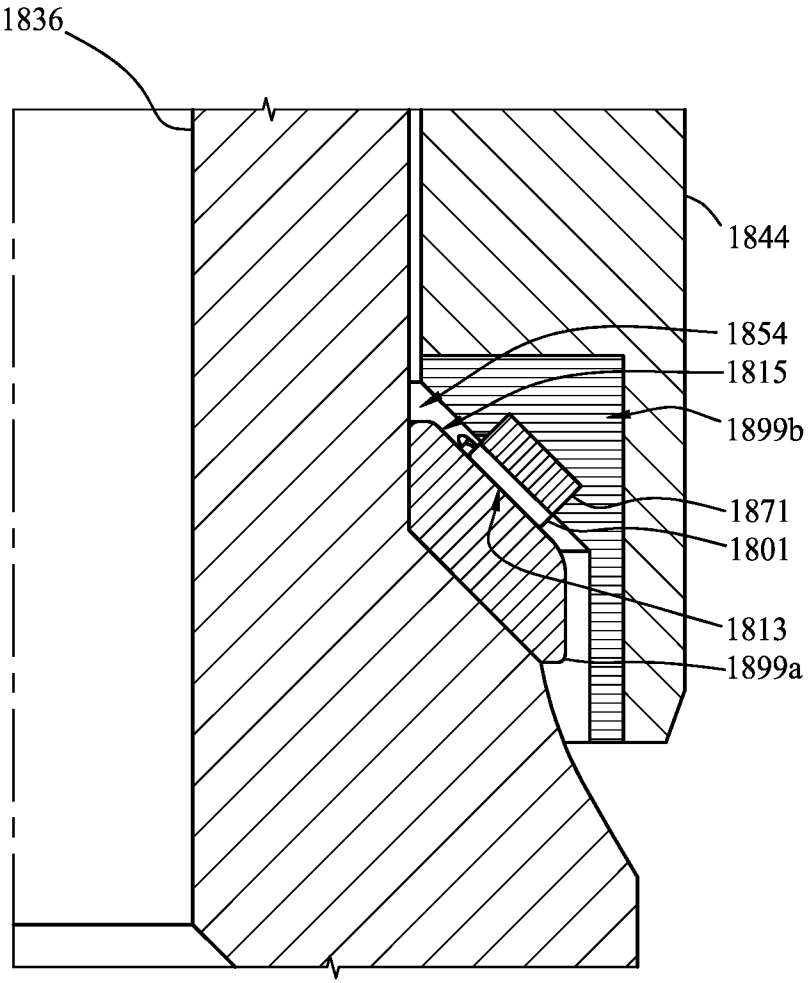
FIG. 18G is a cross-sectional view of a portion of a drill string assembly substantially identical to that of FIG. 18F, with the exception that the drive shaft and the bearing housing have bearing rings positioned thereabout.
Figure 18F:
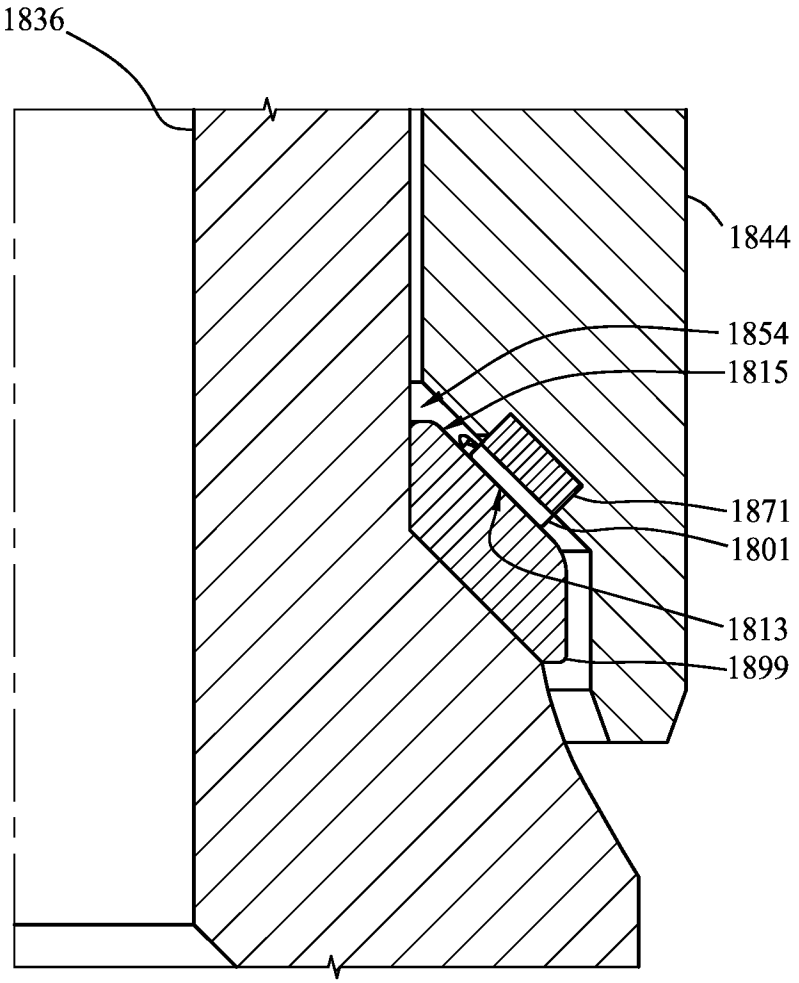
FIG. 18F is a cross-sectional view of a portion of a drill string assembly substantially identical to that of FIG. 18B, with the exception that the drive shaft has a bearing ring positioned thereabout.

FIG. 18F is a cross-sectional view of a portion of a drill string assembly substantially identical to that of FIG. 18B, with the exception that the drive shaft has a bearing ring positioned thereabout.

Bearing ring 1899 is coupled about the outer circumference of drive shaft 1836, at cup portion 1854 of drive shaft 1836. Bearing ring 1899 may be composed of the same material as drive shaft 1836, or may be composed of a different material than drive shaft 1836. In some embodiments bearing ring 1899 is composed of a material that has higher wear-resistance than the material that drive shaft 1836 is composed of. Bearing ring 1899 includes or defines opposing engagement surface 1815 for engagement with diamond engagement surface 1813. In some embodiments, bearing ring 1899 is replaceable, such that after a certain degree of wear to bearing ring 1899, bearing ring 1899 may be removed from drive shaft 1836 and a new and/or replacement bearing ring 1899 may then be coupled onto drive shaft 1836. Thus, the use of bearing ring 1899 may increase the usable lifetime of drive shaft 1836 because the wear only or mostly occurs on the replaceable bearing ring 1899 and not on drive shaft 1836. Bearing ring 1899 may encircle drive shaft 1836. Bearing ring 1899 is not limited to the shape shown in FIG. 18F. While the bearing ring is shown and described as being coupled about the drive shaft and positioned for engagement with the polycrystalline diamond elements that are on the bearing housing, the bearing assembly disclosed herein is not limited to this particular arrangement. For example, the bearing ring may be coupled about an inner surface of the bearing housing and positioned for engagement with the polycrystalline diamond elements that are on the outer surface of the drive shaft.

As shown in FIG. 18F, the cone component, or a portion thereof, of the conical bearing assemblies can be discrete. That is, in some embodiments the cone component, or a portion thereof, is not integral with the mandrel or drive shaft, but is a discrete component that is coupled therewith. Such an arrangement provides for the opposing engagement surface to have selected or engineered properties that are different from that of the mandrel or drive shaft (e.g., being composed of a different material composition). Such selected or engineered properties may include superior performance properties, such as higher wear-resistance properties in comparison to the mandrel or drive shaft surface. Also, such an arrangement, in some embodiments, provides for ease of repair and replacement, as well as a lower cost for repair and replacement.

FIG. 18G is a cross-sectional view of a portion of a drill string assembly substantially identical to that of FIG. 18F, with the exception that the drive shaft and bearing housing each have a bearing ring positioned thereabout. As shown in FIG. 18G, both the cup and cone components of the conical bearing assemblies disclosed herein can be discrete components. That is, drive shaft 1836 includes bearing ring 1899*a* coupled thereabout (i.e., not integral with the drive shaft). Also, bearing housing 1844 includes bearing ring 1899*b* coupled therewith, and not integral therewith. Polycrystalline diamond element 1801 is coupled with bearing ring 1899*b*, and includes diamond engagement surface 1813 engaged with opposing engagement surface 1815 of bearing ring 1899*a*.

While the polycrystalline diamond element is shown and described as coupled with bearing ring 1899*b* on bearing housing 1844 in FIG. 18G, in other embodiments the polycrystalline diamond elements are coupled with bearing ring 1899*a* on drive shaft 1836, such that the diamond engagement surface of the polycrystalline diamond elements engage with an opposing engagement surface of bearing ring 1899*b* (or of bearing housing 1844, in embodiments where bearing ring 1899*b* is not used). In some embodiments, the polycrystalline diamond elements are coupled with the drive shaft 1836 (when bearing ring 1899*a* is not used), and the polycrystalline diamond elements are engage with an opposing engagement surface of bearing ring 1899*b* (or of bearing housing 1844, in embodiments where bearing ring 1899*b* is not used).

In some embodiments, the bearing ring, the bearing housing, the drive shaft, or combinations thereof are composed, at least partially, of a "hardened material" as defined in U.S. patent Ser. No. 16/425,758, the entirety of which is incorporated herein by reference.

The bearing rings disclosed herein, including the embodiments shown in FIGS. 18F and 18G, can be used as sacrificial surfaces and/or components. That is, the bearing rings can be used to bear loads such that the surfaces of the bearing rings are worn. Worn bearing rings can be then be replaced without having to replace an entirety of the bearing assembly. Thus, in some embodiments, the bearing rings can provide for easier and more cost-effective repair and/or replacement of the bearing assemblies disclosed herein.

Deployment of Additional Components

In some embodiments, the additional space on the drive shaft and/or in the bearing housing that is available due to increased spatial distance between adjacent polycrystalline diamond elements is utilized to deploy one or more additional downhole components on the drill string assembly. For example, in a drive shaft in accordance with FIGS. 17A-17G, space 1763 between adjacent polycrystalline diamond elements may be used to deploy additional downhole components on or within the associated bearing housing.

Figure 19A:
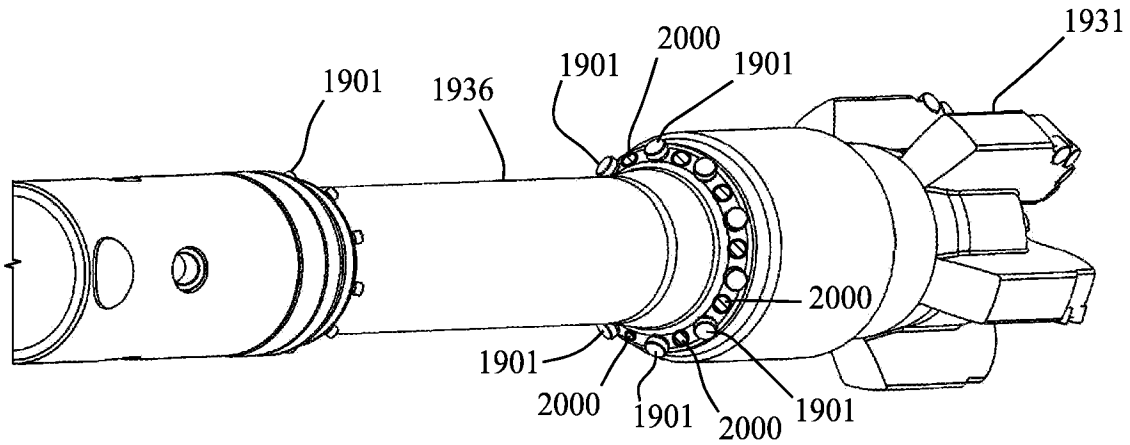
FIG. 19A is a perspective view of a portion of a drill string assembly with spaced-apart polycrystalline diamond elements, with additional downhole components positioned within the spaces between adjacent polycrystalline diamond elements.
Figure 19B:
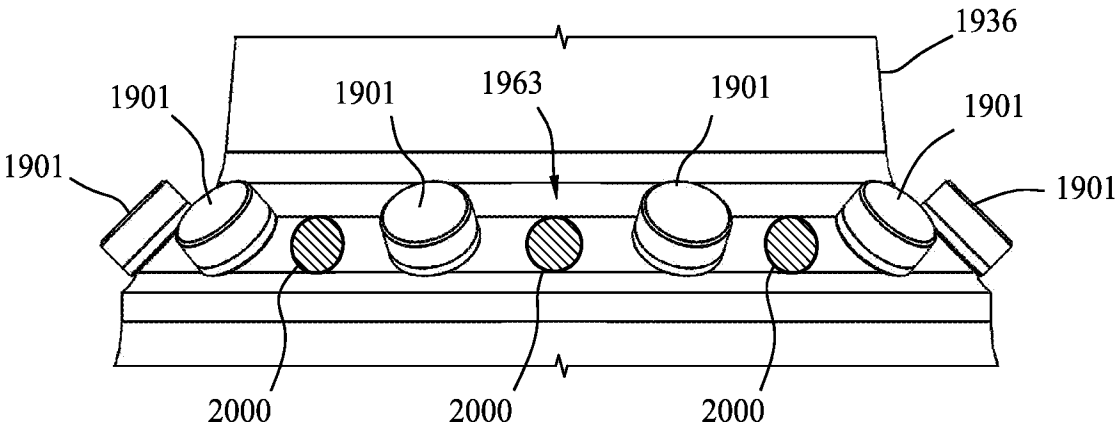
FIG. 19B is a side view of a portion of the drill string assembly of FIG. 19A.

With reference to FIGS. 19A and 19B, drive shaft 1936 is depicted engaged with a plurality of polycrystalline diamond elements 1901, which are coupled with a bearing housing (not shown) that is the same or similar to the bearing housing (1444) shown in FIGS. 14A-14C. Spaces 1963, positioned between adjacent polycrystalline diamond elements 1901, may accommodate downhole components 2000. While downhole components 2000 are shown positioned between each set of adjacent polycrystalline diamond elements 1901, the drive shafts disclosed herein are not limited to including a downhole component between each set of adjacent polycrystalline diamond elements. In some embodiments, at least one space between adjacent polycrystalline diamond elements lacks a downhole component. In some embodiments, at least one space between adjacent polycrystalline diamond elements includes multiple downhole components. The downhole components may be embedded in, attached to, or otherwise coupled with the bearing housing. By incorporating downhole components where there would otherwise be bearing elements (e.g., polycrystalline diamond elements) or empty space, the available space on the bearing housing is more efficiently utilized. As such, the bearing housing may be incorporated with additional functionalities and capabilities that would otherwise not be available, or at least would otherwise occupy additional surface area on the bearing housing or other part of the drill string assembly. That is, spacing the polycrystalline diamond elements apart provides additional surface area on the drill string assembly that would otherwise not be available for use; thereby, increasing the potential functionality of the bearing housing and utilization of the space thereon. Each of the plurality of downhole components 2000 may be the same, or the plurality of downhole components 2000 may include multiple different downhole components. Each downhole component 2000 may be or include a mechanical downhole component, an electromechanical downhole component, a sensor, communication components, or recording components. For example, and without limitation, each downhole component 2000 may be or include a mechanical or electromechanical downhole component, such as a dynamic lateral pad (DLP), a dynamic lateral cutter (DLC), a mandrel driven generator, one or more batteries, an actuator, an extendable sensor (e.g., a sensor in face of a DLP), an extendable reamer blade, a caliper, or a rotary electrical connection, such as a slip ring, a rotary union, or a fiber optic rotary joint. Each downhole component 2000 may be or include a sensor, such as an azimuth sensor (gyroscope), an inclination sensor (inclinometer, gyroscope, magnometer), an accelerometer (to measure vibrations), an acoustic sensor, a gamma ray sensor (e.g., a scintillation crystal), a density sensor (deinsimeter), a resistivity sensor (electrodes, current generator), a temperature sensor (thermocouple), a pressure sensor (pressure transducers), a magnetic field sensor, a torque sensor, a weight on bit (WOB) sensor, a bending moments sensor (strain gage), an RPM sensor (e.g., accelerometers, tachometers), a linear displacement sensor (e.g., for use with calipers, pads), such as a linear variable differential transformer (LVDT) sensor, a porosity, lithology, permeability or rock strength sensor (e.g., piezoelectric transducers and receivers, such as for sonic and ultrasonic components, or a nuclear magnetic resonance sensor. Each downhole component 2000 may be or include a communication and/or recording component, such as a pulser, a data storage, a transmitter, or a microprocessor. As used herein DLPs and DLCs are those shown and described in U.S. Patent Publication No. 2017/70234071, the entirety of which is incorporated herein by reference and made a part of the present disclosure.

In some embodiments, the spacing between adjacent polycrystalline diamond elements can be selected and/or determined such that a desired downhole component can be positioned therein. For example, if it is know that a temperature sensor of a particular size is needed, the bearing assembly can be designed such that at least one spacing between two adjacent polycrystalline diamond elements is of sufficient size that the temperature sensor can be positioned therein, while still attaining sufficient bearing capacity for the particular drilling operation. Thus, in some embodiments the number of polycrystalline diamond elements in the bearing assembly is not maximized but is, instead, designed to be sufficient to bear expected load while also being spaced apart enough to provide space for additional downhole components. In some embodiments, adjacent polycrystalline diamond elements are spaced apart on the conical radial bearing to provide axial space on the drill string that would otherwise not be available for downhole components. In some embodiments, additional space for placement of downhole components on the drill string is formed by maintaining a standard bit-to-bend length while also using the bearing technology disclosed herein (e.g., having spaced apart adjacent polycrystalline diamond elements in accordance with FIGS. 17A-17G) that only requires a portion of the standard bit-to-bend length. That is, the additional unneeded bit-to-bend length may be utilized for incorporation of additional downhole components onto the drill string.

Figure 19C:
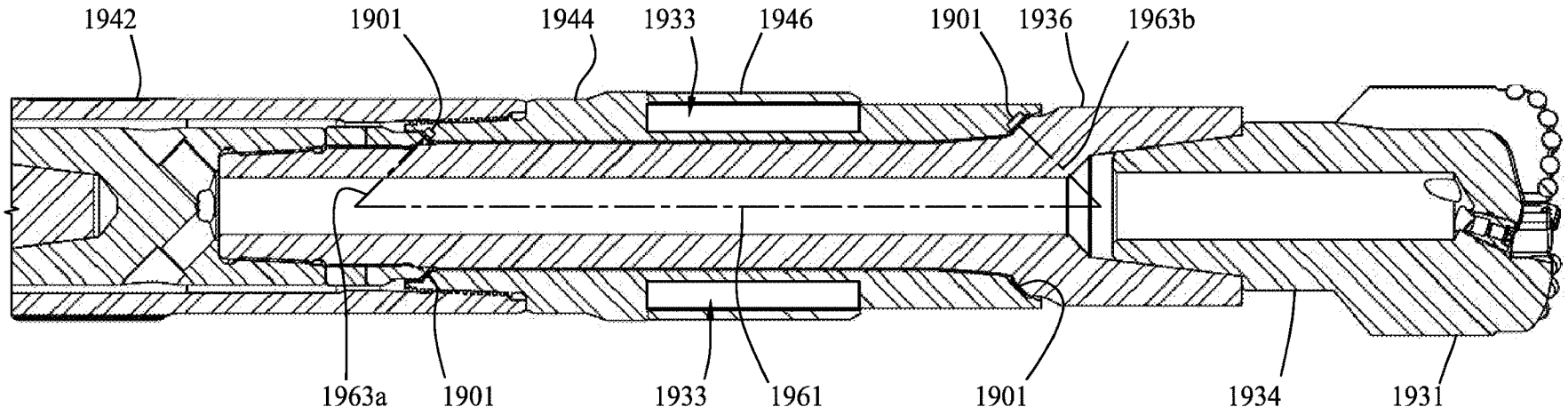
FIG. 19C is a cross-sectional view of a portion of the drill string assembly, showing additional available space in a bearing housing.
Figure 19D:
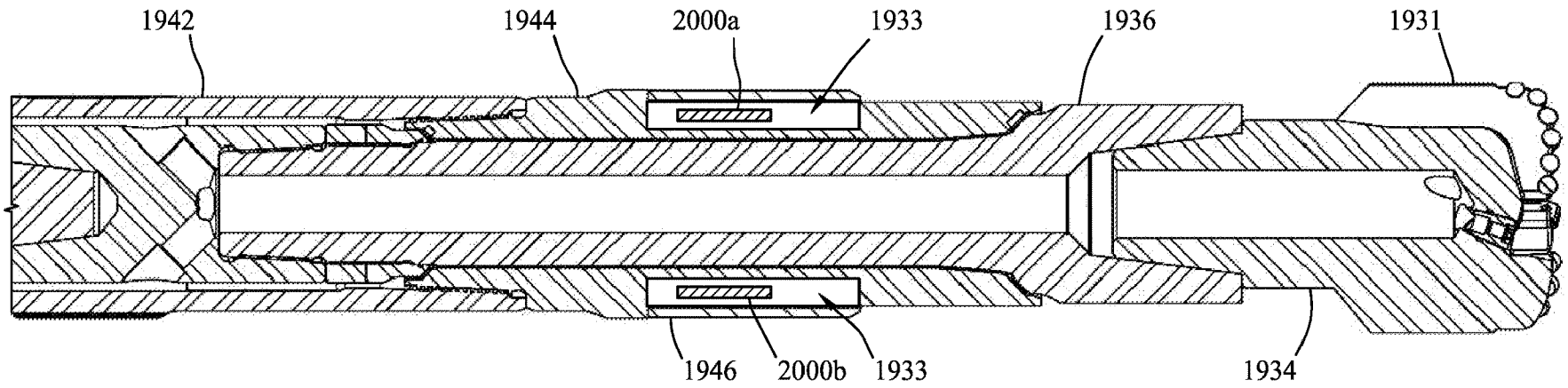
FIG. 19D is a cross-sectional view of a portion of the drill string assembly, identical to FIG. 19C, with the exception of showing additional downhole components in the available space in the bearing housing.

FIG. 19C depicts additional space 1933 on bearing housing 1944 that may be available when using the conical bearing assemblies disclosed herein, with polycrystalline diamond elements 1901 arranged in a spaced-apart configuration, such as is shown in FIGS. 17A-17G. FIG. 19D is identical to FIG. 19C, with the exception that additional downhole components 2000*a* and 2000*b* are positioned in additional spaces 1933.

In some embodiments, the bearings disclosed herein may be sealed bearing packages. In other embodiments, the bearings disclosed herein may be unsealed bearing package.

One skilled in the art would understand that the drill string assembly and drilling motor disclosed herein is not limited to the particular arrangement of parts shown and described with reference to FIGS. 14A-19D. For example, while the drive shaft is described as being connected with the rotor, the drive shaft may be integral with and an extension of the rotor. Also, the drill bit is described as being connected with the drive shaft, the drill bit or a portion thereof may be integral with and an extension of the drive shaft.

One skilled in the art would understand that the features shown and described with respect to FIGS. 1-13B with respect to rotors and stators can be combined with and/or applied to the drive shaft and bearing housing assembly described with reference to FIGS. 14A-19D. For example, the same or similar polycrystalline diamond elements may be used, and may be mounted in the same or similar way. Also, a drive shaft and bearing housing in accordance with FIGS. 14A-19D may be coupled with a rotor and stator in accordance with FIGS. 1-13B.

Bearing Housing Antenna

In some embodiments, the bearing housing functions as an antenna for communication between the downhole components incorporated into or on the bearing housing and other components, such as other downhole components or surface components at the surface (i.e., not downhole). For example, the bearing housing, or a portion thereof, may be composed of an electrically conductive material that is capable of transmitting data signals to and/or from downhole components, such as a copper alloy. For example, the downhole components incorporated into or on the bearing housing may include a sensor that is coupled with the bearing housing such that sensor measurement data from sensor may be transmitted along bearing housing, or a portion thereof, when bearing housing is configured to function as an antenna.

Applications

The bearing assemblies disclosed herein may form a portion of a machine or other apparatus or system. In some such aspects, the proximal end of the stator may be connected to another component, such as a drill string or motor housing by threaded connection, welding, or other connection means as known in the art. In some aspects, if the bearing assembly is used in a downhole application, the distal end of the rotor may be augmented by a thrust bearing and may carry a threaded connection for the attachment of a drill bit, or the distal end of the rotor may be a drill bit directly formed on and/or positioned on the end of the mandrel of the rotor. The component connections are not limited to downhole applications, and can be applied to other applications, for example wind turbine energy generators, or marine applications.

Furthermore, discrete versions of the bearing assemblies described herein may be used in a broad array of other applications including, but not limited to, heavy equipment, automotive, turbines, transmissions, rail cars, computer hard drives, centrifuges, medical equipment, pumps, and motors.

In certain aspects, the bearing assemblies disclosed herein are suitable for deployment and use in harsh environments (e.g., downhole). In some such aspects, the bearing assemblies are less susceptible to fracture than bearing assemblies where a polycrystalline diamond engagement surface engages with another polycrystalline diamond engagement surface. In certain aspects, such harsh environment suitable radial bearings provide enhanced service value in comparison with bearing assemblies that include a polycrystalline diamond engagement surface engaged with another polycrystalline diamond engagement surface. Furthermore, the bearing assemblies disclosed herein may be capable of being spaced apart at greater distances that the spacings required when using bearing assemblies that include a polycrystalline diamond engagement surface engaged with another polycrystalline diamond engagement surface.

In certain applications, the bearing assemblies disclosed herein can act as a rotor catch, such as in downhole applications.

In lubricated environments, the bearing assemblies may benefit from the hydrodynamic effect of the lubricant creating a clearance between the moving and stationary elements of the bearing assembly.

Exemplary Testing

In an effort to develop a robust cam follower interface for use in Applicants' previously referenced "Drilling Machine" of U.S. patent application Ser. No. 15/430,254 (the '254 Application), Applicants designed and constructed an advanced test bench. The test bench employed a 200 RPM electric gearmotor driving a hard-faced ferrous rotor mandrel inside a hard-faced ferrous stator housing. The mandrel incorporated a non-hard faced offset camming cylinder midway along its length. The rotor/stator assembly was fed a circulating fluid through the use of a positive displacement pump. Candidate cam follower interface mechanisms were placed in contact and under load with the camming cylinder of the rotor mandrel. Employing the test bench, candidate interface mechanisms were tested for survivability and wear under loads ranging from 500 to 3000 lbf either in clear water or in sand laden drilling fluid.

The Applicants conducted testing of the ferrous camming cylinder in sliding contact with polished polycrystalline diamond surfaces without deleterious effects or apparent chemical interaction. Ferrous materials are attractive for bearing applications due to their ready availability, ease of forming and machining, higher elasticity, and lower cost than so called superhard materials.

The testing program conducted by the Applicants has established that, even at relatively high loads and high RPM speeds, a successful load interface between polycrystalline diamond and diamond reactive materials can be employed in bearing applications.

A key finding has been that, as long as polycrystalline diamond elements are not put into edge or point contact with diamond reactive materials, which, it is believed, could lead to machining and chemical interaction, the polycrystalline diamond can experience sliding contact with diamond reactive materials at the typical bearing loads and speeds called for in many applications. This unexpected and surprising success of the Applicants' testing has led to the development of new high performance radial bearings.

The testing program included tests of a curved ferrous surface in high load facial linear area contact with planar polycrystalline diamond under rotation. This testing produced a slightly discolored Hertzian contact area on the face of the PDC about 0.250" in width along the entire ½" wide face of the polycrystalline diamond. The width of the contact area can be explained by the cam offset, vibration in the system and by slight deformation of the ferrous metal under load. It is estimated that the total contact area on the ½" polycrystalline diamond element face, at any given point in time, is about 7%, or less, of the total area of the polycrystalline diamond element face. The configuration employed in the testing demonstrates that even a small surface area on the face of a polycrystalline diamond element can take significant load.

Additional testing of a spherical ferrous ball under load and rotation against a planar polycrystalline diamond face produced a small, approximately 0.030 diameter, discolored Hertzian contact area in the center of the polycrystalline diamond element. As in the contact explanation above, it is believed, without being bound by theory, that the diameter of the discoloration is a result of slight vibration in the test apparatus and by slight deformation of the ferrous metal under load.

Table 2, below, sets forth data summarizing the testing performed by the Applicants of various configurations of sliding interface.

| | Tested Mechanism - Bearing Steel Ball in Alloy Steel Cup Against Rotating Steel Cam Surface | RPM | Surface Speed | Loading | Result |
|---|---|---|---|---|---|
| Test 1 | 1.50 Ball Socket | 200 | 1.13 m/s | 1200 lb | Abort after 3 minutes, ball is not rolling, heavy galling on ball and cup |
| Test 2 | 1.25 Ball Socket | 200 | 1.13 m/s | 500 lb | Abort after 3 minutes, ball is not rolling, heavy galling on ball and cup |
| Test 3 | Single Polished PDC 1.50 Ball | 200 | 1.13 m/s | 700 lb | Ball is rolling, wear of steel on side wall of cup after 45 minutes |
| Test 4 | Tripod Polished PDC 1.50 Ball | 200 | 1.13 m/s | 700 lb | 20 hr. test, little wear on Ball slight Hertzian trace on PDCs |
| | Tested Mechanism - Planar PDC Rotating Steel Cam Surface | | | | |
| Test 5 | Single Polished PDC Shder | 200 | 1.13 m/s | 900 lb | Ran 20 hours, PDC direct on steel cam in water. Slight, small Hertzian trace on PDC |
| Test 6 | Single Polished PDC Slider | 200 | 1.13 m/s | 900 lb | Varied load from zero, 4 hrs, good results in water. Slight, small Hertzian trace on PDC |
| Test 7 | Single Polished PDC Slider | 200 | 1.13 m/s | 2000 lb | Varied load from zero, 20 hrs, good results in water. Slight, small Hertzian trace on PDC |

-continued

| | | | | | |
|---|---|---|---|---|---|
| Test S | Single Polished PDC Slider | 200 | 1.13 m/s | 2000 lb | Drilling Fluid & Sand test, 32+ brs, good results. Slight, small Hertzian trace on PDC |
| Test 9 | Single Polished PDC Slider | 200 | 1.13 m/s | 3000 lb | Mud test at 3000 Ibf, 10 hrs, good results. Slight, small Hertzian trace on PDC |
| Test 10 | Single Polished vs Single Unpolished | 200 | 1.13 m/s | 1100 lb | Mud test, 2 hours each, Unpolished coefficient of friction at least 50% higher by ampere measurement |

Tests 1 and 2 summarize failed tests of individual steel balls rolling in a steel cup under load. Test 3 summarizes the results of a more successful test of a steel ball supported by a single polished PDC element in a steel cup. Test 4 summarizes a very successful test of a single steel ball supported by an array of three polished polycrystalline diamond elements in a steel cup. Tests 5 through 9 summarize increasingly rigorous tests each of a single polished polycrystalline diamond element in sliding contact with a rotating ferrous cam surface. Test 10 summarizes a comparative test of a single polished polycrystalline diamond element versus a single unpolished polycrystalline diamond element, each in sliding contact with a rotating ferrous cam surface. The final test shows a significant increase in coefficient of friction when the unpolished polycrystalline diamond element was used. The conditions and results presented in Table 2 are emblematic of the potential use of polycrystalline diamond on diamond reactive material and are not to be considered limiting or fully encompassing of the technology of the application.

Testing Conclusions

It was found that applications of polycrystalline diamond elements in a radial bearing can employ far less than the full face of the elements and still take significant load. This finding means effective polycrystalline diamond element containing radial bearings can be designed and manufactured without the need for full face contact of the polycrystalline diamond elements with the opposing surface. Employing this finding in the technology of the present application means it is possible to manufacture radial bearings with far less processing of the polycrystalline diamond elements used and substantially reducing the risk of edge clashing, or of the instigation of machining of a diamond reactive material opposing surface.

Without being bound by theory, in operation, running a cam and cam follower in a liquid cooled, lubricated environment, allows for higher speeds and loads to be attained without commencing a thermo-chemical reaction. Further, a polycrystalline diamond face that has been polished, notably, provides a lower thermo-chemical response.

From the descriptions and figures provided above it can readily be understood that the bearing assembly technology of the present application may be employed in a broad spectrum of applications, including those in downhole environments. The technology provided herein additionally has broad application to other industrial applications.

Furthermore, while shown and described in relation to engagement between surfaces in a radial bearing assembly, one skilled in the art would understand that the present disclosure is not limited to this particular application and that the concepts disclosed herein may be applied to the engagement between any diamond reactive material surface that is engaged with the surface of a diamond material.

EMBODIMENTS

Certain embodiments will now be described.

Embodiment 1. A downhole drilling tool for use in a downhole drill string, the downhole drilling tool comprising: a rotor movably coupled within a stator; a drive shaft movably coupled within a bearing housing, the drive shaft having a first end coupled with the rotor and a second end coupled with a drill bit; a bearing assembly interfacing engagement between the drive shaft and the bearing housing, the bearing assembly comprising: a plurality of spaced-apart polycrystalline diamond elements, wherein each polycrystalline diamond elements has an engagement surface; and an opposing engagement surface comprising a metal that is softer than tungsten carbide, wherein the opposing engagement surface is movably engaged with each of the engagement surfaces; wherein the plurality of polycrystalline diamond elements are coupled with the drive shaft and the opposing engagement surface is a surface on the bearing housing, or wherein the plurality of polycrystalline diamond elements are coupled with the bearing housing and the opposing engagement surface is a surface on the drive shaft.

Embodiment 2. The downhole drilling tool of embodiment 1, wherein the bearing assembly comprises a first bearing assembly interfacing engagement between the drive shaft and the bearing housing at the first end of the drive shaft, and a second bearing assembly interfacing engagement between the drive shaft and the bearing housing at the second end of the drive shaft.

Embodiment 3. The downhole drilling tool of embodiment 1 or 2, wherein the plurality of polycrystalline diamond elements are coupled with the drive shaft and the opposing engagement surface is a surface on the bearing housing.

Embodiment 4. The downhole drilling tool of embodiment 1 or 2, wherein the plurality of polycrystalline diamond elements are coupled with the bearing housing and the opposing engagement surface is a surface on the drive shaft.

Embodiment 5. The downhole drilling tool of embodiment 2, wherein the first and second bearing assemblies are radiused conical bearings, each including a cup portion that is coupled with a cone portion.

Embodiment 6. The downhole drilling tool of embodiment 5, wherein the cup portion is a portion of the bearing housing and the cone portion is a portion of the drive shaft.

Embodiment 7. The downhole drilling tool of embodiment 6, wherein opposing engagement surface is a surface on the cup portion, and wherein the plurality of polycrystalline diamond elements are on a surface of the cone portion.

Embodiment 8. The downhole drilling tool of embodiment 6, wherein opposing engagement surface is a surface on the cone portion, and wherein the plurality of polycrystalline diamond elements are on a surface of the cup portion.

Embodiment 9. The downhole drilling tool of any of embodiments 1 to 8, wherein the opposing engagement surface is a single, continuous surface, and wherein the engagement surfaces are multiple, discrete, spaced-apart surfaces that are positioned to engage with the opposing engagement surface.

Embodiment 10. The downhole drilling tool of embodiment 2, wherein the first and second bearing assemblies bear both radial and thrust loads.

Embodiment 11. The downhole drilling tool of embodiment 2, wherein the first and second bearing assemblies are oriented in opposing directions.

Embodiment 12. The downhole drilling tool of any of embodiments 1 to 11, wherein a bearing element spacing between adjacent polycrystalline diamond elements is greater than a width of each of the adjacent polycrystalline diamond elements.

Embodiment 13. The downhole drilling tool of any of embodiments 1 to 12, wherein the engagement surface of each polycrystalline diamond element is a planar surface.

Embodiment 14. The downhole drilling tool of any of embodiments 1 to 13, wherein the engagement surface of each polycrystalline diamond element has a surface finish that is equal to or less than 10 μin.

Embodiment 15. The downhole drilling tool of any of embodiments 1 to 14, wherein a contact area between each engagement surface and the opposing engagement surface is less than 75% of a total surface area of that engagement surface.

Embodiment 16. The downhole drilling tool of any of embodiments 1 to 15, wherein the metal of the opposing engagement surface is a diamond reactive metal.

Embodiment 17. The downhole drilling tool of any of embodiments 1 to 16, wherein the metal of the opposing engagement surface comprises iron or an alloy thereof, cobalt or an alloy thereof, nickel or an alloy thereof, ruthenium or an alloy thereof, rhodium or an alloy thereof, palladium or an alloy thereof, chromium or an alloy thereof, manganese or an alloy thereof, copper or an alloy thereof; titanium or an alloy thereof; or tantalum or an alloy thereof.

Embodiment 18. The downhole drilling tool of any of embodiments 1 to 17, further comprising one or more downhole components positioned in a space between two adjacent polycrystalline diamond elements, positioned in on or within the bearing housing, or combinations thereof.

Embodiment 19. The downhole drilling tool of embodiment 18, wherein the downhole components comprise a mechanical or an electromechanical downhole component.

Embodiment 20. The downhole drilling tool of embodiment 19, wherein the downhole components comprise a dynamic lateral pad (DLP), a dynamic lateral cutter (DLC), a mandrel driven generator, one or more batteries, an actuator, a sensor, a reamer blade, a caliper, a rotary electrical connection, or combinations thereof.

Embodiment 21. The downhole drilling tool of embodiment 20, wherein the downhole components comprise a slip ring, a rotary union, a fiber optic rotary joint, or combinations thereof.

Embodiment 22. The downhole drilling tool of embodiment 18, wherein the downhole components comprise a sensor.

Embodiment 23. The downhole drilling tool of embodiment 22, wherein the downhole components comprise an azimuth sensor, an inclination sensor, an accelerometer, an acoustic sensor, a gamma ray sensor, a density sensor, a resistivity sensor, a temperature sensor, a pressure sensor, a magnetic field sensor, a torque sensor, a weight on bit (WOB) sensor, a bending moments sensor, an RPM sensor, a linear displacement sensor, one or more sensors for detecting porosity sensor, one or more sensors for detecting permeability, a piezoelectric transducer and receiver, a nuclear magnetic resonance sensor, or combinations thereof.

Embodiment 24. The downhole drilling tool of embodiment 18, wherein the downhole components comprise a communication or recording component.

Embodiment 25. The downhole drilling tool of embodiment 24, wherein the downhole components comprises a pulser, a data storage, a transmitter, a microprocessor, or combinations thereof.

Embodiment 26. A bearing assembly for use in a downhole drill string, the bearing assembly comprising: a drive shaft movably coupled within a bearing housing, the drive shaft having a first end and a second end; a bearing assembly interfacing engagement between the drive shaft and the bearing housing the bearing assembly comprising: a plurality of polycrystalline diamond elements, wherein each polycrystalline diamond element has an engagement surface; and an opposing engagement surface comprising a metal that is softer than tungsten carbide, wherein the opposing engagement surface is movably engaged with each of the engagement surfaces; wherein the plurality of polycrystalline diamond elements are coupled with the drive shaft and the opposing engagement surface is a surface on the bearing housing, or wherein the plurality of polycrystalline diamond elements are coupled with the bearing housing and the opposing engagement surface is a surface on the drive shaft.

Embodiment 27. A method of bearing radial and thrust load in a drill string bearing assembly, the method comprising: coupling a drive shaft within a bearing housing, the drive shaft having a first end and a second end, wherein coupling the drive shaft within the bearing housing includes interfacing engagement between the drive shaft and the bearing housing with a bearing assembly, the bearing assembly comprising: a plurality of polycrystalline diamond elements, wherein each polycrystalline diamond elements has an engagement surface; and an opposing engagement surface comprising a metal that is softer than tungsten carbide, wherein the opposing engagement surface is movably engaged with each of the engagement surfaces; wherein the plurality of polycrystalline diamond elements are coupled with the drive shaft and the opposing engagement surface is a surface on the bearing housing, or wherein the plurality of polycrystalline diamond elements are coupled with the bearing housing and the opposing engagement surface is a surface on the drive shaft; and bearing radial and thrust loads on the drive shaft with the bearing assembly.

Embodiment 28. The method of embodiment 27, wherein interfacing engagement between the drive shaft and the bearing housing with the bearing assembly includes continuously engaging the opposing engagement surface with each of the engagement surfaces, wherein the opposing engagement surface is a single, continuous surface, and wherein the engagement surfaces are multiple, discrete, spaced-apart surfaces that are positioned to engage with the opposing engagement surface.

Embodiment 29. The method of embodiment 27 or 28, further comprising positioning the plurality of polycrystalline diamond elements such that a bearing element spacing between adjacent polycrystalline diamond elements is greater than a width of each of the adjacent polycrystalline diamond elements.

Embodiment 30. The method of any of embodiments 27 to 29, wherein interfacing engagement between the drive shaft and the bearing housing with the bearing assembly includes engaging a contact area of each engagement surface with the opposing engagement surface, wherein the contact area of each engagement surface is less than 75% of a total surface area of that engagement surface.

Embodiment 31. The method of any of embodiments 27 to 30, wherein the metal of the opposing engagement surface is a diamond reactive metal, and wherein the method includes polishing the engagement surfaces to have a surface finish that is equal to or less than 10 μin.

Embodiment 32. The method of any of embodiments 27 to 31, further comprising positioning a downhole component in a space between two adjacent polycrystalline diamond elements.

Embodiment 33. A method of designing a bearing assembly for a drive shaft and bearing housing of a downhole drilling tool, wherein the bearing assembly includes polycrystalline diamond elements, each polycrystalline diamond element including an engagement surface in sliding engagement with an opposing engagement surface, the opposing engagement surface includes a metal that is softer than tungsten carbide, the method comprising: determining if a maximum sliding speed of the drive shaft and the bearing housing is less than a preset limit; if the maximum sliding speed is less than the preset limit, selecting a configuration of the bearing assembly within the drive shaft and bearing housing; calculating a maximum contact pressure per polycrystalline diamond element based on a selected number of polycrystalline diamond elements in the selected configuration of the bearing assembly within the drive shaft and bearing housing, and based on anticipated load, wherein the calculated maximum contact pressure is optionally multiplied by a safety factor; determining if the calculated maximum contact pressure, optionally multiplied by the safety factor, is below a preset maximum allowable pressure; wherein, if the calculated maximum contact pressure is determined to be below the preset maximum allowable pressure, deploying at least a minimum number of the polycrystalline diamond elements on the selected configuration of the bearing assembly within the drive shaft and bearing housing, and, if the number of the polycrystalline diamond elements fit on the selected configuration of the bearing assembly within the drive shaft and bearing housing, making the bearing assembly for the drive shaft and bearing housing.

Embodiment 34. The method of embodiment 33, wherein selecting the configuration of the bearing assembly within the drive shaft and bearing housing includes selecting a configuration that has at least one space between adjacent polycrystalline diamond elements that is of a sufficient size such that a downhole component is positionable in the space between the adjacent polycrystalline diamond elements or is positionable on or in the bearing housing.

Embodiment 35. The method of embodiment 32, further comprising transmitting data to or from the downhole component via at least a portion of the bearing housing that is an antenna.

Embodiment 36. The method of embodiment 27, further comprising: positioning a bearing ring about the bearing housing, wherein the plurality of polycrystalline diamond elements are coupled with the drive shaft and the opposing engagement surface is a surface on the bearing ring; or positioning a bearing ring about the drive shaft, wherein the plurality of polycrystalline diamond elements are coupled with the bearing housing and the opposing engagement surface is a surface on the bearing ring.

Embodiment 37. The downhole tool of embodiment 1, further comprising a bearing ring; and wherein: the plurality of polycrystalline diamond elements are coupled with the drive shaft, the bearing ring is coupled with the bearing housing, and the opposing engagement surface is a surface on the bearing ring; or the plurality of polycrystalline diamond elements are coupled with the bearing housing, the bearing ring is coupled with the drive shaft, and the opposing engagement surface is a surface on the bearing ring.

Embodiment 38. The downhole tool of embodiment 1, wherein the downhole tool is a downhole drilling motor.

Embodiment 39. The method of embodiment 37, further comprising, after the surface on the bearing ring is worn, replacing the bearing ring with a replacement bearing ring, including: positioning the replacement bearing ring about the bearing housing, wherein the plurality of polycrystalline diamond elements are coupled with the drive shaft and the opposing engagement surface is a surface on the replacement bearing ring; or positioning the replacement bearing ring about the drive shaft, wherein the plurality of polycrystalline diamond elements are coupled with the bearing housing and the opposing engagement surface is a surface on the replacement bearing ring.

Although the present embodiments and advantages have been described in detail, it should be understood that various changes, substitutions and alterations can be made herein without departing from the spirit and scope of the disclosure. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A radiused conical bearing, the radiused conical bearing comprising:

a bearing cup, the bearing cup having a first bearing surface; and a bearing cone, the bearing cone having a second bearing surface;

wherein one of the first and second bearing surfaces is a diamond bearing surface comprising polycrystalline diamond, and wherein the other of the first and second bearing surfaces is a metal bearing surface comprising a metal that contains at least 2 weight percent of a diamond solvent or diamond catalyst based on a total weight of the metal; and wherein the metal bearing surface is in sliding contact with the diamond bearing surface.

2. The radiused conical bearing of claim 1, wherein the first and second bearing surfaces are angled bearing surfaces.

3. The radiused conical bearing of claim 1, wherein the first and second bearing surfaces are tapered bearing surfaces.

4. The radiused conical bearing of claim 3, wherein the first bearing surface tapers toward a center of the bearing cup, and wherein the second bearing surface tapers toward an outer diameter of the bearing cone.

5. The radiused conical bearing of claim 1, wherein the first and second bearing surfaces are annular bearing surfaces.

6. The radiused conical bearing of claim 1, wherein the bearing cone has a frustoconical shape.

7. The radiused conical bearing of claim 1, wherein the radiused conical bearing bears radial load, thrust load, or combinations thereof.

8. The radiused conical bearing of claim 1, wherein the diamond bearing surface is a surface of a polycrystalline diamond element.

9. The radiused conical bearing of claim 8, wherein the polycrystalline diamond element is a polycrystalline diamond compact.

10. The radiused conical bearing of claim 1, wherein one of the bearing cup and the bearing cone comprise a plurality of diamond bearing surfaces including the diamond bearing surface, wherein each diamond bearing surface comprises polycrystalline diamond.

11. The radiused conical bearing of claim 10, wherein each diamond bearing surface is a surface of one of a plurality of spaced-apart polycrystalline diamond elements positioned on a surface of the bearing cup or a surface of the bearing cone.

12. The radiused conical bearing of claim 1, wherein the metal bearing surface is in sliding contact with less than an entirety of the diamond bearing surface.

13. The radiused conical bearing of claim 12, wherein a contact area of the diamond bearing surface is in sliding contact with the metal bearing surface.

14. The radiused conical bearing of claim 13, wherein the contact area is less than 90% of a surface area of the diamond bearing surface.

15. The radiused conical bearing of claim 13, wherein the contact area is a linear contact area.

16. The radiused conical bearing of claim 13, wherein the radiused conical bearing has an axis of rotation, and wherein an imaginary line extending from and normal to the contact area is at an angle relative to the axis of rotation.

17. The radiused conical bearing of claim 1, wherein the metal bearing surface is a single, continuous metal bearing surface.

18. The radiused conical bearing of claim 17, wherein multiple discrete, spaced-apart diamond bearing surfaces, including the diamond bearing surface, are in sliding contact with the single, continuous metal bearing surface.

19. The radiused conical bearing of claim 18, wherein the multiple, discrete, spaced-apart diamond bearing surfaces maintain constant contact with the single continuous metal bearing surface.

20. The radiused conical bearing of claim 1, wherein the diamond solvent or diamond catalyst comprises iron, cobalt, nickel, ruthenium, rhodium, palladium, chromium, manganese, copper, titanium, or tantalum.

21. The radiused conical bearing of claim 1, wherein the metal is steel.

22. The radiused conical bearing of claim 1, wherein the metal is softer than a superhard material.

23. The radiused conical bearing of claim 1, wherein the metal is softer than tungsten carbide.

24. The radiused conical bearing of claim 1, wherein the first bearing surface is the diamond bearing surface, and wherein the second bearing surface is the metal bearing surface.

25. The radiused conical bearing of claim 1, wherein the second bearing surface is the diamond bearing surface, and wherein the first bearing surface is the metal bearing surface.

26. The radiused conical bearing of claim 1, wherein the first bearing surface is a first annular surface that tapers toward a center of the bearing cup at a first angle;

wherein the second bearing surface is a second annular surface that tapers toward an outer diameter of the bearing cone at a second angle;

wherein one of the first and second annular surfaces comprises a plurality of polycrystalline diamond bearing elements, each polycrystalline diamond bearing having a diamond surface thereon including the diamond bearing surface, and wherein the other of the first and second annular surfaces is the metal bearing surface comprising the metal, wherein the metal comprises steel; and wherein the metal bearing surface is in sliding contact with each of the diamond bearing surfaces.

27. A downhole tool, the downhole tool comprising:

a rotor;

a stator;

a first bearing ring coupled with one of the rotor and the stator, and a polycrystalline diamond bearing element coupled with the other of the rotor and the stator;

wherein the first bearing ring comprises a metal bearing surface, the metal bearing surface comprising a metal that contains at least 2 weight percent of a diamond solvent or diamond catalyst based on a total weight of the metal;

wherein the polycrystalline diamond bearing element has a diamond bearing surface; and wherein the metal bearing surface is in contact with the diamond bearing surface.

28. The downhole tool of claim 27, wherein the metal bearing surface is in sliding contact with the diamond bearing surface.

29. The downhole tool of claim 27, wherein the polycrystalline diamond bearing element bears radial load, axial load, or combinations thereof.

30. The downhole tool of claim 27, wherein the first bearing ring is positioned between the rotor and the stator.

31. The downhole tool of claim 27, wherein the first bearing ring is coupled with the rotor, and wherein the polycrystalline diamond bearing element is coupled with the stator.

32. The downhole tool of claim 27, wherein the first bearing ring is coupled with the stator, and wherein the polycrystalline diamond bearing element is coupled with the rotor.

33. The downhole tool of claim 27, further comprising a second bearing ring, wherein the polycrystalline diamond bearing element is coupled with the second bearing ring.

34. The downhole tool of claim 33, wherein the first bearing ring is coupled with the rotor and the second bearing ring is coupled with the stator.

35. The downhole tool of claim 34, wherein the rotor is a drive shaft, and wherein the stator is a bearing housing.

36. The downhole tool of claim 34, wherein the metal of the first bearing ring has higher wear-resistance than a metal of the rotor.

37. The downhole tool of claim 33, wherein the first and second bearing rings are replaceable.

38. The downhole tool of claim 27, wherein the diamond solvent or diamond catalyst comprises iron, cobalt, nickel, ruthenium, rhodium, palladium, chromium, manganese, copper, titanium, or tantalum.

39. The downhole tool of claim 27, wherein the metal is steel.

40. The downhole tool of claim 27, wherein the metal is softer than a superhard material.

41. The downhole tool of claim 27, wherein the metal is softer than tungsten carbide.

42. A method of providing bearings in a downhole tool, the method comprising:

positioning a first bearing ring on one of a rotor and a stator;

positioning a second bearing ring on the other of the rotor and the stator;

wherein the first bearing ring comprises a metal bearing surface, the metal bearing surface comprising a metal that contains at least 2 weight percent of a diamond solvent or diamond catalyst based on a total weight of the metal;

wherein the second bearing ring comprises a polycrystalline diamond bearing element having a diamond bearing surface that is in contact with the metal bearing surface; and bearing load between the rotor and the stator with the metal bearing surface and the diamond bearing surface.

43. The method of claim 42, wherein the load is a radial load, an axial load, or combinations thereof.

44. The method of claim 42, further comprising, after a degree of wear on the first bearing ring, removing the first bearing and replacing the first bearing ring with a replacement bearing ring.

45. A downhole tool, the downhole tool comprising:

a stator;

a rotor, wherein one of the stator and the rotor comprises a metal bearing surface, the metal bearing surface comprising a metal that contains at least 2 weight percent of a diamond solvent or diamond catalyst based on a total weight of the metal;

a first bearing interfacing engagement between the rotor and the stator, the first bearing comprising a first polycrystalline diamond bearing element having a first diamond bearing surface, wherein the first polycrystalline diamond bearing element is positioned relative to the stator and the rotor such that the first diamond bearing surface is engaged with the metal bearing surface; and one or more downhole components coupled with the stator.

46. The downhole tool of claim 45, wherein the rotor comprises a transmission, and wherein the stator comprises a transmission housing, or wherein the rotor comprises a drive shaft, and wherein the stator comprises a bearing housing.

47. The downhole tool of claim 45, wherein the one or more downhole components comprise a sensor, a dynamic lateral pad, an MWD tool, an actuator, a transmitter, a dynamic lateral cutter, a generator, a battery, a reamer blade, a caliper, a rotary electrical connection, a slip ring, a rotary union, a fiber optic rotary joint, a pulser, a data storage, a microprocessor, or combinations thereof.

* * * * *